US008322814B2

(12) United States Patent
Hirato et al.

(10) Patent No.: US 8,322,814 B2
(45) Date of Patent: Dec. 4, 2012

(54) INKJET RECORDING APPARATUS AND METHOD, AND ABNORMAL NOZZLE DETECTION METHOD

(75) Inventors: Katsuyuki Hirato, Kanagawa-ken (JP); Baku Nishikawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 243 days.

(21) Appl. No.: 12/900,152

(22) Filed: Oct. 7, 2010

(65) Prior Publication Data

US 2011/0084996 A1 Apr. 14, 2011

(30) Foreign Application Priority Data

Oct. 8, 2009 (JP) ..... 2009-234424
Aug. 30, 2010 (JP) ..... 2010-192777

(51) Int. Cl.
*B41J 29/393* (2006.01)

(52) U.S. Cl. ..... 347/19; 347/10; 347/14; 347/12

(58) Field of Classification Search ..... 347/10, 347/12, 14, 19
See application file for complete search history.

(56) References Cited

U.S. PATENT DOCUMENTS

| | | | |
|---|---|---|---|
| 7,484,824 | B2 | 2/2009 | Chiwata |
| 2006/0061624 | A1 | 3/2006 | Nagashima |
| 2007/0279446 | A1 | 12/2007 | Ishizaki |
| 2009/0128594 | A1 | 5/2009 | Martinez et al. |

FOREIGN PATENT DOCUMENTS

| | | | |
|---|---|---|---|
| JP | 5-17712 | A | 1/1993 |
| JP | 11-348246 | A | 12/1999 |
| JP | 2003-205623 | A | 7/2003 |
| JP | 2005-205766 | A | 8/2005 |
| JP | 2006-347164 | A | 12/2006 |
| JP | 2010-83007 | A | 4/2010 |

OTHER PUBLICATIONS

Extended European Search Report dated Dec. 3, 2010 for European Application No. 10187004.6.

*Primary Examiner* — Julian Huffman
(74) *Attorney, Agent, or Firm* — Birch, Stewart, Kolasch & Birch, LLP

(57) ABSTRACT

The inkjet recording apparatus includes: an abnormal nozzle detective waveform signal generating device which generates a drive signal having an abnormal nozzle detective waveform including a waveform that is different from a recording waveform and applied to pressure generating elements when performing ejection for abnormality detection to detect an abnormal nozzle among nozzles; an abnormal nozzle detective device which identifies the abnormal nozzle showing an ejection abnormality from results of the ejection for abnormality detection; a correction control device which corrects image data in such a manner that ejection is stopped from the identified abnormal nozzle and a desired image is recorded by the nozzles other than the abnormal nozzle; and a recording ejection control device which performs image recording by controlling ejection from the nozzles other than the abnormal nozzle in accordance with the image data that has been corrected by the correction control device.

30 Claims, 24 Drawing Sheets

INKJET RECORDING APPARATUS AND METHOD, AND ABNORMAL NOZZLE DETECTION METHOD

BACKGROUND OF THE INVENTION

1. Field of the Invention

The present invention relates to an inkjet recording apparatus and method, and an abnormal nozzle detection method, and in particular to technology for detecting ejection defects (flight deviation of ejected droplets, volume abnormality of ejected droplets, splashing, ejection failure, and the like) occurring in an inkjet head having a plurality of nozzles (droplet ejection ports), and to correction technology for suppressing decline in image quality arising from nozzles having abnormalities.

2. Description of the Related Art

An inkjet apparatus forms images by ejecting and depositing a functional material (hereinafter, taken to be synonymous with "ink") using an inkjet head, and has characteristic features which include: excellent eco-friendly properties, capability for high-speed recording on various different recording media, the capability to achieve high-definition images which are not liable to bleeding.

However, in recording by an inkjet method, ejection defects occur with a certain probability in nozzles of the inkjet head, and stripe non-uniformities and density non-uniformities occur in recorded images at positions corresponding to the defective nozzles. These ejection defects which lead to decline in image quality produce an increase in wasted paper and give rise to a decline in throughput due to the carrying out of head maintenance.

In particular, in a single-pass method which performs image formation by means of one recording scan, even an ejection defect in one nozzle has a great effect on the overall image quality. Moreover, in the case of a single-pass method which emphasizes productivity, since the inkjet head is always positioned above recording media, then it is difficult to carry out head maintenance during the image formation operation.

Possible causes of the occurrence of ejection defects in the inkjet heads include: decline in ejection force due to bubbles which have entered into the nozzles, adherence of foreign matter to the vicinity of the nozzles, abnormality in the liquid-repelling properties in the vicinity of the nozzles, abnormality in the nozzle shapes, and the like. Moreover, a nozzle that has produced an ejection defect is liable to create an ink mist due to instable ejection, and this mist causes deterioration of the surrounding nozzles which are normally functioning. Various countermeasures have been proposed for suppressing the occurrence of ejection defects, such as deaeration of the ink (Japanese Patent Application Publication No. 05-017712), suctioning of ink mist (Japanese Patent Application Publication No. 2005-205766), and the like. However, it is difficult to completely prevent ejection defects.

In response to these problems, a method which detects, in advance, nozzles that are likely to produce ejection defects has been proposed (Japanese Patent Application Publication Nos. 2003-205623 and 11-348246).

Japanese Patent Application Publication No. 2003-205623 discloses technology for performing ejection failure nozzle detection at a maintenance position outside an image formation region by using a waveform that is different from a recording waveform, and carrying out maintenance in cases where an ejection failure has been detected. However, this technology has a problem in that throughput declines due to adopting a composition in which the print head is moved to the maintenance position outside the image formation region, and the ejection failure nozzle detection and the maintenance are carried out at the maintenance position. Moreover, it is silent about detection of ejection defects (e.g., flight deviation and splashing) other than ejection failures, and the actual waveform used for detection is not made clear.

Japanese Patent Application Publication No. 11-348246 discloses technology for detecting nozzles which have ejection abnormally and performing correction by means of the surrounding nozzles which are operating normally. However, in order to detect perceivable ejection abnormalities, the technology requires an expensive detective device, such as a high-resolution imaging device (e.g., CCD) capable of accurately determining the deposition of ink droplets or a device capable of measuring the state of flight of ink droplets, or the like; it also takes time for the detection process. Moreover, since it is not possible to detect abnormalities during image formation with this technology, then throughput declines.

As stated above, it has been difficult to achieve both recording stability and throughput in the related art.

SUMMARY OF THE INVENTION

The present invention has been contrived in view of these circumstances, an object thereof being to provide an inkjet recording apparatus and method, and an abnormal nozzle detection method whereby both recording stability and improved throughput can be achieved.

In order to attain the aforementioned object, the present invention is directed to an inkjet recording apparatus, comprising: an inkjet head which includes a plurality of nozzles through which droplets of liquid are ejected and a plurality of pressure generating elements corresponding to the nozzles; a conveyance device which conveys a recording medium; a recording waveform signal generating device which generates a drive signal having a recording waveform which is applied to the pressure generating elements when recording a desired image on the recording medium by means of the inkjet head; an abnormal nozzle detective waveform signal generating device which generates a drive signal having an abnormal nozzle detective waveform including a waveform that is different from the recording waveform and applied to the pressure generating elements when performing ejection for abnormality detection to detect an abnormal nozzle among the nozzles in the inkjet head; a detective ejection control device which causes the ejection for abnormality detection to be performed from the nozzles by applying the drive signal having the abnormal nozzle detective waveform to the pressure generating elements, in a state where the inkjet head is disposed in a head position which enables deposition of the ejected droplets onto the recording medium; an abnormal nozzle detective device which identifies the abnormal nozzle showing an ejection abnormality from results of the ejection for abnormality detection; a correction control device which corrects image data in such a manner that ejection is stopped from the identified abnormal nozzle and the desired image is recorded by the nozzles other than the abnormal nozzle; and a recording ejection control device which performs image recording by controlling ejection from the nozzles other than the abnormal nozzle in accordance with the image data that has been corrected by the correction control device.

According to this aspect of the present invention, the occurrence of the ejection abnormality is detected at an early stage by using the abnormal nozzle detective waveform before an image defect producing a visible density non-uniformity (stripe non-uniformity) occurs due to an ejection defect in an output image recorded by a drive signal having a recording waveform. An abnormal nozzle in which ejection is deteriorating is detected at an early stage, ejection from the abnormal nozzle is disabled (halted) before a defect appears in the output image, and the effects of decline in image quality due to the disabling of ejection of the abnormal nozzle are corrected by means of surrounding normal nozzles. Thus, it is possible to maintain recording stability and continuous recording with little paper waste is possible.

Furthermore, it is also possible to carry out abnormal nozzle detection at the head position where deposition of the ejected droplets onto the recording medium is possible (within the image formation area), without withdrawing the inkjet head to a maintenance position, or the like, and therefore it is also possible to avoid reduction in throughput as a result of detection.

Preferably, the desired image is recorded on an image forming region of the recording medium; and the ejection for abnormality detection is performed so as to deposit the ejected droplets onto a non-image region of the recording medium outside the image forming region.

There is a mode where a pattern, or the like, formed in the non-image region of the recording medium by the ejection for abnormality detection is read by an optical sensor, or the like, and abnormal nozzles are identified by analyzing and measuring this pattern. Furthermore, there is also a mode in which the ejected droplets in flight produced by the ejection for abnormality detection are detected by an optical sensor, or the like, and the abnormal nozzles are identified by analyzing and measuring the detection signal of the sensor.

Preferably, at least one of a test pattern for abnormal nozzle detection and a test pattern for density non-uniformity correction is formed in the non-image region on the recording medium.

There is also a mode in which a test pattern output control device is provided in order to output these test patterns, and either one of the test patterns is output selectively according to requirements. For example, the occurrence or non-occurrence of abnormal nozzles is monitored constantly while forming a test pattern for abnormal nozzle detection in the non-image region of a recording medium, during a process of recording a desired output image continuously (continuous printing). In a case where an abnormal nozzle has been detected in this monitoring during recording, a test pattern for density non-uniformity correction is formed in the non-image region of the recording medium, in order to acquire density data required for correction processing to improve the effects of disabling the ejection of the abnormal nozzle. Therefore, the test pattern is read and image data is corrected in such a manner that a prescribed image quality can be achieved by using only the nozzles other than the abnormal nozzle, on the basis of the reading results. Thereupon, image recording is carried out in accordance with this corrected data. It is possible to continue recording of the desired image in accordance with the data before correction, after the detection of an occurrence of an abnormal nozzle and until switching to image formation on the basis of correction data, and therefore the occurrence of wasted paper can be suppressed.

Preferably, the nozzles are respectively connected to corresponding pressure chambers, and a volume of each of the pressure chambers is changed by driving corresponding one of the pressure generating elements.

The present invention is suited to an inkjet recording apparatus which carries out ejection by changing the volume of the pressure chamber, such as a piezo actuator system.

Preferably, the abnormal nozzle detective waveform includes a waveform which reduces an ejection velocity compared to the recording waveform.

According to this aspect of the present invention, since the ejection force during the ejection for abnormal nozzle detection is weaker than the ejection force during the recording of the image using the recording waveform, then good effects are obtained in respect of the detection of ejection abnormalities caused by abnormality causes that are internal to the nozzles, such as the entering of bubbles into the nozzles, adherence of foreign matter to the internal walls of the nozzles, reduction of the amount of deformation volume of the pressure chamber, and the like.

Preferably, the abnormal nozzle detective waveform includes a waveform which increases a volume of the liquid swelling from the nozzles compared to the recording waveform.

According to this aspect of the present invention, a beneficial effect is obtained in respect of the detection of ejection defects caused by abnormality causes that are external to the nozzles, such as ink mist, the adherence of paper dust, or the like.

Preferably, the abnormal nozzle detective waveform is selectable from at least two types of waveforms.

According to this aspect of the present invention, it is possible to effectively detect abnormalities, in respect of a plurality of defect causes.

Preferably, at least one of the at least two types of waveforms includes a waveform which reduces an ejection velocity compared to the recording waveform.

This aspect of the present invention is effective in respect of the detection of abnormalities due to defect causes that are internal to the nozzles.

Preferably, at least one of the at least two types of waveforms includes a waveform which increases a volume of the liquid swelling from the nozzles compared to the recording waveform.

This aspect of the present invention is effective in respect of the detection of abnormalities due to defect causes that are external to the nozzles.

Preferably, the waveform which reduces the ejection velocity compared to the recording waveform includes at least one of a waveform having a smaller potential difference than the recording waveform, a waveform having a modified pulse width in comparison with a pulse of the recording waveform, a waveform having a modified pulse gradient in comparison with the pulse of the recording waveform, and a waveform in which a pre-pulse of a potential difference that does not cause ejection is added by $(T_c/2)\times n$ before an application of an ejection pulse, where $T_c$ is a head resonance period and n is a natural number.

It is possible to reduce the ejection velocity with respect to the recording waveform by means of the waveforms given above as examples. Furthermore, it is also possible suitably to combine the characteristics of the waveforms given here as examples. Preferably, the waveform which increases the volume of the liquid swelling from the nozzles compared to the recording waveform includes at least one of a waveform having a larger potential difference than the recording waveform, a waveform in which a signal element compressing the pressure chamber to an extent that does not produce ejection is added before ejection, a waveform in which at least two pulses in which a signal element compressing the pressure chamber to an extent that does not produce ejection is added before ejection are applied consecutively at a time interval of $T_c\times n$, where $T_c$ is a head resonance period and n is a natural number, a waveform which applies another pulse of a potential difference that does not produce ejection before application of the ejection pulse, and a waveform which performs ejection by applying a subsequent second pulse after causing the liquid to overflow from the nozzle by applying a first pulse which does not normally produce ejection when the first pulse is applied alone.

By means of the waveforms given as examples above, it is possible to increase the volume of liquid swelling from the nozzle, in comparison with the recording waveform. Furthermore, it is also possible suitably to combine the characteristics of the waveforms given here as examples.

Preferably, the abnormal nozzle detective waveform includes a waveform which reduces an ejection velocity compared to the recording waveform, and a waveform which increases a volume of the liquid swelling from the nozzles compared to the recording waveform.

According to this aspect of the present invention, it is possible to effectively detect ejection defects due to abnormality causes which are internal and external to the nozzles.

Preferably, the abnormal nozzle detective device includes an optical sensor which optically determines the results of the ejection for abnormality detection.

As an example of an optical sensor, it is possible to use an image reading device which reads the image formation results of a pattern, or the like, formed on the recording medium. Furthermore, it is also possible to use an optical sensor which captures the ejected droplets during flight, instead of the image reading device. The optical sensor does not have to be disposed inside the inkjet recording apparatus and it is also possible to adopt a mode where the sensor is an external device, such as a scanner, which is constituted separately from the inkjet recording apparatus. In this case, the whole of the inkjet system including the external apparatus is interpreted as an "inkjet recording apparatus". Moreover, it is also possible to adopt a mode which has a plurality of optical sensors. For example, it is possible to provide a plurality of sensors having different reading resolutions.

Preferably, the optical sensor is an image reading device which is disposed to face the conveyance device which conveys the recording medium after image formation by the inkjet head, the image reading device reading a recording surface of the recording medium during conveyance by the conveyance device.

According to this aspect of the present invention, it is possible to read the test pattern on the recording medium during a printing process of recording the desired image (without halting image formation), and the corresponding read results can be reflected in correction. Since it is possible to detect an abnormal nozzle and carry out correction processing which reflects the detection results, during image formation, then throughput is improved while maintaining recording image quality.

Preferably, advance detection by the optical sensor and advance correction using results of the advance detection are carried out before recording the desired image on the recording medium, and detection by the optical sensor and correction using results of the detection are carried out during the recording of the desired image.

According to this aspect of the present invention, it is possible to carry out both advance correction before image recording and on-line detection and correction during recording of the desired image, by using the optical sensor. It is possible to achieve high-precision detection and correction by means of the advance correction, and it is possible to respond also to ejection abnormalities that may occur during continuous printing, by means of the detection and correction during the image recording.

Preferably, a plurality of types of waveforms are used as the abnormal nozzle detective waveform in the advance detection, and one type of waveform is used as the abnormal nozzle detective waveform in the detection during the recording of the desired image.

If a test pattern for abnormal nozzle detection is formed in the non-image region (margin portion) of the recording medium, then due to the limitations of the margin area, there may be cases where a plurality of sheets of recording media are required in order to evaluate all of the nozzles. When the presence or absence of abnormalities in all of the nozzles is evaluated by means of a test pattern which is divided between a plurality of sheets, if waveforms for abnormal nozzle detection of a plurality of types are also used, then it can be envisaged that the number of sheets of recording media required to cover all combinations of the waveform types in all of the nozzles will be large.

In detection during image recording, it is possible to reduce the number of sheets required to cover the whole detection pattern, by using only one type of waveform, and hence the amount of wasted paper can be reduced.

Preferably, the inkjet recording apparatus further comprises a second optical sensor having detection characteristics that are different from the optical sensor disposed to face the conveyance device.

It is possible to selectively change the optical sensor used in accordance with the target objective, such as the quality of the output image, the throughput, or the like. Apart from a mode including a switching control device which automatically switches the optical sensor used, it is also possible to change the sensor by means of a manual operation by the user, or the like.

Preferably, the second optical sensor has a different resolution to the optical sensor disposed to face the conveyance device.

For example, in the case of the first optical sensor which is disposed inside the inkjet recording apparatus and the second optical sensor which is disposed outside the inkjet recording apparatus, it is possible to set the resolution of the second optical sensor higher than that of the first optical sensor.

Preferably, the second optical sensor is an off-line image reading device which reads offline the recording surface on the recording medium; and advance detection by the second optical sensor and advance correction using results of the advance detection are carried out before recording the desired image on the recording medium, and detection by the optical sensor and correction using results of the detection are carried out during the recording of the desired image.

According to this aspect of the present invention, it is possible to carry out both advance correction by means of the second optical sensor (off-line detection and correction) and on-line detection and correction during recording of the desired image. It is possible to achieve high-precision detection and correction by means of the advance correction, and it is possible to respond also to ejection abnormalities that may occur during continuous printing, by means of the detection and correction during the image recording.

Preferably, a plurality of types of waveforms are used as the abnormal nozzle detective waveform in the advance detection, and one type of waveform is used as the abnormal nozzle detective waveform in the detection during recording of the desired image.

In detection during the image recording, it is possible to reduce the number of sheets required to cover the whole detection pattern, by using only one type of waveform, and hence the amount of wasted paper can be reduced.

Preferably, the inkjet recording apparatus further comprises: an information storage device which stores information specifying criteria for judging whether or not there is an ejection abnormality with respect to information obtained from the optical sensor, wherein the abnormal nozzle showing the ejection abnormality is identified in accordance with the criteria.

Since ejection defects are encouraged and amplified by the application of the drive signal having the abnormal nozzle detection waveform, then it is possible to judge the presence or absence of abnormal nozzles at a stage before an image defect occurs in the recorded image, by comparing the information obtained by this detection (the sensor output signal, or the like), with stipulated criteria.

Preferably, a plurality of image quality modes are prepared, and the inkjet recording apparatus further comprises a control device which changes the criteria in accordance with one of the image quality modes that is set.

According to this aspect of the present invention, it is possible to change the throughput and reliability in accordance with the image quality required.

Preferably, the inkjet recording apparatus further comprises a warning output device which outputs a warning in accordance with number of nozzles that have been determined as abnormal.

If the number of nozzles determined to be abnormal nozzles is very high, then it can be imagined that it would not be possible to correct the effects caused by disabling the ejection of these nozzles, sufficiently by means of other nozzles. Consequently, a desirable mode is one where a prescribed judgment reference value is stored in advance in a memory, or the like, and if the number of abnormal nozzles exceeds this reference value, then control is implemented to present a warning to the user.

Preferably, the inkjet recording apparatus further comprises a maintenance control device which implements control for carrying out a maintenance operation of the inkjet head in accordance with number of nozzles that have been determined as abnormal.

A desirable mode is one where, if the number of abnormal nozzles has exceeded the prescribed value, then control is implemented to carry out head maintenance automatically. For example, a control device and a maintenance mechanism are provided for carrying out at least one of pressurized purging, ink suctioning, dummy ejection, and wiping of the nozzle surface, as maintenance operations. By this means, it is possible to prevent image defects in a case the number of abnormal nozzles becomes excessively high.

In order to attain the aforementioned object, the present invention is also directed to an inkjet recording method, comprising: a recording waveform signal generating step of generating a drive signal having a recording waveform which is applied to pressure generating elements when recording a desired image on a recording medium by means of an inkjet head including a plurality of nozzles through which droplets of liquid are ejected and the pressure generating elements corresponding to the nozzles; an abnormal nozzle detective waveform signal generating step of generating a drive signal having an abnormal nozzle detective waveform including a waveform that is different from the recording waveform and applied to the pressure generating elements when performing ejection for abnormality detection to detect an abnormal nozzle among the nozzles in the inkjet head; a detective ejection control step of causing the ejection for abnormality detection to be performed from the nozzles by applying the drive signal having the abnormal nozzle detective waveform to the pressure generating elements, in a state where the inkjet head is disposed in a head position which enables deposition of the ejected droplets onto the recording medium; an abnormal nozzle detection step of identifying an abnormal nozzle showing an ejection abnormality from results of the ejection for abnormality detection; a correction control step of correcting image data in such a manner that ejection is stopped from the identified abnormal nozzle and the desired image is recorded by the nozzles other than the abnormal nozzle; and a recording ejection control step of performing image recording by controlling ejection from the nozzles other than the abnormal nozzle in accordance with the image data that has been corrected by the correction control step.

In order to attain the aforementioned object, the present invention is also directed to an inkjet recording apparatus, comprising: an inkjet head which includes a plurality of nozzles through which droplets of liquid are ejected and a plurality of pressure generating elements corresponding to the nozzles; a conveyance device which conveys a recording medium; a recording waveform signal generating device which generates a drive signal having a recording waveform which is applied to the pressure generating elements when recording a desired image on the recording medium by means of the inkjet head; a first abnormal nozzle detective waveform signal generating device which generates a drive signal having a first abnormal nozzle detective waveform including a waveform that reduces an ejection velocity compared to the recording waveform and is applied to the pressure generating elements when performing ejection for abnormality detection to detect an abnormal nozzle among the nozzles in the inkjet head; a second abnormal nozzle detective waveform signal generating device which generates a drive signal having a second abnormal nozzle detective waveform including a waveform that increases a volume of the liquid swelling from the nozzles compared to the recording waveform and is applied to the pressure generating elements when performing ejection for abnormality detection to detect an abnormal nozzle among the nozzles in the inkjet head; a detective ejection control device which causes the ejection for abnormality detection to be performed from the nozzles by applying one of the drive signal having the first abnormal nozzle detective waveform and the drive signal having the second abnormal nozzle detective waveform to the pressure generating elements; and an abnormal nozzle detective device which identifies the abnormal nozzle showing an ejection abnormality from results of the ejection for abnormality detection.

According to this aspect of the present invention, it is possible to encourage and amplify, and hence to detect effectively, the respective defects caused by abnormalities that are internal to the nozzles and abnormalities that are external to the nozzles. Therefore, high-precision detection becomes possible, and detection using a low-resolution sensor becomes possible.

In order to attain the aforementioned object, the present invention is also directed to an abnormal nozzle detection method, comprising: a first abnormal nozzle detective waveform signal generating step of generating, separately from a drive signal having a recording waveform which is applied to pressure generating elements when recording a desired image on a recording medium by means of an inkjet head including a plurality of nozzles through which droplets of liquid are ejected and the pressure generating elements corresponding to the nozzles, a drive signal having a first abnormal nozzle detective waveform including a waveform that reduces an ejection velocity compared to the recording waveform and is applied to the pressure generating elements when performing ejection for abnormality detection to detect an abnormal nozzle among the nozzles in the inkjet head; a second abnormal nozzle detective waveform signal generating step of generating a drive signal having a second abnormal nozzle detective waveform including a waveform that increases a volume of the liquid swelling from the nozzles compared to the recording waveform and is applied to the pressure generating elements when performing ejection for abnormality detection to detect an abnormal nozzle among the nozzles in the inkjet head; a detective ejection control step of causing the ejection for abnormality detection to be performed from the nozzles by applying one of the drive signal having the first abnormal nozzle detective waveform and the drive signal having the second abnormal nozzle detective waveform to the pressure generating elements; and an abnormal nozzle detection step of identifying the abnormal nozzle showing an ejection abnormality from results of the ejection for abnormality detection.

Preferably, the abnormal nozzle detective waveform or the second abnormal nozzle detective waveform includes a waveform which applies an ejection pulse capable of causing ejection of the droplet from the nozzle, and at least one non-ejection pulse which causes a meniscus of the liquid to swell to an extent which ejects no droplet from the nozzle, before application of the ejection pulse.

Preferably, the abnormal nozzle detective waveform or the second abnormal nozzle detective waveform further includes a waveform which applies the non-ejection pulse consecutively at a head resonance period $T_c$,in order to cause the meniscus of the liquid to swell, before the application of the ejection pulse.

This aspect of the present invention concerns a waveform which is able to increase the volume of the liquid swelling from the nozzle before ejection. According to this mode, the whole of the meniscus swells and the liquid overflows from the nozzle, by causing the meniscus to vibrate repeatedly by consecutive application of the non-ejection pulses. Consequently, it is possible to detect the ejection defects having an abnormality cause that is external to the nozzles, even more effectively.

Preferably, the non-ejection pulse includes a portion which causes a pressure chamber provided corresponding to the nozzle to expand, and a portion which causes the pressure chamber to contract, a potential difference of the portion which causes the pressure chamber to contract being greater than a potential difference of the portion which causes the pressure chamber to expand.

According to this aspect of the present invention, it is possible to increase the volume of the liquid swelling, yet further.

Preferably, a pulse period between the ejection pulse and the non-ejection pulse applied immediately before the ejection pulse in the abnormal nozzle detective waveform is not shorter than a head resonance period $T_c$.

More desirably, the pulse period between the ejection pulse and the non-ejection pulse applied immediately before the ejection pulse is longer than the head resonance period $T_c$,and even more desirably, is not shorter than twice the head resonance period $T_c$. According to the present invention, abnormal nozzles can be detected with high accuracy, and both high reliability and improved throughput can be achieved simultaneously.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Causes of ejection defects

Figure 1C:
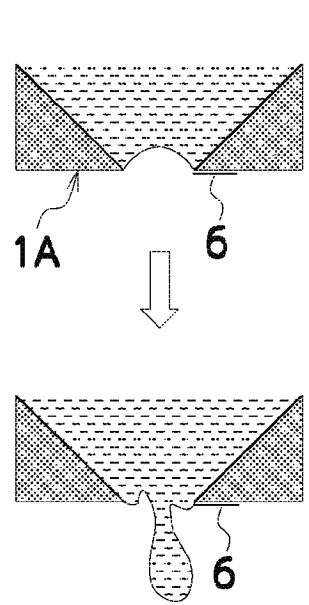
FIGS. 1A to 1C are enlarged diagrams of a nozzle unit showing schematic drawings of the causes of ejection defects.
Figure 1B:
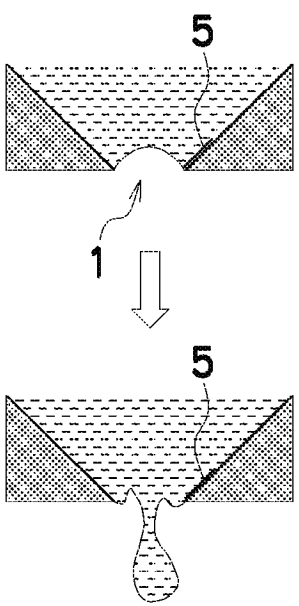
Figure 1A:
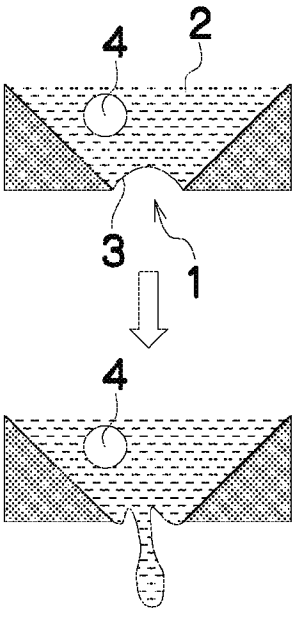

Firstly, the causes of ejection defects are described below. FIGS. 1A to 1C are enlarged diagrams of a nozzle unit having a nozzle 1 showing schematic drawings of the causes of ejection defects, in which ink 2 filled in the nozzle 1 has a meniscus (gas/liquid interface) 3.

FIG. 1A shows a state where a bubble 4 has become mixed in the ink 2 inside the nozzle 1. The nozzle 1 is connected to a pressure chamber (not shown), which is provided with a piezoelectric element (piezoelectric actuator) serving as a pressure generating device. By changing the volume of the pressure chamber by driving the piezoelectric element, a droplet of the liquid is ejected from the nozzle 1. In this case, if a bubble 4 is present inside the nozzle 1, then the pressure is absorbed by the bubble 4 and the flow of liquid is obstructed, thus giving rise to an ejection defect.

FIG. 1B shows a state where foreign matter 5 is adhering to the inner wall surface of the nozzle 1. If foreign matter 5 is adhering to the interior of the nozzle 1, then the flow of liquid is impeded by the foreign matter 5, giving rise to ejection defects, such as flight deviation of ejected droplets, or the like.

FIG. 1C shows a case where foreign matter 6 is adhering to the vicinity of the nozzle orifice on the outside of the nozzle 1. If foreign matter 6 is adhering to the vicinity of the nozzle on the outer side of the nozzle, then the axial symmetry of the meniscus is disrupted when the liquid comes into contact with this foreign matter 6, giving rise to ejection defects, such as flight deviation of ejected droplets.

In the case of a partial decline in liquid-repelling properties on a nozzle surface 1A in the vicinity of the nozzle (for example, peeling away of a liquid-repelling film), or the like, instead of the adherence of foreign matter 6, the situation is similar to that in FIG. 1C. The foreign matter 5 and 6 may be, for example: aggregated or dried ink component, paper dust, other dust, ink mist, residue left unintentionally from the head manufacture process, and so on.

Method of Detecting Abnormal Nozzles

As described with reference to FIGS. 1A to 1C, the causes of ejection defects can be divided broadly into causes that are internal to the nozzles as in FIGS. 1A and 1B, and causes that are external to the nozzles as in FIG. 1C. In cases where the nozzle 1 has a bubble 4 or foreign matter 5 therein (an abnormal nozzle having a cause that is internal to the nozzle), if the ejection force is reduced, the ejection defect produced by the internal cause is encouraged. More specifically, the effects of the bubble 4 or the foreign matter 5 are reflected even more markedly in the ejection results if driving at a reduced ejection velocity by means of a method which reduces the amount of displacement of the piezoelectric element or applies a pressure variation at a frequency that is shifted from the resonance frequency of the ejection head. Thus, the ejection failure is encouraged or the amount of deviation in flight of ejected droplets is increased.

On the other hand, in cases where there is foreign matter 6 or defective liquid-repelling properties, or the like, in the outer part of the nozzle 1, the ejection defect produced by the cause that is external to the nozzle is encouraged if the ink swells or overflows from the orifice of the nozzle 1 and the ink is brought in contact with the foreign matter 6 on the outer part of the nozzle or the portion of defective liquid-repelling properties.

In the present embodiment, when performing detection of ejection defects, an image of a test pattern is formed using a drive signal having a waveform that encourages ejection defects, separately from a drive waveform for normal image recording, and the print results of the test pattern are measured. In other words, even if there is an air bubble 4 or foreign matter 5 or 6 of a level that produces no ejection defects (i.e., that cannot be detected) when the piezoelectric element is driven using the normal drive waveform for ejection during normal image formation, it is possible to cause a detectable defect to appear by using the detective drive waveform that encourages and amplifies the ejection defects. Thus, it is possible to detect, at an early stage, an ejection defect of an initial level that cannot yet be recognized as the ejection defect when using the normal drive waveform for image recording.

Below, specific embodiments of the waveform are described.

Drive Waveform for Image Recording

Figure 2:
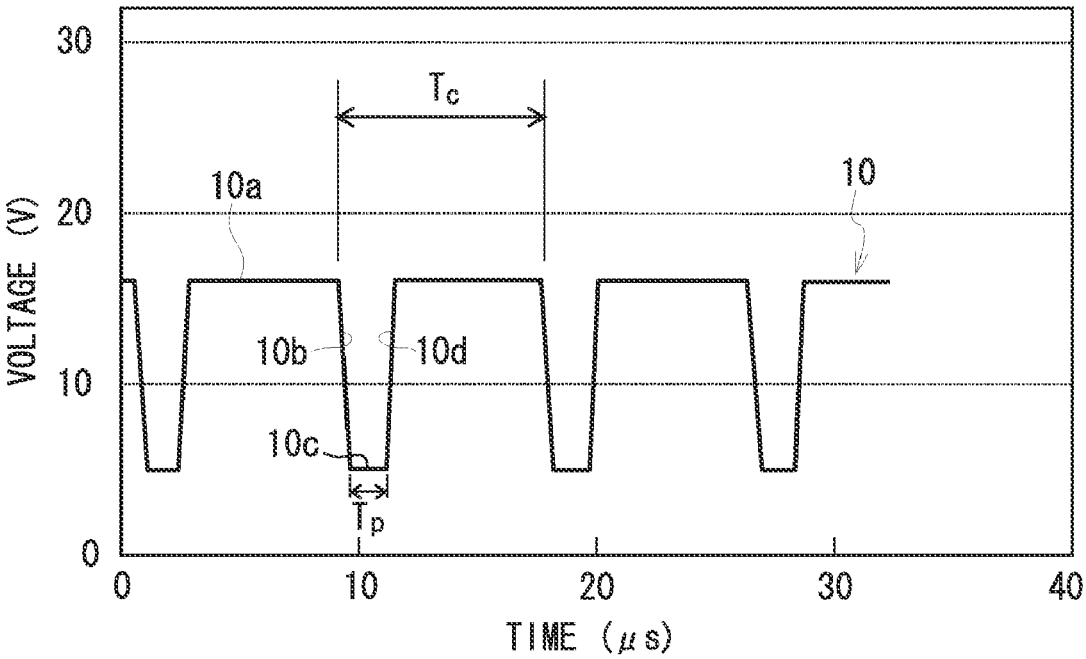
FIG. 2 is a waveform diagram showing an embodiment of a drive signal having a recording waveform.

FIG. 2 is an embodiment of a drive waveform (hereinafter referred to as a "recording waveform") for ejection of normal image recording. Here, in order to simplify the description, a so-called pull-push type drive waveform is described as an example. However, in implementing the present invention, there are no particular restrictions on the mode of the drive waveform, and drive waveforms of various other types, such as a pull-push-pull waveform can be used.

The drive signal of the recording waveform 10 shown in FIG. 2 is constituted of: a first signal element 10*a*, which outputs a reference potential that maintains the volume of the pressure chamber in a steady state; a second signal element (pull waveform portion) 10*b*, which drives the piezoelectric element in a direction that expands the pressure chamber from the steady state; a third signal element 10*c*, which maintains the pressure chamber in the expanded state; and a fourth signal element (push waveform portion) 10*d*, which drives the piezoelectric element in a direction that pushes and compresses the pressure chamber.

In other words, the first signal element 10*a* is a waveform portion that maintains the reference potential, and the second signal element 10*b* is a falling waveform portion that reduces the potential from the reference potential. The third signal element 10*c* is a waveform portion that maintains the potential that has been reduced by the second signal element 10*b*, and the fourth signal element 10*d* is a rising waveform portion that raises the potential of the third signal element 10*c* to the reference potential.

The pulse interval of the pull-push waveform desirably coincides with the resonance period $T_c$ (the Helmholtz intrinsic oscillation period) of the head, and the pulse width $T_p$ is desirably a natural fraction of the resonance period $T_c$ (the Helmholtz intrinsic oscillation period). The head resonance period is the intrinsic oscillation period of the whole oscillation system, which is determined by the ink flow channel system, the ink (acoustic element), and the dimensions, material and physical values of the piezoelectric element, and the like.

Embodiments of Abnormal Nozzle Detective Waveforms Suited to Detection of Defects Having Causes Internal to Nozzles When detecting abnormal nozzles, the detection sensitivity and accuracy are improved by encouraging and amplifying ejection defects using a special waveform (abnormal nozzle detective waveform) which is different from the recording waveform shown in FIG. 2.

FIGS. 3 to 6 show embodiments of abnormal nozzle detective waveforms which are suitable for detecting abnormal nozzles having internal causes.

Figure 3:
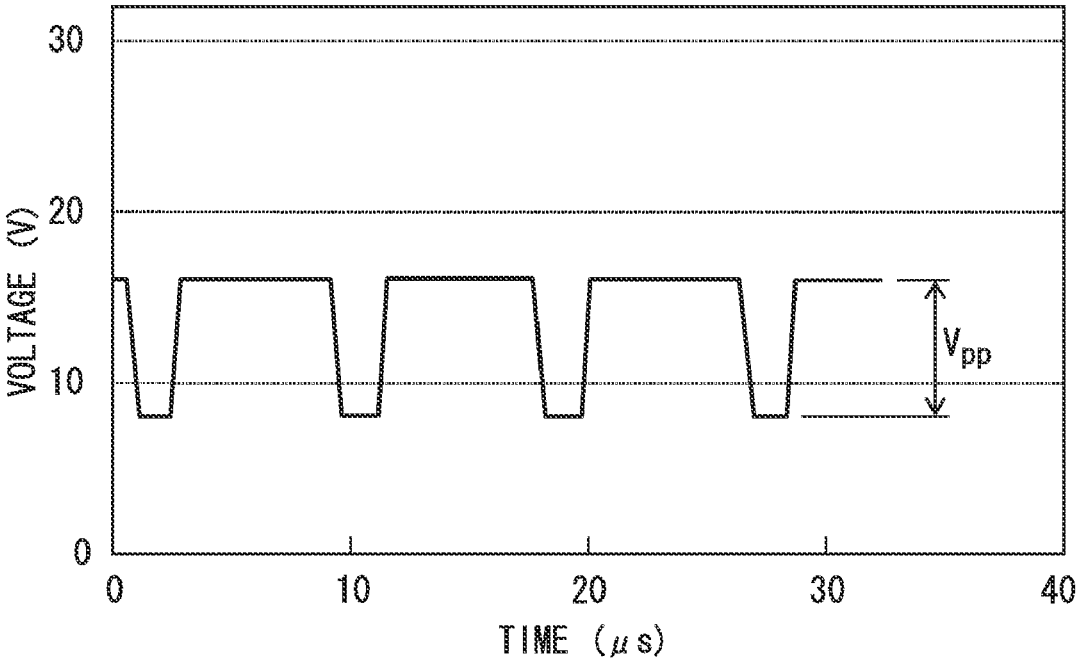
FIG. 3 is a waveform diagram showing an embodiment of an abnormal nozzle detective waveform suited to detection of causes that are internal to the nozzles.

FIG. 3 shows a case where the potential difference $V_{pp}$ (the difference between the maximum value and the minimum value of the voltage waveform) is reduced in comparison with the recording waveform in FIG. 2. Desirably, the potential difference is reduced by 10% or more compared to the potential difference of the recording waveform, and more desirably, it is reduced by 15% to 25%.

Figure 4:
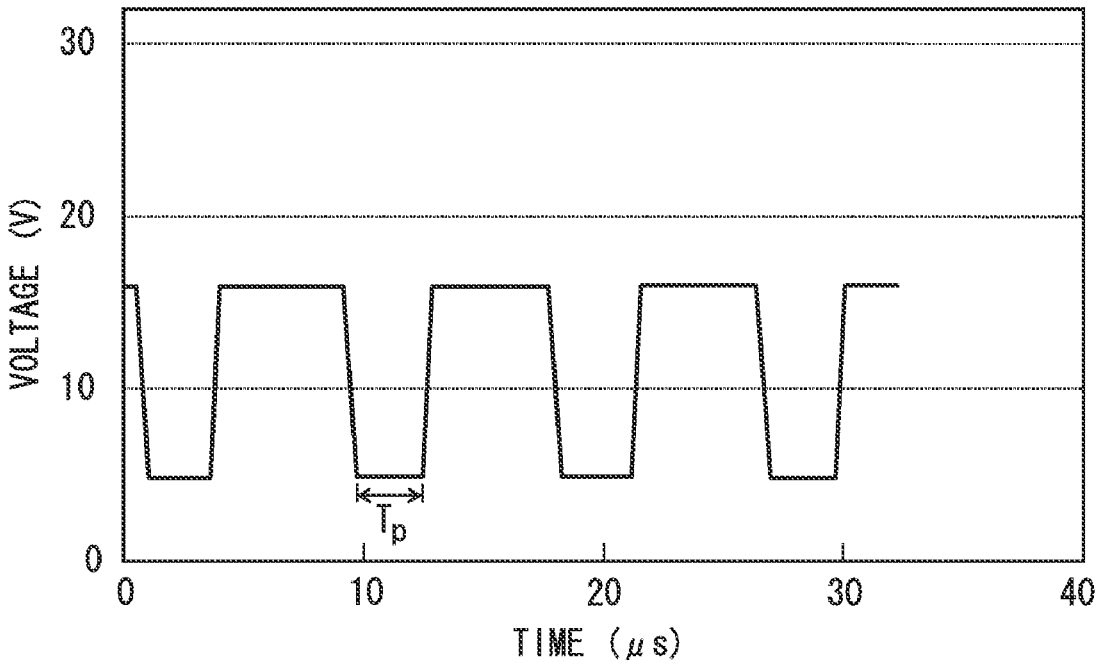
FIG. 4 is a waveform diagram showing an embodiment of an abnormal nozzle detective waveform suited to detection of causes that are internal to the nozzles.

FIG. 4 shows a case where the pulse width $T_p$ is changed in comparison with the recording waveform in FIG. 2. Desirably, the pulse width is increased or decreased by 10% or more, and more desirably, is increased or decreased by 20% to 50%, with respect to the pulse width of the recording waveform. An inkjet head has a pulse width capable of achieving stable ejection, due to the flow channel structure, and the physical properties of the liquid used, and so on. The pulse width of the recording waveform is set to be the pulse width capable of achieving stable ejection. On the other hand, in the abnormal nozzle detective waveform, a modified pulse width is used in order to weaken the ejection force.

Figure 5:
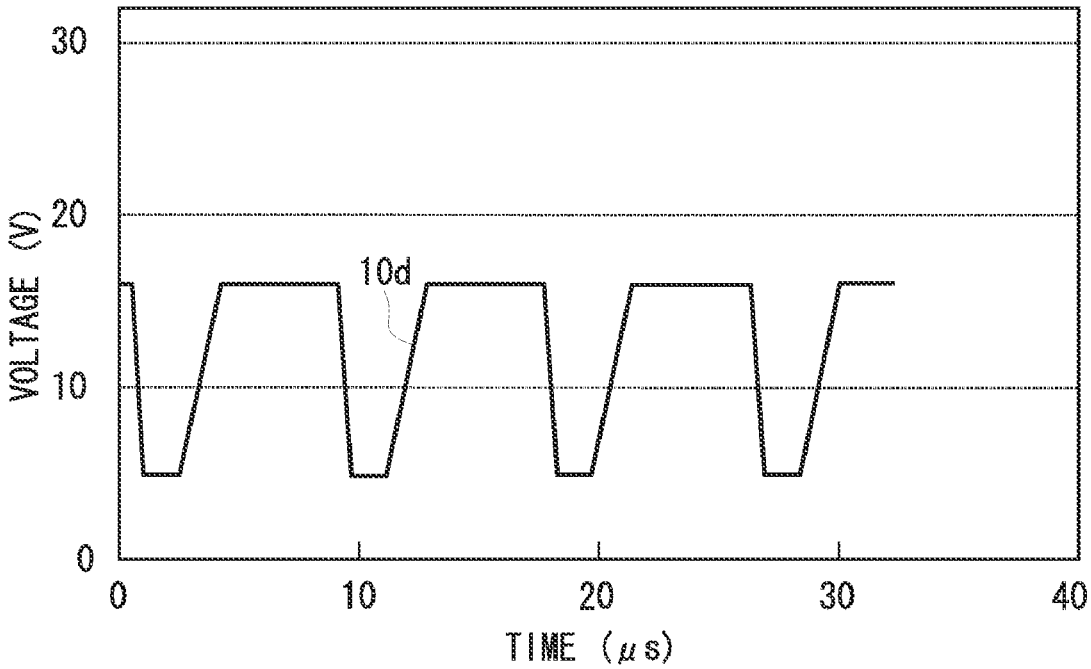
FIG. 5 is a waveform diagram showing an embodiment of an abnormal nozzle detective waveform suited to detection of causes that are internal to the nozzles.

FIG. 5 shows a case where the gradient of the pulse waveform (the rising gradient of the fourth signal element 10*d*) is changed with respect to the recording waveform in FIG. 2. Desirably, the gradient is increased or decreased by 20% or more, and more desirably, the gradient is increased or decreased by 50% to 200% with respect to the gradient of the recording waveform.

Figure 6:
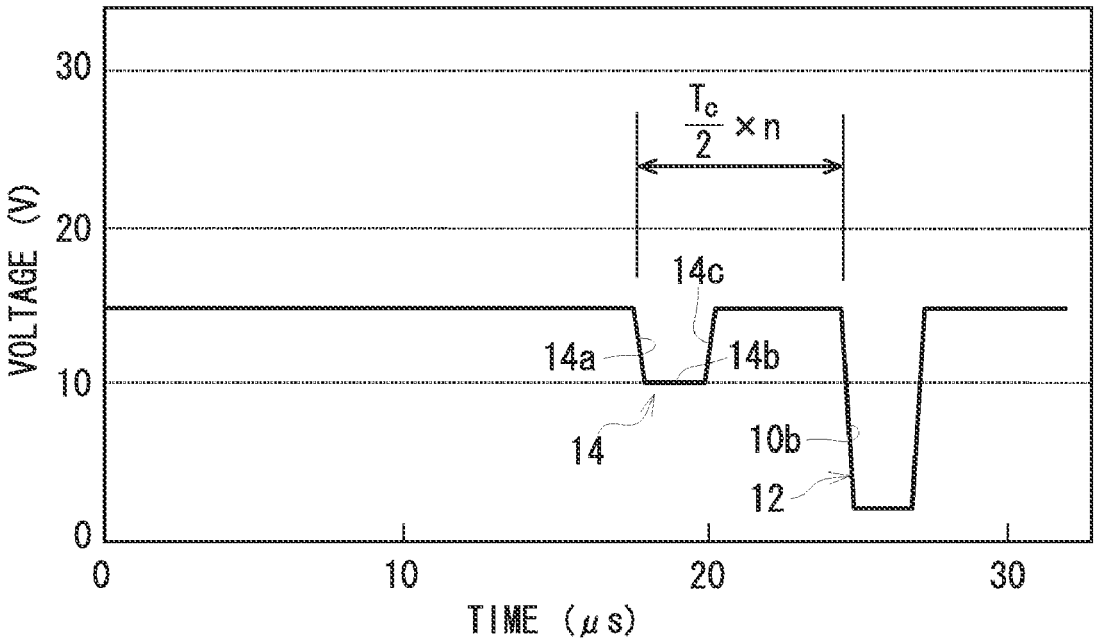
FIG. 6 is a waveform diagram showing an embodiment of an abnormal nozzle detective waveform suited to detection of causes that are internal to the nozzles.

FIG. 6 shows a case where a waveform signal (a pre-pulse) that weakens the ejection force is added before the ejection pulse 12. If the head resonance frequency is taken to be $1/T_c$, then a pulse having a small potential difference (a weak pulse of which application alone is not sufficient to cause ejection from the nozzle) is applied at timing of $(T_c/2)\times n$ (where n is a natural number) before the ejection pulse 12.

The pre-pulse 14 is constituted of: a fifth signal element 14*a*, which is a waveform portion that reduces the potential from the reference potential; a sixth signal element 14*b*, which is a waveform portion that maintains the potential which has been reduced by the fifth signal element 14*a;* and a seventh signal element 14*c*, which is a waveform portion that raises the potential of the sixth signal element 14*b* to the reference potential. The vibration wave generated by the application of the pre-pulse 14 impedes the subsequent pulling action of the ejection pulse 12 (the pulling action produced by the second signal element 10*b*) and thereby reduces the ejection force produced by the ejection pulse 12. More specifically, the application of the pre-pulse 14 temporarily pulls the meniscus in the nozzle inside the nozzle, and then pushes the meniscus so as to swell from the nozzle. The pull signal element 10*b* of the subsequent ejection pulse 12 is applied at the timing that the remaining vibration of the pre-pulse causes the meniscus to be pushed out after being pulled in once again. Hence, the pulling action of the pull signal element 10*b* that is superimposed on the swelling action produced by the remaining vibration of the pre-pulse 14 is thereby impeded and the ejection force is weakened. It is also possible to suitably combine the compositions described in FIGS. 3 to 6.

Embodiments of Abnormal Nozzle Detective Waveforms Suited to Detection of Defects Having Causes External to Nozzles FIGS. 7 to 11 show embodiments of abnormal nozzle detective waveforms which are suitable for detecting abnormal nozzles having external causes.

Figure 7:
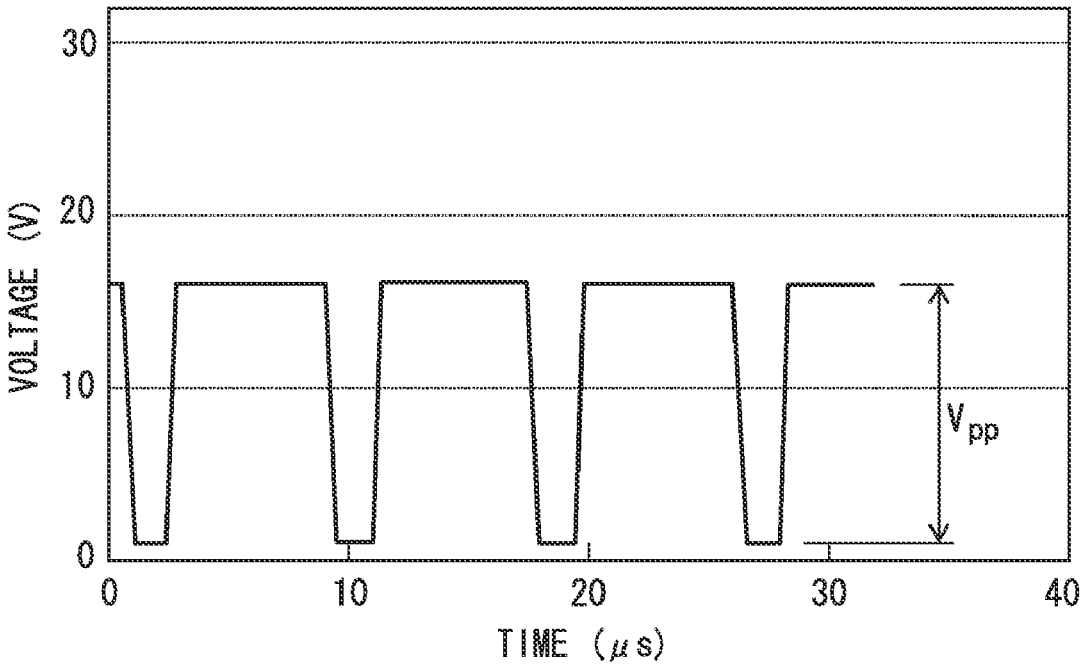
FIG. 7 is a waveform diagram showing an embodiment of an abnormal nozzle detective waveform suited to detection of causes that are external to the nozzles.

FIG. 7 shows a case where the potential difference $V_{pp}$ (the difference between the maximum value and the minimum value of the voltage waveform) is increased in comparison with the recording waveform in FIG. 2. Desirably, the potential difference is increased by 10% or more compared to the potential difference of the recording waveform.

Figure 8:
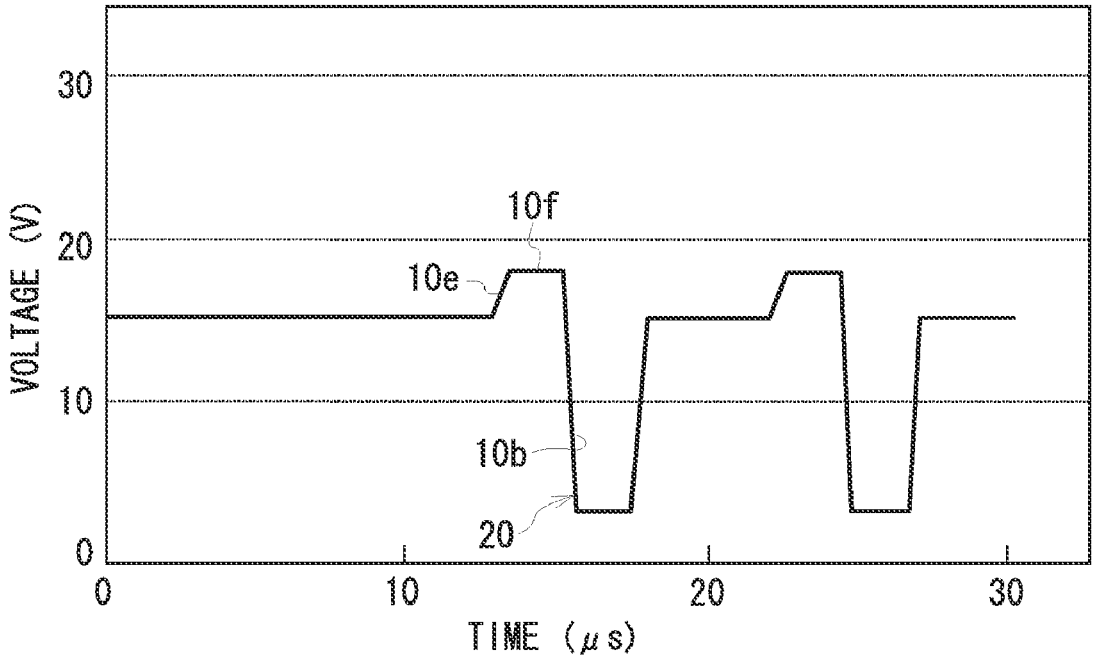
FIG. 8 is a waveform diagram showing an embodiment of an abnormal nozzle detective waveform suited to detection of causes that are external to the nozzles.

FIG. 8 shows a case where a signal element 10*e* for causing the ink to swell or bulge out from the nozzle and a signal element 10*f* for maintaining this potential are added before the pull signal element 10*b* of the ejection pulse 20. By means of these signal elements 10*e* and 10*f*, the ink is caused to swell from the nozzle before ejection, and the ink can come into contact with the foreign matter 6, and the like, outside the nozzle.

Figure 9:
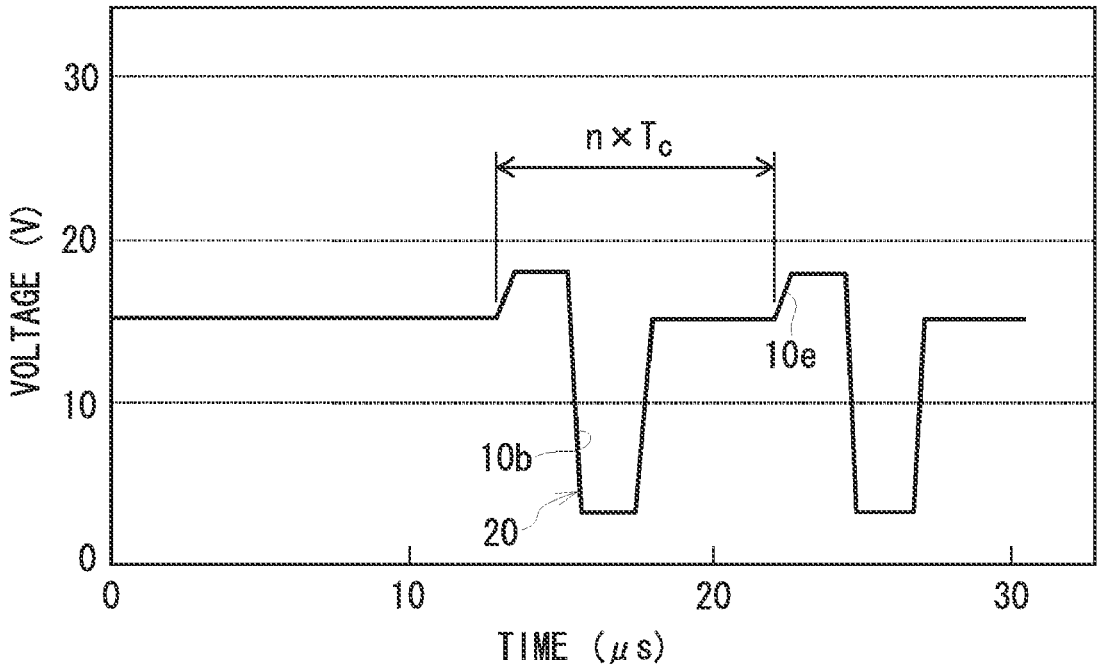
FIG. 9 is a waveform diagram showing an embodiment of an abnormal nozzle detective waveform suited to detection of causes that are external to the nozzles.

FIG. 9 shows a case where an ejection pulse 20 is applied at a time interval of n×Tc, in addition to the waveform in FIG. 8. According to the composition in FIG. 9, it is possible to cause the ink to further swell from the nozzle with the pressure chamber compression signal element 10*e* before the subsequent ejection, by means of the remaining vibration produced by the application of the preceding ejection pulse 20. It is possible to amplify the vibration by applying the push action at the timing prior by the integral multiple of the resonance period $T_c$.

Figure 10:
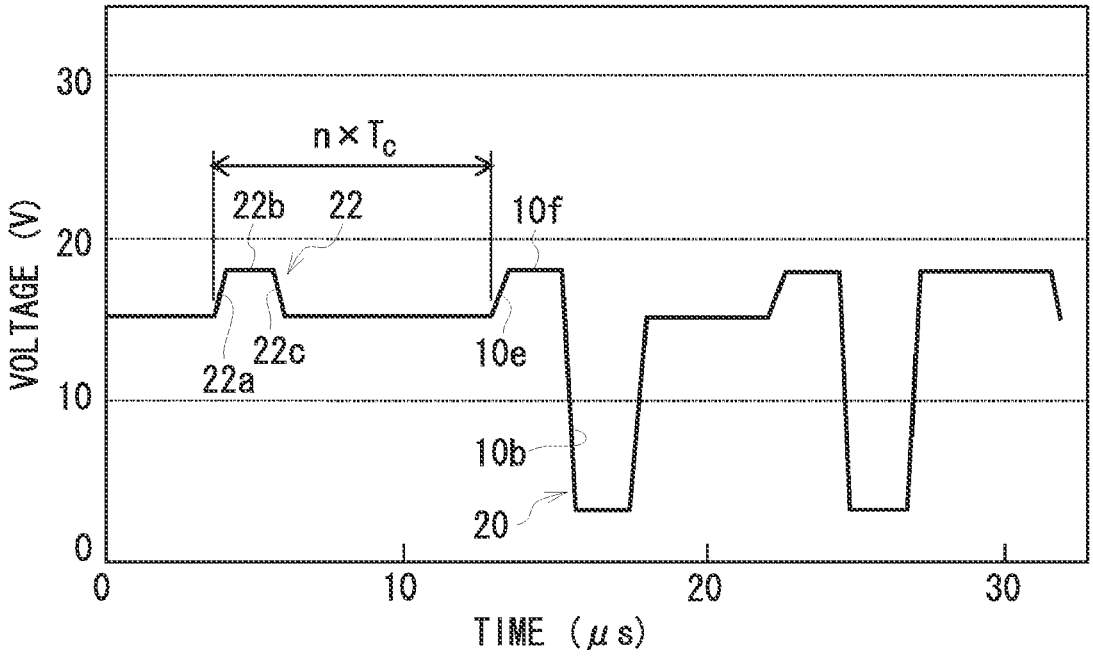
FIG. 10 is a waveform diagram showing an embodiment of an abnormal nozzle detective waveform suited to detection of causes that are external to the nozzles.

FIG. 10 shows a case where a pre-pulse 22 having a small potential difference is added before the ejection pulse 20. This pre-pulse 22 is applied at a timing of "n×Tc" prior to the ejection pulse 20. The pre-pulse 22 is constituted of: an eighth signal element 22*a*, which is a push signal element to compress the pressure chamber by raising the potential from the reference potential; a ninth signal element 22*b*, which maintains the potential that has been raised by the eighth signal element 22*a;* and a tenth signal element 22*c*, which returns the potential of the ninth signal element 22*b* to the reference potential. The application of the pre-pulse 22 alone is not sufficient to eject ink from the nozzle. It is possible to amplify the swell of the ink from the nozzle by the vibration wave generated by the application of the pre-pulse 22 resonant with the vibration wave generated by the subsequent ejection pulse 20, in other words, by means of the remaining vibration of the pre-pulse 22.

Figure 11:
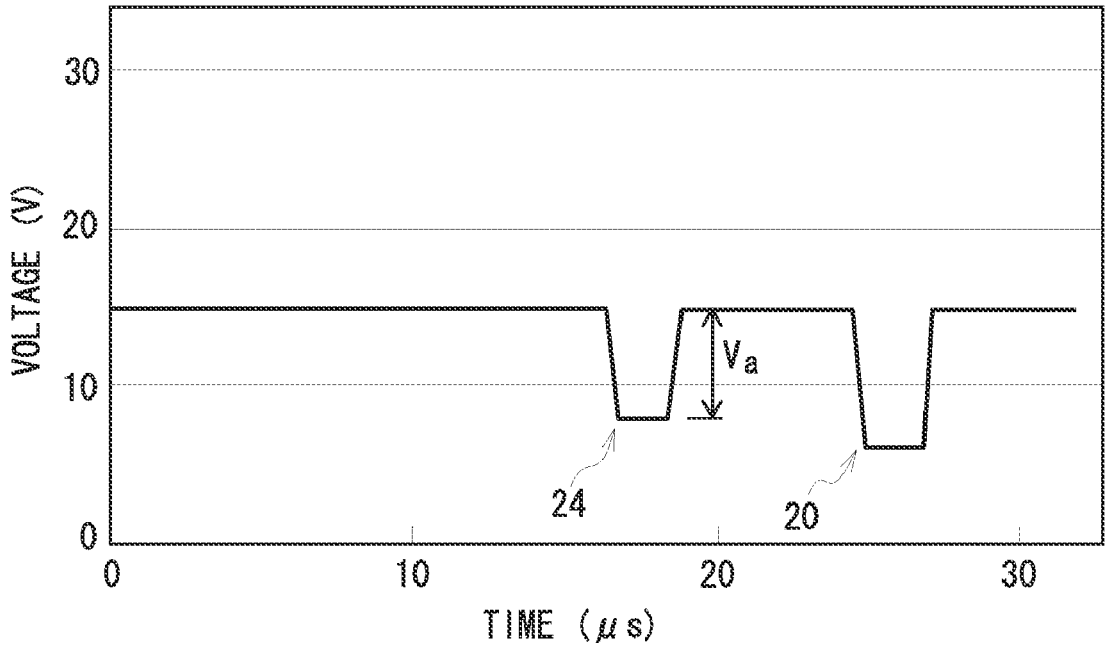
FIG. 11 is a waveform diagram showing an embodiment of an abnormal nozzle detective waveform suited to detection of causes that are external to the nozzles.

FIG. 11 shows a case where a first pulse 24 that alone does not produce normal ejection (for example, ejection at an ejection velocity of 4 m/s or lower) is added before the ejection pulse 20. The ink is caused to overflow from the nozzle by means of the first pulse 24, and the ejection is then performed by means of the subsequent second pulse 20. The potential difference $V_a$ of the first pulse 24 is adjusted to a value smaller than the potential difference of the second pulse 20.

Furthermore, it is also possible to adopt a mode which uses a waveform by which the ink is swollen from the nozzle and the ejection velocity is made slower than the recording waveform. By adjusting the voltage of the waveform that causes the ink to overflow as shown in FIGS. 7 to 11, it is possible to obtain a waveform that reduces the ejection force and also generates the swell of the ink. Thereby, it is possible to detect ejection defects having causes that are internal and external to the nozzles, by encouraging and amplifying the ejection defects.

As described with reference to FIGS. 3 to 11, droplets are ejected to form a test pattern (referred also to as a "test chart") using a special waveform (a abnormal nozzle detective waveform) which is different from the drive waveform for image recording, and the presence or absence of abnormal nozzles is detected from the print results of this test chart.

The abnormal nozzle detective waveform is able to amplify the state of abnormality in the nozzle, compared to the recording waveform. Hence, it is possible to carry out abnormality detection at an early stage before a recording defect occurs in image recording using the recording waveform. Moreover, it is also possible to carry out detection with a low-resolution detective device, as well as being able to achieve detection at high speed and with high sensitivity.

Moreover, by detecting abnormal nozzles using different types of abnormal nozzle detective waveforms, in accordance with both causes that are internal to the nozzles and causes that are external to the nozzles, it is also possible to detect ejection defects caused by respective causes.

Furthermore, during the recording of a desired image, a test chart can be formed using the abnormal nozzle detective waveform in a non-image region (margin portion) on the recording medium, and abnormal nozzle detection can be carried out on the basis of the print results of this test chart. When an abnormal nozzle has been detected, use of the abnormal nozzle in question is halted, the image data is corrected in such a manner that a satisfactory image can be output by only using the remaining normal nozzles, and printing of the desired image can be continued on the basis of this corrected image data. Thereby, it is possible to detect and deal with an abnormal nozzle at an early stage before a problem occurs in image recording of an image portion using a drive signal having the recording waveform, and therefore continuous recording (continuous printing) can be carried out. More specifically, an abnormal nozzle that would be liable to create an ejection defect is detected at an early stage before a problem actually occurs in image formation of the image portion, ejection from this nozzle is disabled, and the image data is corrected so as to compensate for the effects of this disabling of ejection, by means of the remaining nozzles. Thus, it is possible to avoid the occurrence of paper waste and decline in throughput, and to continue printing, in relation to problems occurring during continuous recording.

General Composition of Inkjet Recording Apparatus

Next, an inkjet recording apparatus to which the above-describe abnormal nozzle detection method is applied is described below.

Figure 12:
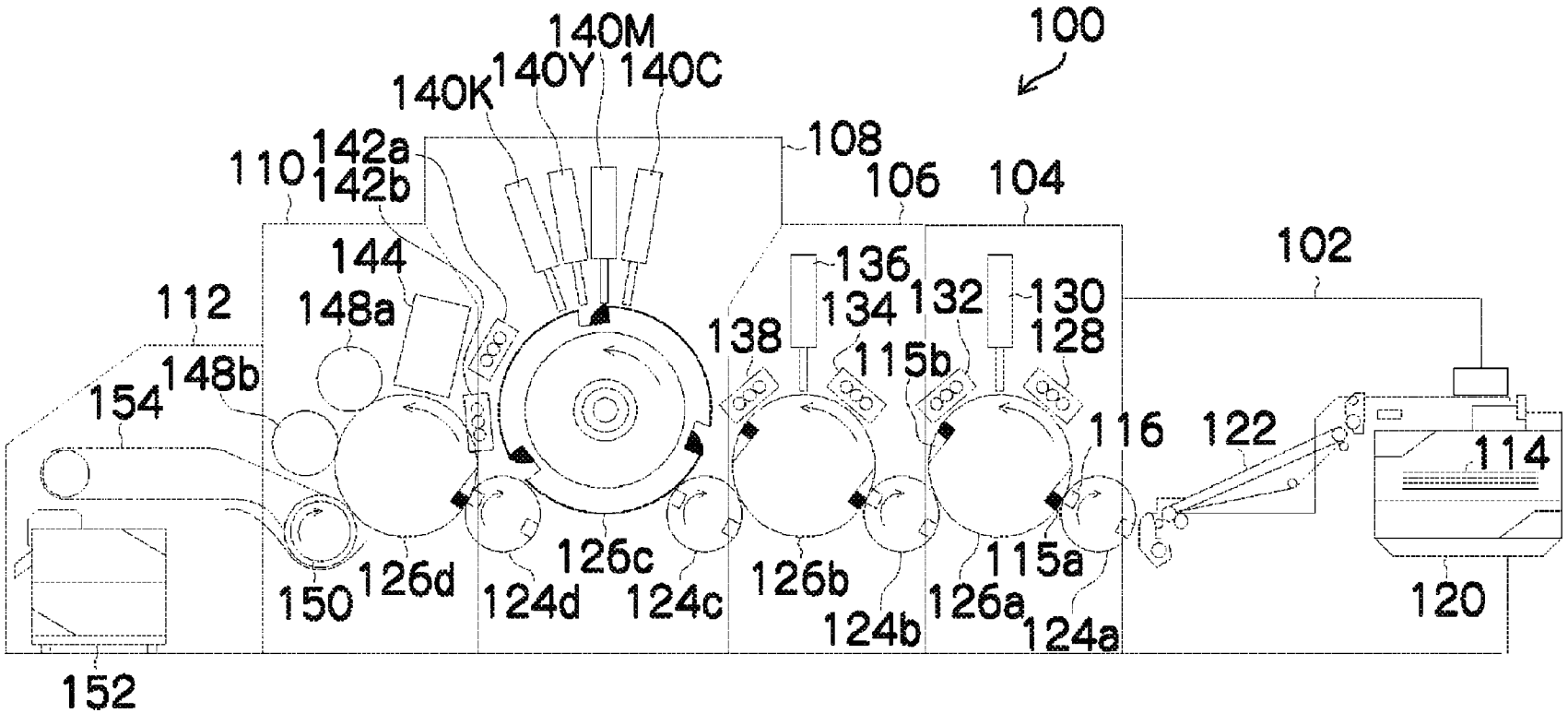
FIG. 12 is a schematic drawing of an inkjet recording apparatus according to an embodiment of the present invention.

FIG. 12 is a schematic drawing of the composition of an inkjet recording apparatus 100 according to an embodiment of the present invention. The inkjet recording apparatus 100 adopts a pressure drum direct rendering system which directly deposits droplets of ink of a plurality of colors onto a recording medium (also referred to as "paper" for convenience) 114 held on a pressure drum 126*c* of an ink ejection unit 108 to form a desired color image, and is an on demand type image forming apparatus that uses the two liquid reaction (aggregation) system that uses the ink and treatment liquid (here, aggregation treatment liquid) to form images on the recording medium 114.

The inkjet recording apparatus 100 principally includes: a paper supply unit 102, which supplies the recording medium 114; a permeation suppression agent deposition unit 104, which deposits permeation suppression agent on the recording medium 114; a treatment liquid deposition unit 106, which deposits treatment liquid onto the recording medium 114; the ink ejection unit 108, which ejects and deposits droplets of ink onto the recording medium 114; a fixing unit 110, which fixes an image recorded on the recording medium 114; and a paper output unit 112, which conveys and outputs the recording medium 114 on which an image has been formed.

The paper supply unit 102 is provided with a paper supply platform 120 on which the recording media 114 of paper sheets are stacked. A feeder board 122 is connected to the front of the paper supply platform 120, and the recording media 114 stacked on the paper supply platform 120 is supplied one sheet at a time, successively from the uppermost sheet, to the feeder board 122. The recording medium 114 which has been conveyed to the feeder board 122 is supplied through a transfer drum 124*a* to a pressure drum (permeation suppression agent drum) 126*a* of the permeation suppression agent deposition unit 104.

Holding hooks (grippers) 115*a* and 115*b* for holding the leading end portion of the recording medium 114 are arranged on the surface (circumferential surface) of the pressure drum 126*a*. The recording medium 114 that has been transferred to the pressure drum 126*a* from the transfer drum 124*a* is conveyed in the direction of rotation (the counter-clockwise direction in FIG. 12) of the pressure drum 126*a* in a state where the leading end portion thereof is held by the holding hooks 115*a* and 115*b* and the medium adheres tightly to the surface of the pressure drum 126*a* (in other words, in a state where the medium is wrapped about the pressure drum 126*a*). A similar composition is also employed for the other pressure drums 126*b* to 126*d*, which are described hereinafter. A member 116 for transferring the leading end portion of the recording medium 114 to the holding hooks 115*a* and 115*b* of the pressure drum 126*a* is arranged on the surface (circumferential surface) of the transfer drum 124*a*. A similar composition is also employed for the other transfer drums 124*b* to 124*d*, which are described hereinafter.

<Permeation Suppression Agent Deposition Unit>

The permeation suppression agent deposition unit 104 is provided with a paper preheating unit 128, a permeation suppression agent ejection head 130 and a permeation suppression agent drying unit 132 arranged respectively at positions facing the surface of the pressure drum 126*a*, in this order from the upstream side in terms of the direction of rotation of the pressure drum 126*a* (the counter-clockwise direction in FIG. 12). The paper preheating unit 128 and the permeation suppression agent drying unit 132 are provided with hot air driers which can control the temperature and air blowing volume within a prescribed range. When the recording medium 114 held on the pressure drum 126*a* passes the positions facing the paper preheating unit 128 and the permeation suppression agent drying unit 132, hot air heated by the hot air driers is blown toward the surface of the recording medium 114.

The permeation suppression agent ejection head 130 ejects and deposits liquid containing a permeation suppression agent (the liquid also referred to simply as "permeation suppression agent") onto the recording medium 114 held on the pressure drum 126*a*. In the present embodiment, the ejection system is employed in the device for depositing the permeation suppression agent on the surface of the recording medium 114, but the system is not limited to this, and it is also possible to use various other systems, such as a roller application system, a spray system, and the like.

The permeation suppression agent suppresses permeation of solvent (and organic solvent having affinity for the solvent) contained in the later-described treatment liquid and ink liquid into the recording medium 114. The permeation suppression agent is composed of resin particles dispersed as an emulsion in a solvent, or a resin dissolved in the solvent. Organic solvent or water is used as the solvent of the permeation suppression agent. Methyl ethyl ketone, petroleum, or the like may be desirably used as appropriate as the organic solvent of the permeation suppression agent.

The paper preheating unit 128 makes the temperature T1 of the recording medium 114 higher than the lowest film formation temperature Tf1 of the resin particles of the permeation suppression agent. Adjustment of the temperature T1 may be carried out by the method of providing a heating element such as a heater or the like within the pressure drum 126*a* to heat the recording medium 114 from the bottom surface thereof, or the method of applying hot air to the upper surface of the recording medium 114, and the heating using an infrared heater to heat the recording medium 114 from the upper surface is used in the present embodiment. It is possible to use a combination of these.

The methods to deposit the permeation suppression agent desirably include the droplet ejection system, a spray system, a roller application system, and the like. The droplet ejection system can be suitably used because the permeation suppression agent can be deposited selectively only on portions where ink liquid is to be deposited and the neighboring portions, as described later. If the recording medium 114 does not easily curl, the deposition of the permeation suppression agent may be omitted.

The treatment liquid deposition unit 106 is arranged after the permeation suppression agent deposition unit 104. A transfer drum 124*b* is arranged between the pressure drum (permeation suppression agent drum) 126*a* of the permeation suppression agent deposition unit 104 and a pressure drum (treatment liquid drum) 126*b* of the treatment liquid deposition unit 106, so as to make contact with same. By adopting this structure, after the recording medium 114 which is held on the pressure drum 126*a* of the permeation suppression agent deposition unit 104 has been subjected to the deposition of the permeation suppression agent, the recording medium 114 is transferred through the transfer drum 124*b* to the pressure drum 126*b* of the treatment liquid deposition unit 106.

<Treatment Liquid Deposition Unit>

The treatment liquid deposition unit 106 is provided with a paper preheating unit 134, a treatment liquid ejection head 136 and a treatment liquid drying unit 138 provided respectively at positions facing the surface of the pressure drum 126*b*, in this order from the upstream side in terms of the direction of rotation of the pressure drum 126*b* (the counter-clockwise direction in FIG. 12).

The paper preheating unit 134 uses a similar composition to the paper preheating unit 128 of the permeation suppression agent deposition unit 104, and the explanation is omitted here. Of course, it is also possible to employ a different composition.

The treatment liquid ejection head 136 ejects and deposits droplets of the treatment liquid to the recording medium 114 held on the pressure drum 126*b*, and has a composition similar to the ink ejection heads 140C, 140M, 140Y and 140K of the later described ink ejection unit 108. The treatment liquid used in the present embodiment is an acidic liquid that has the action of aggregating the coloring materials contained in the inks that are ejected onto the recording medium 114 respectively from the ink ejection heads 140C, 140M, 140Y and 140K disposed in the ink ejection unit 108, which is arranged at a downstream stage. The treatment liquid drying unit 138 is provided with a hot air drier which can control the temperature and air blowing volume within a prescribed range. When the recording medium 114 held on the pressure drum 126*b* passes the position facing the hot air drier of the treatment liquid drying unit 138, hot air heated by the hot air driers is blown toward the treatment liquid on the recording medium 114.

The heating temperature of the hot air drier is set to a temperature at which the treatment liquid which has been deposited on the recording medium 114 by the treatment liquid ejection head 136 disposed to the upstream side in terms of the direction of rotation of the pressure drum 126*b* is dried, and a solid or semi-solid aggregating treatment agent layer (a thin film layer of dried treatment liquid) is formed on the recording medium 114.

Reference here to "aggregating treatment agent layer in a solid state or a semi-solid state" includes a layer having a moisture content ratio of 0% to 70% as defined below. "Moisture content ratio" ="Weight per unit surface area of water contained in treatment liquid after drying ($g/m^2$)"/"Weight per unit surface area of treatment liquid after drying ($g/m^2$)"

Also, "aggregating treatment agent" refers not only to a solid or semi-solid substance, but in addition is used in the broader concept to include a liquid substance. In particular, liquid aggregating treatment agent that includes 70% or more solvent (content rate of solvent) is referred to as "aggregating treatment liquid".

Evaluation experiments on movement of coloring material with respect to variation of solvent content in the treatment liquid (the aggregating treatment agent layer) on the recoding medium 114 have shown that when the treatment liquid is dried until the solvent content in the treatment liquid becomes 70% or less, movement of coloring material is not conspicuous. Further, when the treatment liquid is dried until the solvent content in the treatment liquid becomes 50% or less, the level is so good that movement of coloring material can not be visually detected. Therefore, it has been confirmed that this is effective in preventing image degradation.

In this way, by drying the treatment liquid on the recording medium 114 to a solvent content of 70% or less (desirably 50% or less) so that a solid or semi-solid layer of aggregation treatment agent is formed on the recording medium 114, it is possible to prevent image degradation due to movement of coloring material.

<Ink Ejection Unit>

The ink ejection unit 108 is arranged after the treatment liquid deposition unit 106. A transfer drum 124*c* is arranged between the pressure drum 126*b* of the treatment liquid deposition unit 106 and the pressure drum 126*c* of the ink ejection unit 108, so as to make contact with same. By adopting this structure, after the treatment liquid has been deposited onto the recording medium 114 held on the pressure drum 126*b* of the treatment liquid deposition unit 106, thereby forming a solid or semi-solid layer of aggregating treatment agent, the recording medium 114 is transferred through the transfer drum 124*c* to the pressure drum 126*c* of the ink ejection unit 108.

The ink ejection unit 108 is provided with the ink ejection heads 140C, 140M, 140Y and 140K, which correspond respectively to four colors of ink, C (cyan), M (magenta), Y (yellow) and K (black), and solvent drying units 142*a* and 142*b*, which are arranged respectively at positions facing the surface of the pressure drum 126*c*, in this order from the upstream side in terms of the direction of rotation of the pressure drum 126*c* (the counter-clockwise direction in FIG. 12).

The ink ejection heads 140C, 140M, 140Y and 140K employ liquid ejection type recording heads (liquid ejection heads), similarly to the above-described treatment liquid ejection head 136. In other words, the ink ejection heads 140C, 140M, 140Y and 140K respectively eject droplets of corresponding colored inks onto the recording medium 114 held on the pressure drum 126*c*.

An ink storing and loading unit (not shown) has ink tanks for storing the inks to be supplied to the ink ejection heads 140C, 140M, 140Y and 140K, respectively. The tanks are connected to the corresponding ink ejection heads by means of prescribed channels, and supply the inks to the corresponding ink ejection heads. The ink storing and loading unit has a warning device (for example, a display device or an alarm sound generator) for warning when the remaining amount of any ink in the tank is low, and has a mechanism for preventing loading errors among the colors.

The inks are supplied from the ink tanks of the ink storing and loading unit to the ink ejection heads 140C, 140M, 140Y and 140K, and droplets of the colored inks are ejected from the ink ejection heads 140C, 140M, 140Y and 140K toward the recording medium 114 in accordance with the image signal.

Each of the ink ejection heads 140C, 140M, 140Y and 140K is the full-line type head (see FIG. 13) which has a length corresponding to a maximum width of an image forming region of the recording medium 114 held on the pressure drum 126*c*, and has the plurality of nozzles for ejecting ink (not shown in FIG. 12) arrayed on the ink ejection surface thereof over the full width of the image forming region of the recording medium 114. The ink ejection heads 140C, 140M, 140Y and 140K are fixed so as to extend in a direction that is perpendicular to the direction of rotation of the pressure drum 126*c* (the conveyance direction of the recording medium 114).

According to the composition in which such full line heads having the nozzle rows which cover the full width of the image forming region of the recording medium 114 are provided for the respective colors of ink, it is possible to record an image on the image forming region of the recording medium 114 by performing just one operation of moving the recording medium 114 and the ink ejection heads 140C, 140M, 140Y and 140K relatively to each other (in other words, by one sub-scanning action) in the conveyance direction (the sub-scanning direction) by conveying the recording medium 114 in a fixed speed by the pressure drum 126*c*. This single-pass type image formation with such a full line type (page-wide) head can achieve a higher printing speed compared to a case of a multi-pass type image formation with a serial (shuttle) type of head which moves back and forth reciprocally in the direction (the main scanning direction) perpendicular to the conveyance direction of the recording medium (sub-scanning direction), and hence it is possible to improve the print productivity.

The inkjet recording apparatus 100 according to the present embodiment is able to record on recording media (recording paper) up to a maximum size of 720 mm×520 mm and hence a drum having a diameter of 810 mm corresponding to the recording medium width of 720 mm is used for the pressure drum (print drum) 126*c*. The ink ejection volume of the ink ejection heads 140C, 140M, 140Y and 140K is 2 pl, for example, and the recording density is 1200 dpi in both the main scanning direction (the widthwise direction of the recording medium 114) and the sub-scanning direction (the conveyance direction of the recording medium 114).

Although the configuration with the CMYK four colors is described in the present embodiment, combinations of the ink colors and the number of colors are not limited to those. As required, red (R), green (G) and blue (B) inks, light inks, dark inks and/or special color inks can be added. For example, a configuration in which ink heads for ejecting light-colored inks such as light cyan and light magenta are added is possible. Moreover, there are no particular restrictions of the sequence in which the heads of respective colors are arranged.

Although not shown in the drawings, the inkjet recording apparatus 100 has a composition whereby head maintenance operations such as preliminary ejection and suction operation are performed in a state where the ink ejection heads are moved to a prescribed standby position (e.g., outside of the pressure drum 126*c* along the axis direction thereof) from the image recording position over the pressure drum (the image formation drum) 126*c*.

The solvent drying units 142*a* and 142*b* are provided with hot air driers which can control the temperature and air blowing volume within a prescribed range, similarly to the above-described paper preheating units 128 and 134, the permeation suppression agent drying unit 132, and the treatment liquid drying unit 138. When ink droplets are deposited onto the solid or semi-solid aggregating treatment agent layer formed on the recording medium 114, an ink aggregate (coloring material aggregate) is formed on the recording medium 114, and furthermore, the ink solvent which has separated from the coloring material spreads and a liquid layer of dissolved aggregating treatment agent is formed. The solvent component (liquid component) left on the recording medium 114 in this way is a cause of curling of the recording medium 114 and also leads to deterioration of the image. Therefore, in the present embodiment, after the ink ejection heads 140C, 140M, 140Y and 140K deposit the droplets of the corresponding colored inks on the recording medium 114, the solvent component is evaporated off and dried by the hot air driers of the solvent drying units 142*a* and 142*b*.

<Fixing Unit>

The fixing unit 110 is arranged subsequent to the ink ejection unit 108. A transfer drum 124*d* is arranged between the pressure drum (print drum) 126*c* of the ink ejection unit 108 and a pressure drum (fixing drum) 126*d* of the fixing unit 110, so as to make contact with same. After the colored inks have been deposited onto the recording medium 114 held on the pressure drum 126*c* of the ink ejection unit 108, the recording medium 114 is transferred through the transfer drum 124*d* to the pressure drum 126*d* of the fixing unit 110.

The fixing unit 110 is provided with an in-line determination unit 144, which reads in the print results of the ink ejection unit 108, and heating rollers 148*a* and 148*b* at positions facing the surface of the pressure drum 126*d*, in this order from the upstream side in terms of the direction of rotation of the pressure drum 126*d* (the counter-clockwise direction in FIG. 12). The in-line determination unit 144 serves as a device reading the output images, and includes an image sensor that captures an image of the print result of the ink ejection unit 108 (the ink droplet deposition results of the ink ejection heads 140C, 140M, 140Y and 140K). The in-line determination unit 144 functions as a device for checking for nozzle blockages and other ejection defects and as a device for color measurement (colorimetry), on the basis of the droplet ejection image captured through the image sensor.

In the present embodiment, a test pattern such as a line pattern, a density pattern, and a combined pattern of the both, is formed in the image recording area or non-image area (so-called a margin) of the recording medium 114, this test pattern is read in by the in-line determination unit 144, and in-line determination is carried out, for instance, to acquire color information (colorimetry), determine density non-uniformities, judge the presence or absence of ejection abnormalities in the respective nozzles, and the like, on the basis of the reading results.

Each of the heating rollers 148*a* and 148*b* is a roller of which temperature can be controlled in a prescribed range (e.g., 100° C. to 180° C.). The image formed on the recording medium 114 is fixed while nipping the recording medium 114 between the pressure drum 126*d* and each of the heating rollers 148*a* and 148*b* to heat and press the recording medium 114. It is desirable that the heating temperature of the heating rollers 148*a* and 148*b* is set in accordance with the glass transition temperature of the polymer particles contained in the treatment liquid or the ink, for example.

The paper output unit 112 is arranged after the fixing unit 110. The paper output unit 112 is provided with a paper output drum 150, which receives the recording medium 114 on which the image has been fixed, a paper output platform 152, on which the recording media 114 are stacked, and a paper output chain 154 having a plurality of paper output grippers (not shown), which is spanned between a sprocket arranged on the paper output drum 150 and a sprocket arranged above the paper output platform 152.

<Structure of Head>

Next, the structure of heads is described. The respective heads 130, 136, 140C, 140M, 140Y and 140K have the same structure, and a reference numeral 250 is hereinafter designated to any of the heads.

Figure 13A:
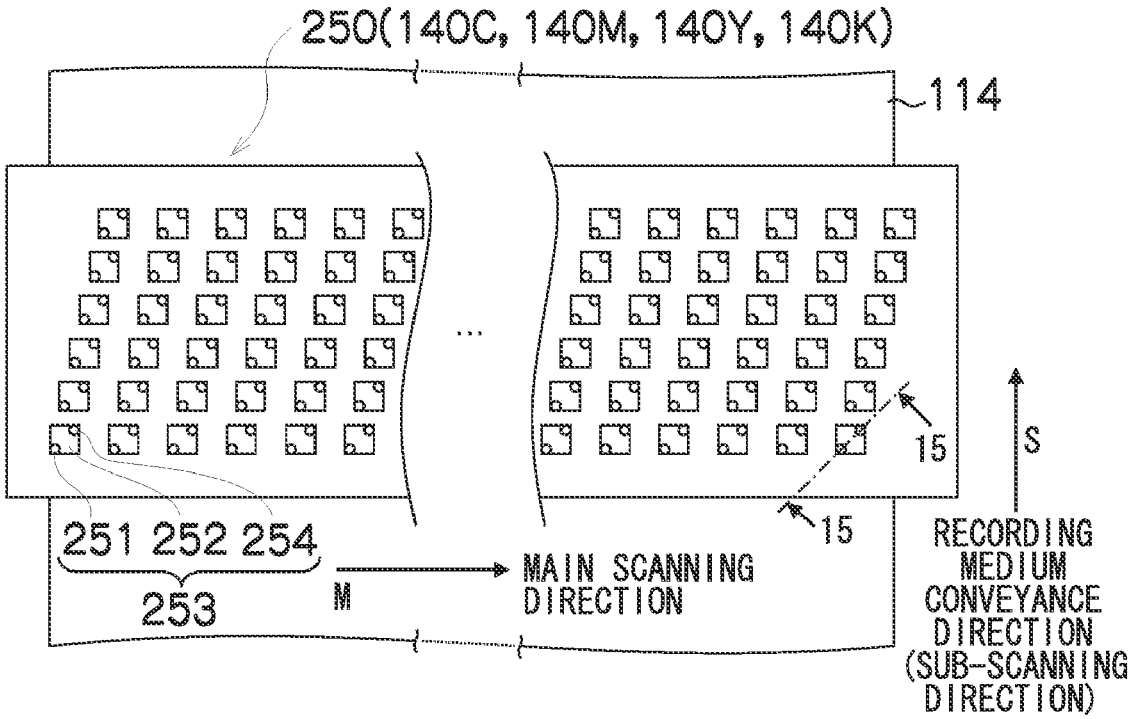
FIGS. 13A and 13B are plan view perspective diagrams showing an embodiment of the structure of a print head.
Figure 13B:
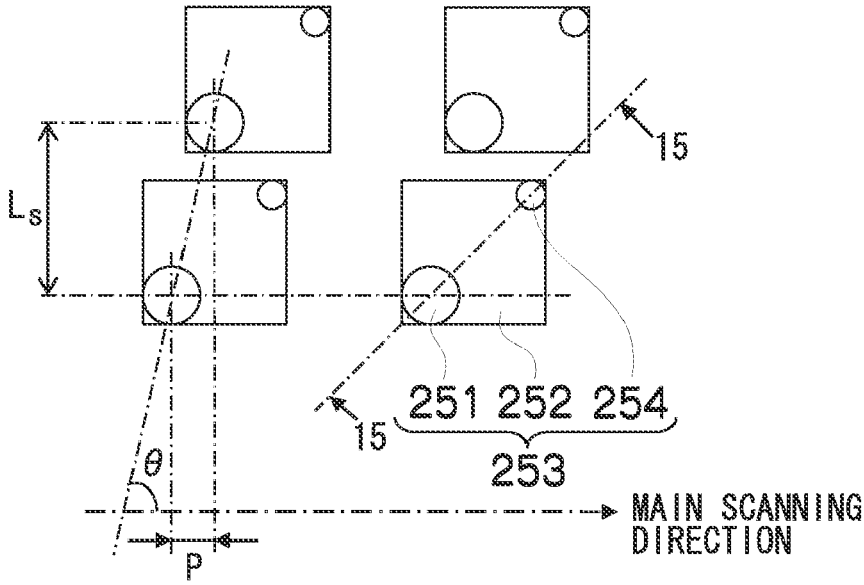
Figure 14A:
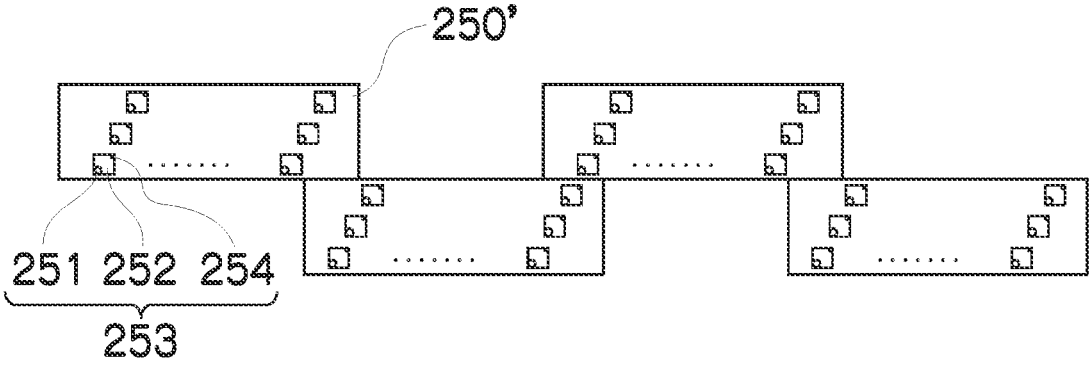
FIGS. 14A and 14B are plan view perspective diagrams showing further embodiments of the structure of a print head.
Figure 14B:
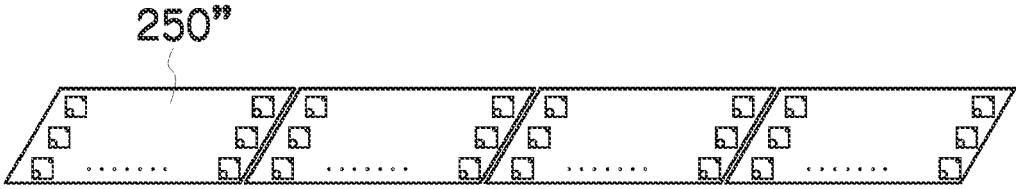
Figure 15:
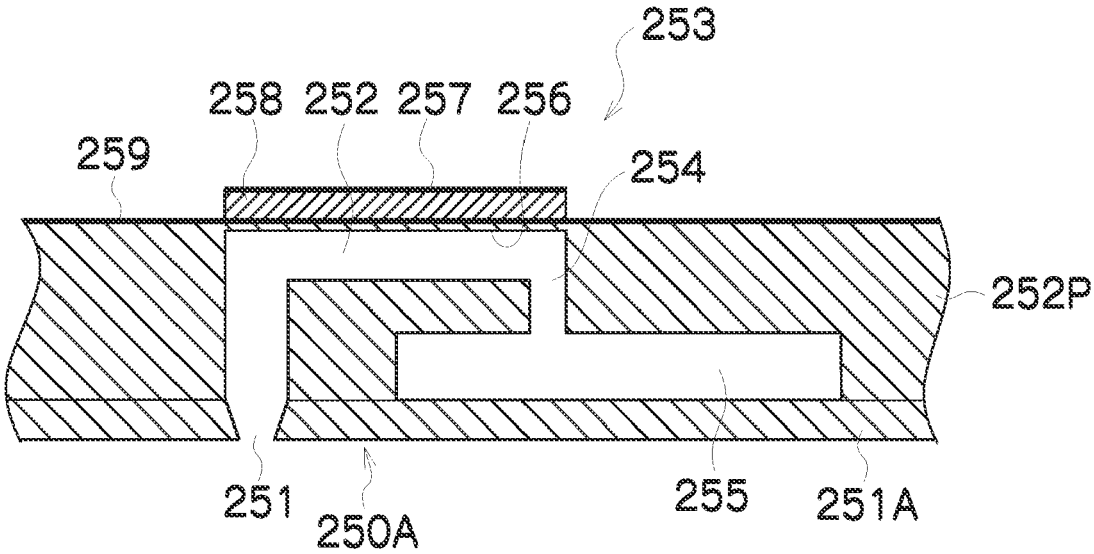
FIG. 15 is a cross-sectional diagram along line 15-15 in FIGS. 13A and 13B.

FIG. 13A is a plan perspective diagram illustrating an embodiment of the structure of a head 250, and FIG. 13B is a partial enlarged diagram of same. Moreover, FIGS. 14A and 14B are planar perspective views illustrating other structural embodiments of heads, and FIG. 15 is a cross-sectional diagram illustrating a liquid droplet ejection element for one channel being a recording element unit (an ink chamber unit corresponding to one nozzle 251) (a cross-sectional diagram along line 15-15 in FIGS. 13A and 13B).

As illustrated in FIGS. 13A and 13B, the head 250 according to the present embodiment has a structure in which a plurality of ink chamber units (liquid droplet ejection elements) 253, each having a nozzle 251 forming an ink droplet ejection aperture, a pressure chamber 252 corresponding to the nozzle 251, and the like, are disposed two-dimensionally in the form of a staggered matrix, and hence the effective nozzle interval (the projected nozzle pitch) as projected (orthographically-projected) in the lengthwise direction of the head (the direction perpendicular to the paper conveyance direction) is reduced and high nozzle density is achieved.

The mode of forming nozzle rows which have a length equal to or more than the entire width Wm of the recording area of the recording medium 114 in a direction (direction indicated by arrow M: main scanning direction) substantially perpendicular to the paper conveyance direction (direction indicated by arrow S: sub-scanning direction) of the recording medium 114 is not limited to the embodiment described above. For example, instead of the configuration in FIG. 13A, as illustrated in FIG. 14A, a line head having nozzle rows of a length corresponding to the entire width Wm of the recording area of the recording medium 114 can be formed by arranging and combining, in a staggered matrix, short head modules 250' having a plurality of nozzles 251 arrayed in a two-dimensional fashion. It is also possible to arrange and combine short head modules 250" in a line as shown in FIG. 14B.

The pressure chamber 252 provided to each nozzle 251 has substantially a square planar shape (see FIGS. 13A and 13B), and has an outlet port for the nozzle 251 at one of diagonally opposite corners and an inlet port (supply port) 254 for receiving the supply of the ink at the other of the corners. The planar shape of the pressure chamber 252 is not limited to this embodiment and can be various shapes including quadrangle (rhombus, rectangle, etc.), pentagon, hexagon, other polygons, circle, and ellipse.

As illustrated in FIG. 15, the head 250 is configured by stacking and joining together a nozzle plate 251A, in which the nozzles 251 are formed, a flow channel plate 252P, in which the pressure chambers 252 and the flow channels including the common flow channel 255 are formed, and the like. The nozzle plate 251A constitutes a nozzle surface (ink ejection surface) 250A of the head 250 and has formed therein the two-dimensionally arranged nozzles 251 communicating respectively to the pressure chambers 252.

The flow channel plate 252P constitutes lateral side wall parts of the pressure chamber 252 and serves as a flow channel formation member, which forms the supply port 254 as a limiting part (the narrowest part) of the individual supply channel leading the ink from a common flow channel 255 to the pressure chamber 252. FIG. 15 is simplified for the convenience of explanation, and the flow channel plate 252P may be structured by stacking one or more substrates.

The nozzle plate 251A and the flow channel plate 252P can be made of silicon and formed in the prescribed shapes by means of the semiconductor manufacturing process.

The common flow channel 255 is connected to an ink tank (not shown), which is a base tank for supplying ink, and the ink supplied from the ink tank is delivered through the common flow channel 255 to the pressure chambers 252.

A piezoelectric actuator 258 having an individual electrode 257 is connected on a diaphragm 256 constituting a part of faces (the ceiling face in FIG. 15) of the pressure chamber 252. The diaphragm 256 in the present embodiment is made of silicon having a nickel (Ni) conductive layer serving as a common electrode 259 corresponding to lower electrodes of a plurality of piezoelectric actuators 258, and also serves as the common electrode of the piezoelectric actuators 258, which are disposed on the respective pressure chambers 252. The diaphragm 256 can be formed by a non-conductive material such as resin; and in this case, a common electrode layer made of a conductive material such as metal is formed on the surface of the diaphragm member. It is also possible that the diaphragm is made of metal (an electrically-conductive material) such as stainless steel (SUS), which also serves as the common electrode.

When a drive voltage is applied between the individual electrode 257 and the common electrode 259, the piezoelectric actuator 258 is deformed, the volume of the pressure chamber 252 is thereby changed, and the pressure in the pressure chamber 252 is thereby changed, so that the ink inside the pressure chamber 252 is ejected through the nozzle 251. When the displacement of the piezoelectric actuator 258 is returned to its original state after the ink is ejected, new ink is refilled in the pressure chamber 252 from the common flow channel 255 through the supply port 254.

As illustrated in FIG. 13B, the plurality of ink chamber units 253 having the above-described structure are arranged in a prescribed matrix arrangement pattern in a line direction along the main scanning direction and a column direction oblique at an angle of θ with respect to the main scanning direction, and thereby the high density nozzle head is formed in the present embodiment. In this matrix arrangement, the nozzles 251 can be regarded to be equivalent to those substantially arranged linearly at a fixed pitch $P=L_S/\tan\theta$ along the main scanning direction, where $L_S$ is a distance between the nozzles adjacent in the sub-scanning direction.

In implementing the present invention, the mode of arrangement of the nozzles 251 in the head 250 is not limited to the embodiments in the drawings, and various nozzle arrangement structures can be employed. For example, instead of the matrix arrangement as described in FIGS. 13A and 13B, it is also possible to use a single linear arrangement, a V-shaped nozzle arrangement, or an undulating nozzle arrangement, such as zigzag configuration (W-shape arrangement), which repeats units of V-shaped nozzle arrangements.

The devices which generate pressure (ejection energy) applied to eject droplets from the nozzles in the inkjet head is not limited to the piezoelectric actuator (piezoelectric elements), and can employ various pressure generation devices (energy generation devices), such as heaters in a thermal system (which uses the pressure resulting from film boiling by the heat of the heaters to eject ink) and various actuators in other systems. According to the ejection system employed in the head, the corresponding energy generation devices are arranged in the flow channel structure body.

<Description of Control System>

Figure 16:
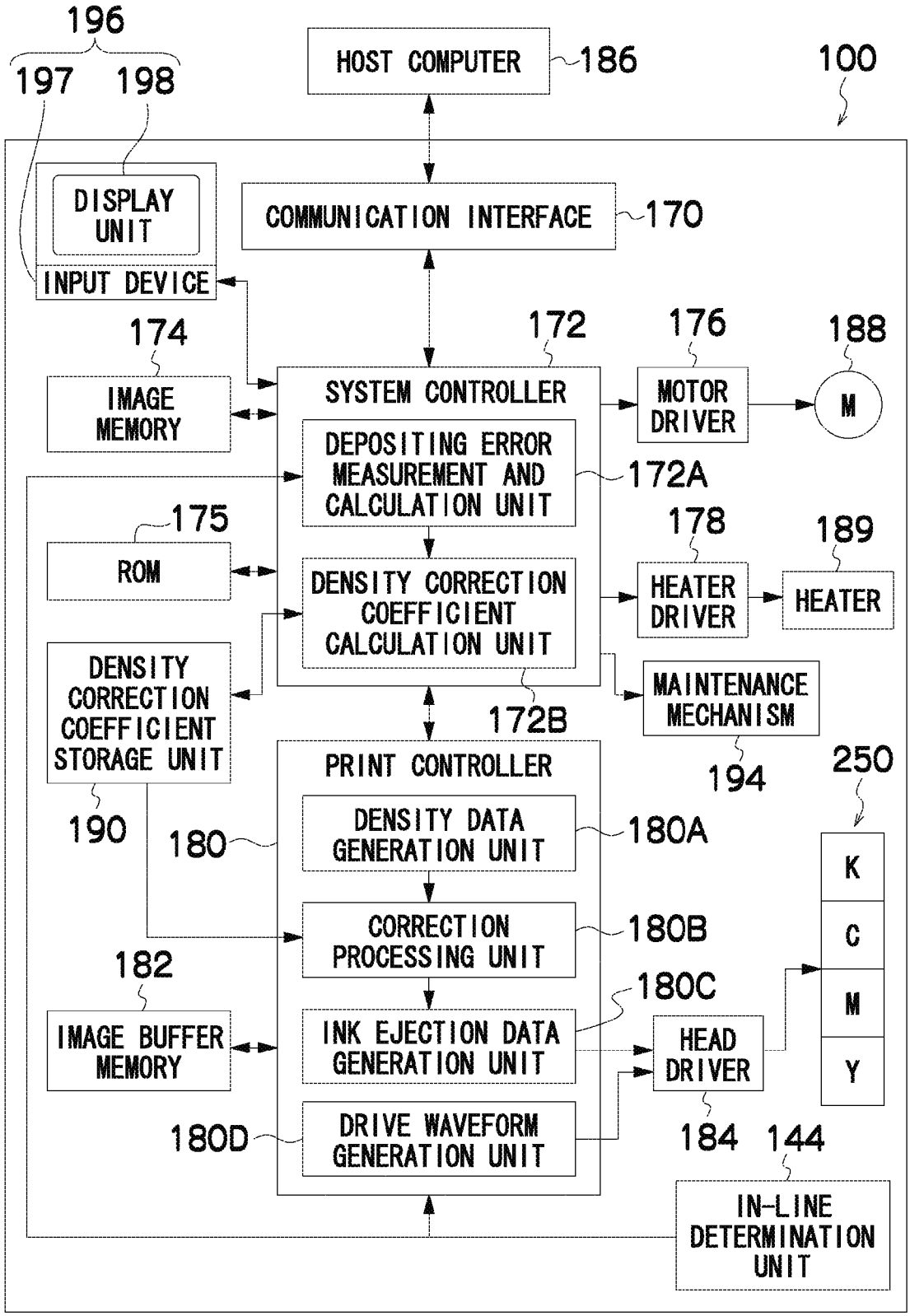
FIG. 16 is a principal block diagram showing the system composition of the inkjet recording apparatus according to the present embodiment.

FIG. 16 is a block diagram showing the system configuration of the inkjet recording apparatus 100. As shown in FIG. 16, the inkjet recording apparatus 100 includes a communication interface 170, a system controller 172, an image memory 174, a ROM 175, a motor driver 176, a heater driver 178, a print controller 180, an image buffer memory 182, a head driver 184, a maintenance mechanism 194, an operating unit 196, and the like.

The communication interface 170 is an interface unit (image input device) for receiving image data sent from a host computer 186. A serial interface such as USB (Universal Serial Bus), IEEE1394, Ethernet (registered trademark), and wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 100 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted of a central processing unit (CPU) and peripheral circuits thereof, and the like, and it functions as a control device for controlling the whole of the inkjet recording apparatus 100 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and the ROM 175, and it also generates control signals for controlling the motor 188 and heater 189 of the conveyance system.

Furthermore, the system controller 172 includes a depositing error measurement and calculation unit 172A, which performs calculation processing for generating depositing position error data from the data read in from the test chart by the in-line determination unit 144, and a density correction coefficient calculation unit 172B, which calculates density correction coefficients from the information relating to the measured depositing position error and the density information. The processing functions of the depositing error measurement and calculation unit 172A and the density correction coefficient calculation unit 172B can be achieved by means of an ASIC (application specific integrated circuit), software, or a suitable combination of same.

The density correction coefficient data obtained by the density correction coefficient calculation unit 172B is stored in a density correction coefficient storage unit 190.

The program executed by the CPU of the system controller 172 and the various types of data (including data for deposition to form the test chart, waveform data for the detection of abnormal nozzles, waveform data for the image recording, data of abnormal nozzles, and the like) which are required for control procedures are stored in the ROM 175. The ROM 175 may be a non-writeable storage device, or it may be a rewriteable storage device, such as an EEPROM. By utilizing the storage region of this ROM 175, the ROM 175 can be configured to be able to serve also as the density correction coefficient storage unit 190.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, as well as functioning as a drive control device which controls the ejection driving of the head 250 by supplying the ink ejection data thus generated to the head driver 184.

In other words, the print controller 180 includes a density data generation unit 180A, a correction processing unit 180B, an ink ejection data generation unit 180C and a drive waveform generation unit 180D. These functional units (180A to 180D) can be realized by means of an ASIC, software or a suitable combination of same.

The density data generation unit 180A is a signal processing device which generates initial density data for the respective ink colors, from the input image data, and it carries out density conversion processing (including UCR processing and color conversion) and, where necessary, it also performs pixel number conversion processing.

The correction processing unit 180B is a processing device which performs density correction calculations using the density correction coefficients stored in the density correction coefficient storage unit 190, and it carries out the non-uniformity correction processing, according to the below described first or second correction method.

The ink ejection data generation unit 180C is a signal processing device including a halftoning device which converts the corrected image data (density data) generated by the correction processing unit 180B into binary or multiple-value dot data, and the ink ejection data generation unit 180C carries out binarization (multiple-value conversion) processing. The halftoning device may employ commonly known methods of various kinds, such as an error diffusion method, a dithering method, a threshold value matrix method, a density pattern method, and the like. The halftoning process generally converts a tonal image data having M values (M≧3) into tonal image data having N values (N<M). In the simplest embodiment, the image data is converted into dot image data having 2 values (dot on/dot off); however, in a halftoning process, it is also possible to perform quantization in multiple values which correspond to different types of dot size (for example, three types of dot: a large dot, a medium dot and a small dot).

The ink ejection data generated by the ink ejection data generation unit 180C is supplied to the head driver 184, which controls the ink ejection operation of the head 250 accordingly.

The drive waveform generation unit 180D is a device for generating drive signal waveforms in order to drive the actuators 258 (see FIG. 15) corresponding to the respective nozzles 251 of the head 250. The signal (drive waveform) generated by the drive waveform generation unit 180D is supplied to the head driver 184. The signal outputted from the drive waveforms generation unit 180D may be digital waveform data, or it may be an analog voltage signal.

The drive waveform generation unit 180D generates selectively the drive signal for the recording waveform and the drive signal for the abnormal nozzle detective waveform. The various waveform data is beforehand stored in the ROM 175, and the waveform data to be used is selectively output according to requirements.

The image buffer memory 182 is provided in the print controller 180, and image data, parameters, and other data are temporarily stored in the image buffer memory 182 when image data is processed in the print controller 180. FIG. 16 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is inputted from an external source through the communication interface 170, and is accumulated in the image memory 174. At this stage, multiple-value RGB image data is stored in the image memory 174, for example.

In this inkjet recording apparatus 110, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180, through the system controller 172, and is converted to the dot data for each ink color by a half-toning technique, using dithering, error diffusion, or the like, by passing through the density data generation unit 180A, the correction processing unit 180B, and the ink ejection data generation unit 180C of the print controller 180.

In other words, the print controller 180 performs processing for converting the input RGB image data into dot data for the four colors of K, C, M and Y. The dot data thus generated by the print controller 180 is stored in the image buffer memory 182. This dot data of the respective colors is converted into CMYK droplet ejection data for ejecting ink from the nozzles of the head 250, thereby establishing the ink ejection data to be printed.

The head driver 184 outputs drive signals for driving the actuators 258 corresponding to the nozzles 251 of the head 250 in accordance with the print contents, on the basis of the ink ejection data and the drive waveform signals supplied by the print controller 180. A feedback control system for maintaining constant drive conditions in the head may be included in the head driver 184.

By supplying the drive signals outputted by the head driver 184 to the head 250 in this way, ink is ejected from the corresponding nozzles 251. By controlling ink ejection from the print head 250 in synchronization with the conveyance speed of the recording medium 114, an image is formed on the recording medium 114.

As described above, the ejection volume and the ejection timing of the ink droplets from the respective nozzles are controlled through the head driver 184, on the basis of the ink ejection data generated by implementing prescribed signal processing in the print controller 180, and the drive signal waveform. By this means, prescribed dot size and dot positions can be achieved.

As described with reference to FIG. 12, the in-line determination unit 144 is a block including an image sensor, which reads in the image printed on the recording medium 114, performs various signal processing operations, and the like, and determines the print situation (presence/absence of ejection, variation in droplet ejection, optical density, and the like), these determination results being supplied to the print controller 180 and the system controller 172.

The print controller 180 implements various corrections with respect to the head 250, on the basis of the information obtained from the in-line determination unit 144, according to requirements, and it implements control for carrying out cleaning operations (nozzle restoring operations), such as preliminary ejection, suctioning, or wiping, as and when necessary.

The maintenance mechanism 194 includes members used to head maintenance operation, such as an ink receptacle, a suction cap, a suction pump, a wiper blade, and the like.

The operating unit 196 which forms a user interface is constituted of an input device 197 through which an operator (user) can make various inputs, and a display unit 198. The input device 197 may employ various formats, such as a keyboard, mouse, touch panel, buttons, or the like. The operator is able to input print conditions, select image quality modes, input and edit additional information, search for information, and the like, by operating the input device 197, and is able to check various information, such as the input contents, search results, and the like, through a display on the display unit 198. The display unit 198 also functions as a warning notification device which displays a warning message, or the like.

The inkjet recording apparatus 100 according to the present embodiment has a plurality of image quality modes, and the image quality mode is set either by a selection operation performed by the user or by automatic selection by a program. The criteria for judging an abnormal nozzle are changed in accordance with the output image quality level which is required by the image quality mode that has been set. If the required image quality is high, then the judgment criteria are set to be more severe.

Information relating to the printing conditions and the abnormal nozzle judgment criteria for each image quality mode is stored in the ROM 175.

It is also possible to adopt a mode in which the host computer 186 is equipped with all or a portion of the processing functions carried out by the depositing error measurement and calculation unit 172A, the density correction coefficient calculation unit 172B, the density data generation unit 180A and the correction processing unit 180B as shown in FIG. 16.

The drive waveform generation unit 180D in FIG. 16 corresponds to a "recording waveform signal generating device" and an "abnormal nozzle detective waveform generating device". Furthermore, a combination of the system controller 172 and the print controller 180 corresponds to a "detective ejection control device", a "correction control device" and a "recording ejection control device".

<Embodiment of Composition of In-line Determination Unit>

Figure 17:
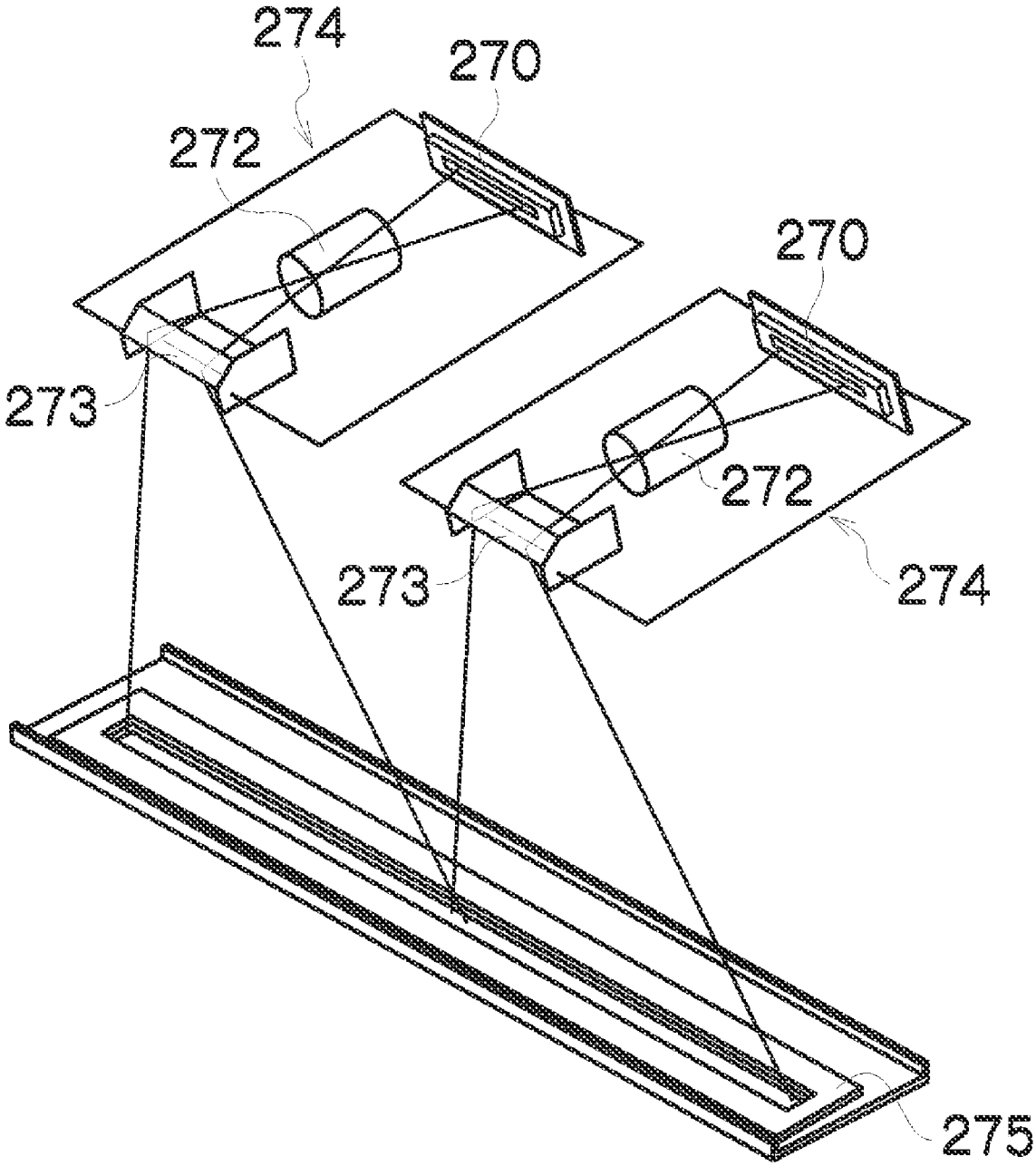
FIG. 17 is a schematic drawing of an in-line determination unit.

FIG. 17 is a schematic drawing showing the composition of the in-line determination unit 144. The in-line determination unit 144 includes reading sensor units 274, which are arranged in parallel and read out the image on a recording medium. Each of the reading sensor units 274 is constituted integrally of: a line CCD 270 (corresponding to an "image reading device"); a lens 272, which forms an image on a light receiving surface of the line CCD 270; and a mirror 273, which bends the light path. The line CCD 270 has an array of color-specific photocells (pixels) provided with three-color RGB filters, and is able to read in a color image by means of RGB color separation. For example, next to each photo cell array of 3 RGB lines, there is provided a CCD analog shift register, which respectively and independently transfers the charges of the even-numbered pixels and odd-numbered pixels in one line.

More specifically, it is possible to use a line CCD "μPD8827A" (product name) having a pixel pitch of 9.325 μm, 7600 pixels×RGB, and a device length (width of sensor in direction of arrangement of photocells) of 70.87 mm, manufactured by NEC Electronics Corporation.

The line CCD 270 is fixed in a configuration where the direction of arrangement of the photocells is parallel with the axis of the drum on which the recording medium is conveyed.

The lens 272 is a lens of a condenser optics system, which provides the image on the recording medium that is wrapped about the conveyance drum (pressure drum 126*d* in FIG. 1), at a prescribed rate of reduction. For example, if a lens which reduces the image to 0.19 times is employed, then the 373 mm width on the recording medium is provided onto the line CCD 270. In this case, the reading resolution on the recording medium is 518 dpi.

As illustrated in FIG. 17, the reading sensor units 274 each integrally having the line CCD 270, lens 272 and mirror 273 can be moved and adjusted in parallel with the axis of the conveyance drum, whereby the positions of the two reading sensor units 274 are adjusted and the respective reading sensor units 274 are disposed in such a manner that the images read by them are slightly overlapping. Furthermore, although not illustrated in FIG. 17, as an illumination device for determination, a xenon fluorescent lamp is disposed on the rear surface of a bracket 75, on the side of the recording medium, and a white reference plate is inserted periodically between the image and the illumination source so as to measure a white reference. In this state, the lamp is extinguished and a black reference level is measured.

The reading width of the line CCD 270 (the extent to which the determination can be performed in one action) can be designed variously in accordance with the width of the image recording range on the recording medium. From the viewpoint of lens performance and resolution, for example, the reading width of the line CCD 270 is approximately ½ of the width of the image recording range (the maximum width which can be scanned).

The image data obtained by the line CCD 270 is converted into digital data by an A/D converter, or the like, and then stored in a temporary memory, whereupon the data is processed through the system controller 172 and stored in the memory 174.

Embodiments of Forming Pattern for On-line Ejection Defect Detection

Figure 18:
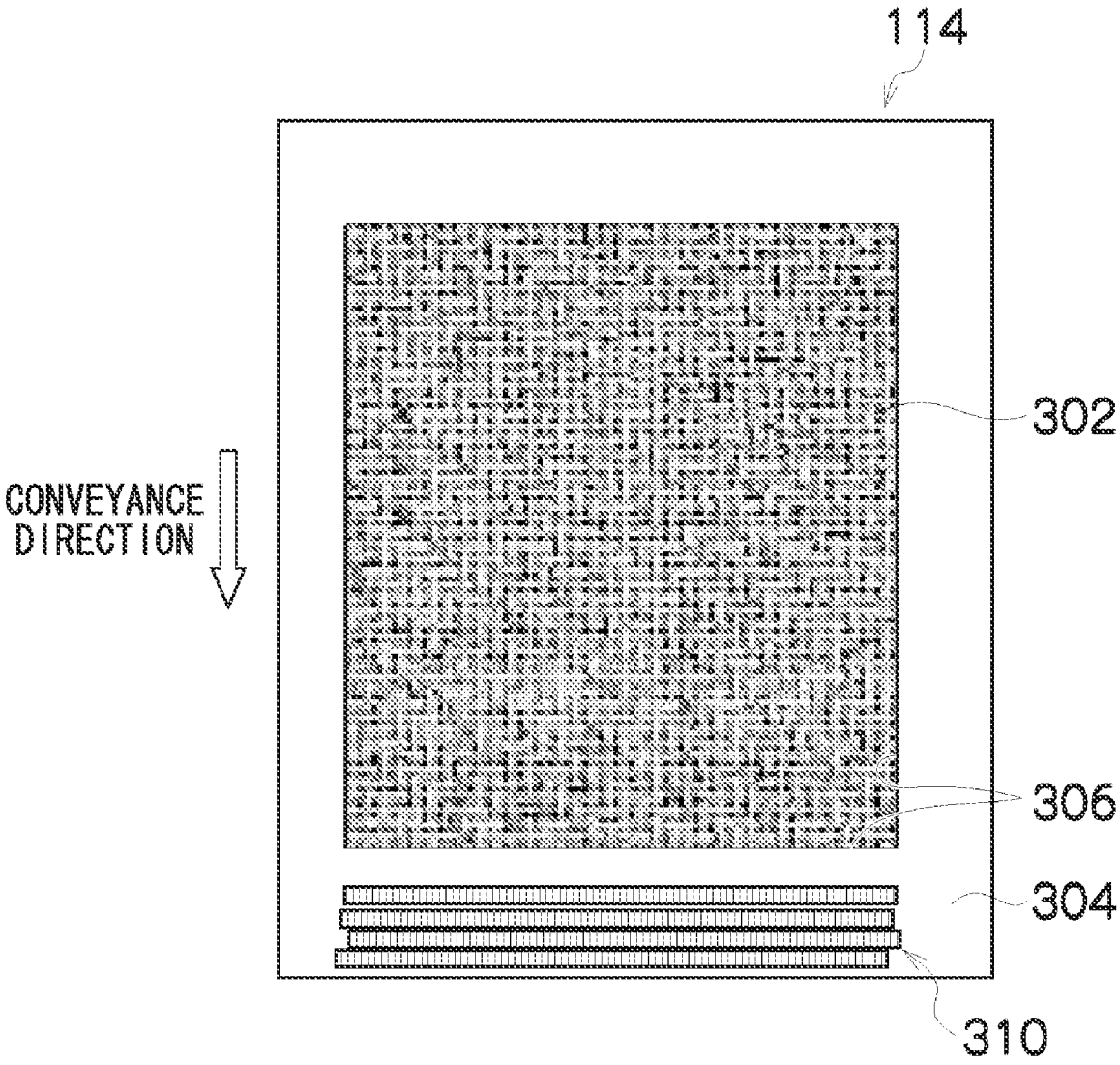
FIG. 18 is an illustrative diagram showing an embodiment of forming a test chart.

FIG. 18 shows an embodiment of forming a detective pattern (test chart) for early detection of abnormal nozzles during printing. Here, a detective pattern 310 is formed in a margin portion (non-image region) 304 outside the image forming region 302 on the recording medium 114. In FIG. 18, the downward vertical direction is the direction of conveyance of the recording medium. The detective pattern 310 is formed in the margin portion 304 on the leading end side of the paper sheet in the conveyance direction of the recording medium 114; however, it is also possible to form a detective pattern in the margin portion on the trailing end side of the paper sheet.

The image forming region 302 is a region where a desired image is formed. After recording a desired image on the image forming region 302, the recording medium is cut along a cutting line 306 to remove the peripheral non-image portion, and the image portion of the image forming region 302 remains as a print product.

For the detective pattern 310, it is possible to use a so-called "1-on n-off" type line pattern, which can form lines in the sub-scanning direction corresponding independently to the nozzles in the head, for example.

By conveying the recording medium 114 while ejecting and depositing droplets continuously from one nozzle, a dot row (line) is formed in which dots created by the ink deposited from the one nozzle are arranged in a line shape in the sub-scanning direction on the recording medium 114, but in the case of a line head having a high recording density, the dots created by adjacent nozzles are partially overlapping when droplets are ejected and deposited simultaneously from all of the nozzles, and therefore the lines of the respective nozzles cannot be distinguished from each other. In order to make it possible to distinguish the lines formed by the respective nozzles individually, line groups are formed by leaving an interval of at least one nozzle, and desirably 3 or more nozzles, between the nozzles which simultaneously perform ejection.

In the present embodiment, in one line head, if nozzle numbers are assigned in sequence from the end in the main scanning direction to the nozzles which constitute a nozzle row aligned effectively in one row following the main scanning direction (the effective nozzle row obtained by orthogonal reflection), then the nozzle groups which simultaneously perform ejection are divided up on the basis of the remainder "B" produced when the nozzle number is divided by an integer "A" of 2 or greater (B=0, 1, . . . , A−1), and line groups produced by continuous droplet ejection from respective nozzles are formed respectively by altering the droplet ejection timing for the groups of nozzle numbers: AN+0, AN+1, . . . , AN+B (where N is an integer of 0 or greater).

By this means, adjacent lines do not overlap with each other between the respective line blocks, and respectively independent lines can be formed for the nozzles. A similar detective pattern is formed for each of the heads corresponding to the ink colors of C, M, Y and K.

Here, since the region of the non-image portion 304 on the recording medium 114 is limited, then it may not be possible to form the line patterns (test charts) for all of the nozzles in all of the heads in the non-image portion 304 of one sheet of recording medium 114. In this case, the test charts are formed by dividing between a plurality of sheets of recording media 114. For example, if the test chart which can be formed on the non-image portion 304 of one sheet of recording medium 114 covers ⅛ of all the nozzles, then this means that the droplet ejection results of all of the nozzles are checked by dividing between 8 sheets of recording media 114.

Furthermore, if using the abnormal nozzle detective waveforms of two types, namely, the waveform suited to amplification of causes that are internal to the nozzle and the waveform suited to amplification of causes that are external to the nozzle, then it is possible to check for the respective causes in all of the nozzles of all of the heads on double the number of sheets of recording media, namely, 16 sheets. The presence and absence of abnormalities can be confirmed in respect of all of the nozzles of all of the heads, and image recording on the image portion can be continued while carrying out correction processing in respect of any abnormal nozzles detected.

However, since a large number of sheets are required to complete confirmation of all of the nozzles, then it is also possible to adopt a composition which uses the abnormal nozzle detective waveform of any one type, namely, the waveform suited to amplification of causes that are internal to the nozzles or the waveform suited to amplification of causes that are external to the nozzles. Furthermore, it is also possible to adopt a composition which uses a different implementation frequency for detection using the waveform suited to amplification of causes that are internal to the nozzles or detection using the waveform suited to amplification of causes that are external to the nozzles.

Flowchart of Non-uniformity Correction Sequence (Embodiment 1)

Figure 19:
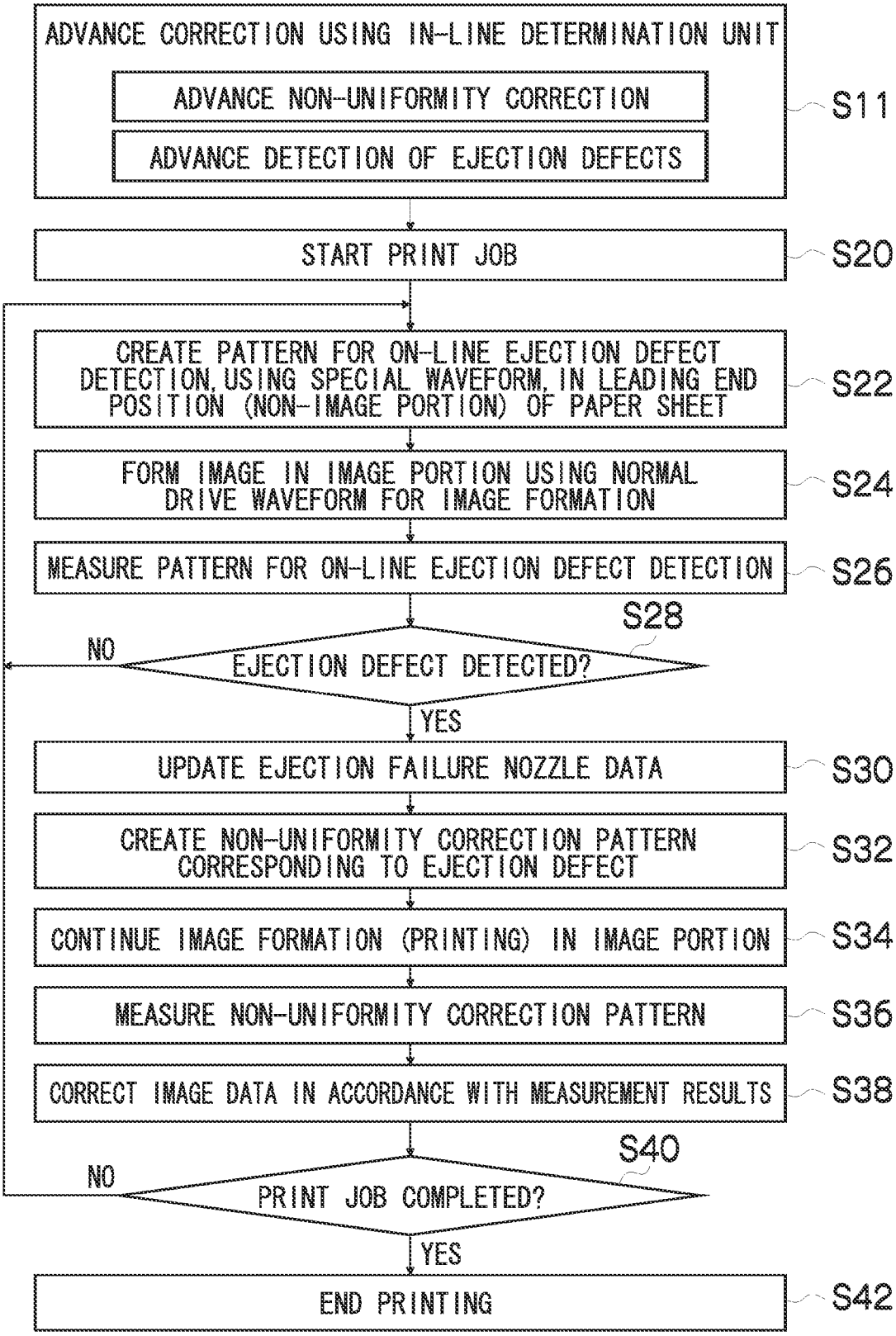
FIG. 19 is a flowchart showing a non-uniformity correction sequence in the inkjet recording apparatus according to an embodiment of the present invention.

FIG. 19 is a flowchart showing a non-uniformity correction sequence in the inkjet recording apparatus 100 according to an embodiment of the present invention. The non-uniformity correction according to the present embodiment combines: an advance correction step (step S11) of acquiring correction data by measuring a test chart by means of the sensor (the in-line determination unit 144) inside the inkjet recording apparatus 100, before the start of continuous printing for a print job; and on-line correction steps (steps S20 to S38) for carrying out correction in an adaptive fashion while carrying out continuous printing (without interrupting printing), by measuring a test chart with the in-line determination unit 144 during continuous printing.

In the advance correction step (step S11), advance ejection defect detection processing is carried out in parallel with advance non-uniformity correction processing.

Figure 20:
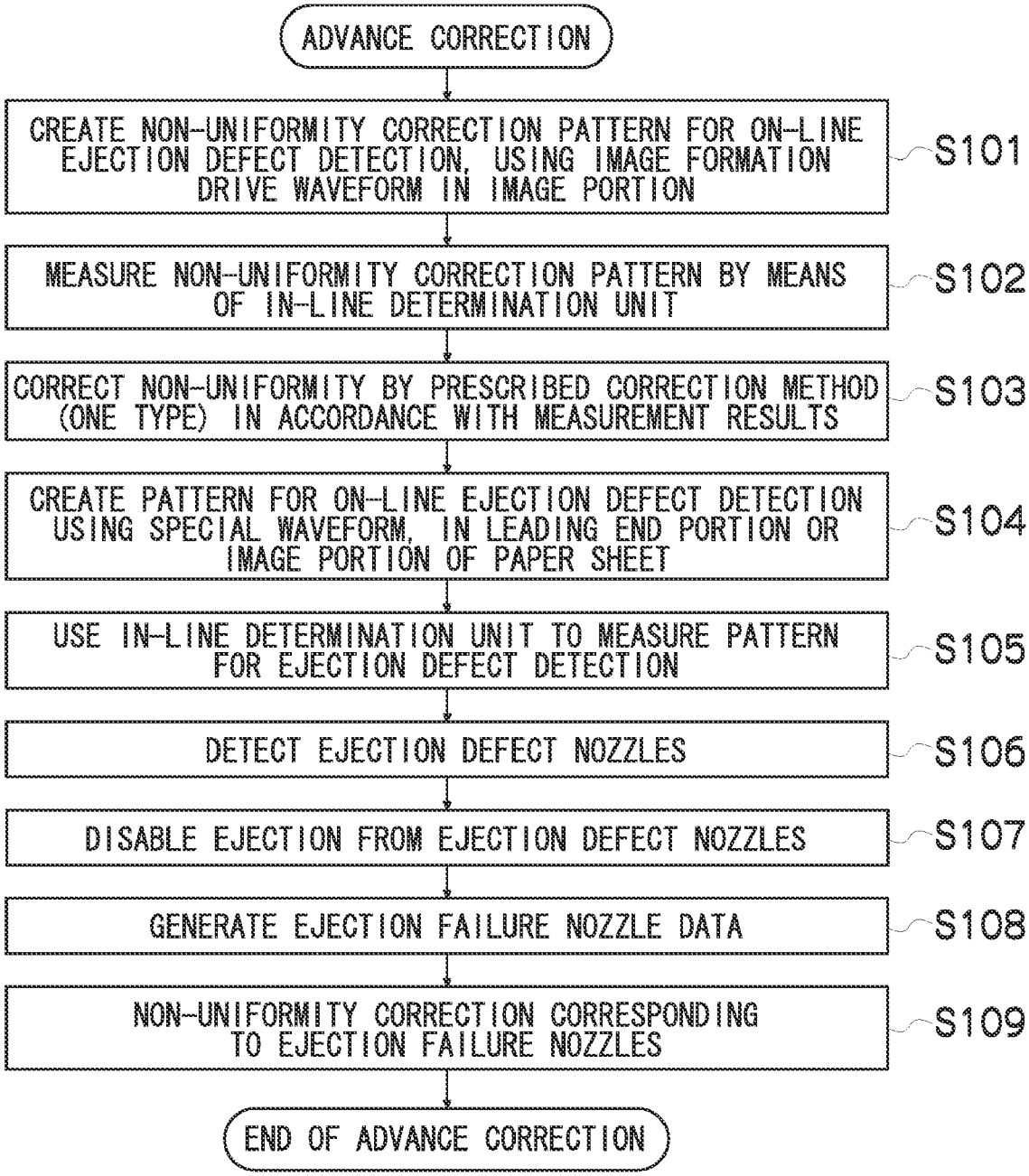
FIG. 20 is a flowchart showing a sequence of advance correction.

FIG. 20 shows a flowchart of the advance correction processing. As shown in FIG. 20, in the advance correction processing, firstly, a non-uniformity correction pattern for on-line ejection defect detection is formed using the image formation drive waveform in an image portion of a recording medium (paper sheet) (step S101). The non-uniformity correction pattern for on-line ejection defect detection may include a line pattern suited to measurement of depositing position variation (deposition error) in each nozzle, a line pattern suited to identifying the positions of ejection failure nozzles, a density pattern suited to measurement of density non-uniformity, and the like. It is possible to print a combination of these test patterns on one sheet of recording medium, and it is possible to print the elements of the respective test patterns by dividing between a plurality of sheets of recording media.

The print results of the non-uniformity correction pattern output in this way are read in using the in-line determination unit 144 inside the inkjet recording apparatus 100, and data of various kinds required for image correction and other processing, such as density data, depositing error data showing depositing position error of each nozzle, ejection failure nozzle data identifying the positions of ejection failure nozzles, and the like, is generated (step S102).

The inkjet recording apparatus 100 carries out non-uniformity correction by employing a prescribed correction method, on the basis of the measurement results of the non-uniformity correction pattern (step S103). Here, any one correction method of the first correction method or the second correction method described below is employed as the correction method.

Furthermore, the advance ejection defect detection shown in steps S104 to S109 is carried out in parallel with the advance non-uniformity correction shown in steps S101 to 5103. More specifically, a pattern (test chart) for on-line ejection defect detection is formed with the abnormal nozzle detective waveform in the leading end portion or the image portion of the paper (step S104), and this is measured by the in-line determination unit 144 (step S105). The abnormal nozzle detective waveform uses the waveform of one type or waveforms of a plurality of types. It is desirable to use the waveform or waveforms of the plurality of types which can respond to abnormality causes that are internal and external to the nozzles.

Ejection defect nozzles are detected in accordance with the measurement results (step S106), and the detected ejection defect nozzles are subjected to an ejection disabling process (step S107). More specifically, the nozzles are set not to be used for droplet ejection during image formation. Furthermore, information on ejection failure nozzles in the head (ejection failure nozzle data) is generated (step S108), and this information is stored in a storage device, such as a memory.

Thereupon, non-uniformity correction processing corresponding to these ejection failure nozzles is carried out (step S109). The method of non-uniformity correction in this case may employ the same method as the correction method employed in step S103. It is also possible to employ a different correction method to the step S103.

The correction coefficient data, ejection failure nozzle data and depositing error data acquired by the above-described advance correction steps (steps S101 to 109) is stored in the storage device inside the inkjet recording apparatus 100 (and desirably, in a non-volatile storage device, for example, the ROM 175).

There are no particular restrictions on the timing at which the advance correction described in FIG. 20 is carried out, but it is, for example, carried out at a frequency of once per a few days, when the inkjet recording apparatus 100 is started up, or the like.

<First Correction Method>

For the first correction method, it is possible to employ a known correction method as disclosed in Japanese Patent Application Publication No. 2006-347164. According to this method, the density non-uniformity caused by the depositing errors can be corrected. Japanese Patent Application Publication No. 2006-347164 discloses image recording apparatuses (1) to (8) having the following compositions.

(1) An image recording apparatus which includes: a recording head which has a plurality of recording elements; a conveyance device which causes the recording head and a recording medium to move relatively to each other by conveying at least one of the recording head and the recording medium; a characteristics information acquisition device which acquires information that indicates recording characteristics of the recording elements; a correction object recording element specification device which specifies a correction object recording element from among the plurality of recording elements, a density non-uniformity caused by the recording characteristic of the correction object recording element being corrected; a correction range setting device which sets N correction recording elements (where N is an integer larger than 1) from among the plurality of recording elements, the N correction recording elements being used in correction of output density; a correction coefficient specification device which calculates the density non-uniformity caused by the recording characteristic of the correction object recording element, and specifies density correction coefficients for the N correction recording elements according to correction conditions that reduce a low-frequency component of a power spectrum representing spatial frequency characteristics of the calculated density non-uniformity; a correction processing device which performs calculation for correcting the output density by using the density correction coefficients specified by the correction coefficient specification device; and a drive control device which controls driving of the recording elements according to correction results produced by the correction processing device.

(2) In the image recording apparatus (1), the correction conditions are conditions where differential coefficients at a frequency origin point (f=0) in the power spectrum representing the spatial frequency characteristics of the density non-uniformity become substantially zero.

(3) In the image recording apparatus (2), the correction conditions are expressed by N simultaneous equations obtained according to conditions for preserving a DC component of the spatial frequency, and conditions at which the differential coefficients up to (N−1)-th order become substantially zero.

(4) In any of the image recording apparatuses (1), (2) and (3), the recording characteristics include recording position error.

(5) In the image recording apparatus (4), the density correction coefficients for the recording elements are specified by the following equation:

$$d_i = \begin{cases} \dfrac{\prod_k x_k}{x_i \cdot \prod_{k \neq i} (x_k - x_i)} - 1 & \text{(for the correction object recording element)} \\ \dfrac{\prod_k x_k}{x_i \cdot \prod_{k \neq i} (x_k - x_i)} & \left(\begin{array}{c}\text{for the recording elements other than the} \\ \text{correction object recording element}\end{array}\right), \end{cases}$$

where i is an index identifying a position of the recording element, $d_i$ is the density correction coefficient for the recording element i, and $x_i$ is a recording position of the recording element i.

(6) In the image recording apparatus (1) or (2), the image recording apparatus further includes: a storage device which stores a print model of the recording elements, wherein the correction coefficient specification device specifies the density correction coefficients according to the print model.

(7) In the image recording apparatus (6), the storage device stores a plurality of print models of the recording elements; and the image recording apparatus further comprises a print model changing device which selects one of the print models according to a recording state of the recording elements.

(8) In the image recording apparatus (6) or (7), the print model includes a hemispherical model.

Irregularities in the density of a recorded image (density non-uniformities) can be represented by the intensity of the spatial frequency characteristics (power spectrum), and the visibility of a density non-uniformity can be evaluated by means of the low-frequency component of the power spectrum. For example, it is possible that the density correction coefficients are specified by using conditions under which the differential coefficients at the frequency origin point (f=0) of the power spectrum after correction using the density correction coefficients become substantially zero, then the intensity of the power spectrum becomes a minimum at the frequency origin point and the power spectrum restricted to a low value in the vicinity of the origin (in other words, in the low-frequency region). Accordingly, highly accurate correction of non-uniformity can be achieved.

The density correction coefficient corresponding to the correction object nozzle and the nozzles included in the correction range peripheral to the correction object nozzle is determined using the correction method disclosed in Japanese Patent Application Publication No. 2006-347164. The density non-uniformity caused by the recording characteristics of the nozzles (deposition error, and the like) is calculated, and the density correction data is derived on the basis of the correction conditions which reduce the low-frequency component of the power spectrum which represents the spatial frequency characteristics of the density non-uniformity. Correction of the input image data for printing is carried out using this density correction data.

The image data correction processing is desirably carried out on the continuous tonal image data at a stage prior to the halftoning process (the processing for converting to binary or multiple-value dot data).

<Second Correction Method>

For the second correction method, it is possible to employ a known correction method as disclosed in Japanese Patent Application Publication No. 2010-083007. In the second correction method, ejection failure nozzles are identified, and a correction coefficient for correcting the image data is calculated so as to compensate the density of the ejection failure nozzles by means of peripheral nozzles other than the ejection failure nozzles. Japanese Patent Application Publication No. 2010-083007 discloses image processing apparatuses (1) and (2) having the following compositions.

(1) An image processing apparatus which includes: a density information acquisition device which is a device that reads in an image of a density measurement test chart recorded by a recording head having a plurality of recording elements arranged in a prescribed direction and acquires density information showing the recording density of the respective recording elements, the reading resolution in the direction following the arrangement of the recording elements being smaller than the recording resolution of the recording elements; an ejection failure information acquisition device which acquires ejection failure information showing the presence or absence of an ejection failure in the recording elements; a density information correction device which corrects density information acquired by the density information acquisition device in accordance with the ejection failure information acquired by the ejection failure information acquisition device; a density non-uniformity correction information calculation device which calculates density non-uniformity correction information from the corrected density information; an ejection failure correction information calculation device which calculates ejection failure correction information for correcting the ejection failures in accordance with the ejection failure information; and an image data correction information calculation device which calculates image data correction information by adding together the density non-uniformity correction information and the ejection failure correction information.

(2) In the image processing apparatus (1), the density information correction device identifies the recording elements having ejection failure in accordance with the ejection failure information and corrects the density information corresponding to the recording elements having ejection failure so as to be higher than the density information before correction.

The specific methods are described with reference to FIGS. 19 to 27 below.

Referring back to the flowchart in FIG. 19, after carrying out the advance correction processing, and acquiring the data required for correction at step S11, a print job is started to carry out consecutive printing of multiple sheets at a suitable timing (step S20). After the start of printing, on-line correction is carried out by means of the correction method based on the second correction method. More specifically, when printing is started, a pattern (test chart) for on-line ejection defect detection is formed using the abnormal nozzle detective waveform (step S22) in the non-image portion of the leading end portion of the paper, and a desired image is recorded on the image portion of the paper by means of the drive signal having the normal drive waveform for image formation (step S24).

Figure 21:
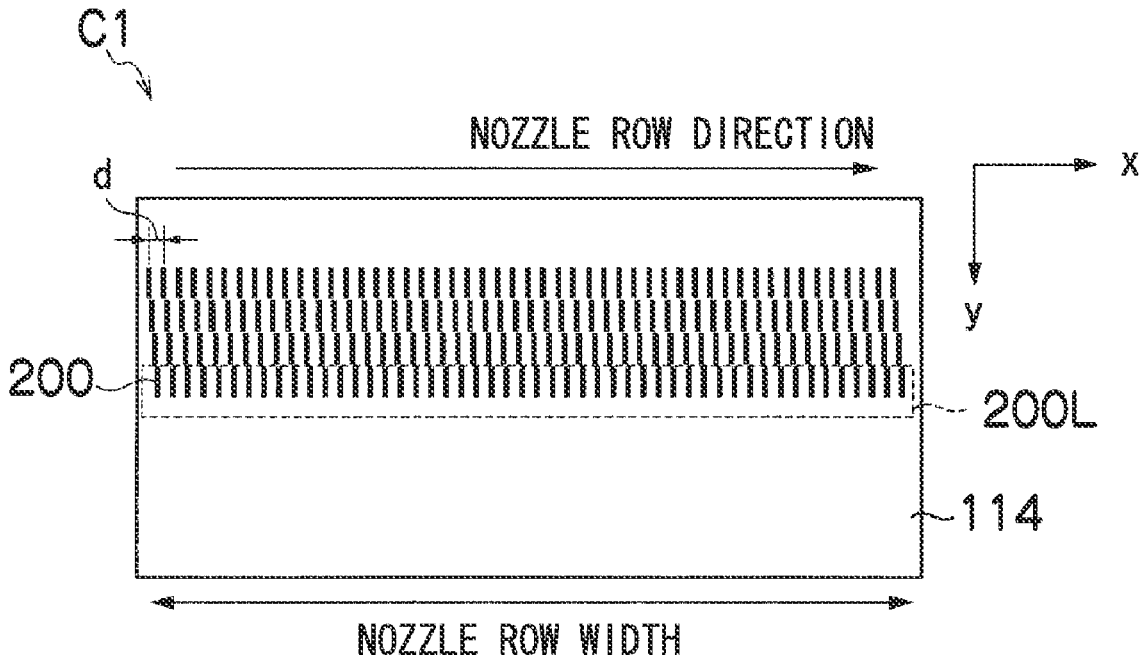
FIG. 21 is a plan diagram showing an embodiment of a test chart for on-line ejection defect detection.

FIG. 21 is a plan diagram showing an embodiment of a test chart for on-line ejection defect detection. As shown in FIG. 21, this test chart C1 is formed by printing substantially parallel line-shape patterns 200 in the y direction (the sub-scanning direction), at a prescribed spacing apart in the x direction (the main scanning direction), by means of the ink droplet ejection head 250. Here, the spacing d in the x direction between the patterns 200 is set in accordance with the resolution of the in-line determination unit 144. For example, if the effective nozzle density N in the x direction of the ink droplet ejection head 250 is taken as 1200 npi (nozzles per inch), and the reading resolution R in the x direction of the in-line print determination unit 144 is taken as 400 dpi (dots per inch), then the x-direction spacing d of the patterns 200 is set to $d \geqq 1/R = 1/400$ inches.

When creating the test chart C1 for ejection failure detection, more specifically, one line of a pattern 200L is printed by ejecting and depositing droplets of the ink from every other n nozzles ($n \geqq 3 (= N/R = 1200/400)$) in the x direction. Thereupon, the nozzles which are to eject ink are shifted by one nozzle in the x direction and printing is carried out by every other n nozzles. By repeating this n times, the patterns 200 formed by the ejection from all of the nozzles are printed. By this means, it is possible to create the test chart C1 which makes it possible to judge whether or not a nozzle is an ejection failure nozzle, at the resolution of the in-line determination unit 144, in respect of all of the nozzles.

The recording medium 114 which has completed image recording of the test chart C1 and the image portion is conveyed by the conveyance devices, such as the transfer drum 124*d* and the pressure drum 126*d*, and the print results of the pattern for on-line ejection defect detection is read in by the in-line determination unit 144 (step S26). The presence and absence of ejection defects is judged on the basis of this reading information (step S28).

The information relating to the judgment criteria of the abnormal nozzle is beforehand stored in the ROM 175, or the like, and the judgment reference value corresponding to the image quality mode is set. For example, a reference value relating to one or a plurality of evaluation items, such as a tolerance value for the depositing error caused by flight deviation of ejected droplets, a tolerance value for line width (tolerance value for ejection volume), a density value, and the like, are specified. The presence or absence of abnormal nozzles is judged in accordance with this reference value, and abnormal nozzles are identified.

In step S28, if there is no nozzle having an ejection defect (an ejection failure or flight deviation of ejected droplets), then the procedure returns to step S22 and the processing described above (steps S22 to S28) is repeated while continuing printing of the desired image.

On the other hand, in step S28, if there is a nozzle having an ejection defect, then the position of this abnormal nozzle is identified, and the ejection failure nozzle data which indicates the nozzles having ejection failure is updated in such a manner that this abnormal nozzle is treated as an ejection failure nozzle which is not used in image formation of the image portion (step S30). Thereupon, a non-uniformity correction pattern corresponding to the aforementioned ejection defect is created in the non-image portion of the following recording medium 114 (step S32). This non-uniformity correction pattern is formed by prohibiting droplet ejection from the abnormal nozzles identified above (halting ejection from these nozzles), and printing a pattern for density measurement by using only the remaining normal nozzles.

The image recording of the image portion of the recording medium 114 in a case where the non-uniformity correction pattern is formed in the non-image portion is carried out by also using (performing ejection from) nozzles which have been determined as abnormal nozzles in step S28 and using a drive signal having the normal waveform for recording (step S32). In other words, the image formation is continued under the same conditions as when printing the previous sheet.

Figure 22:
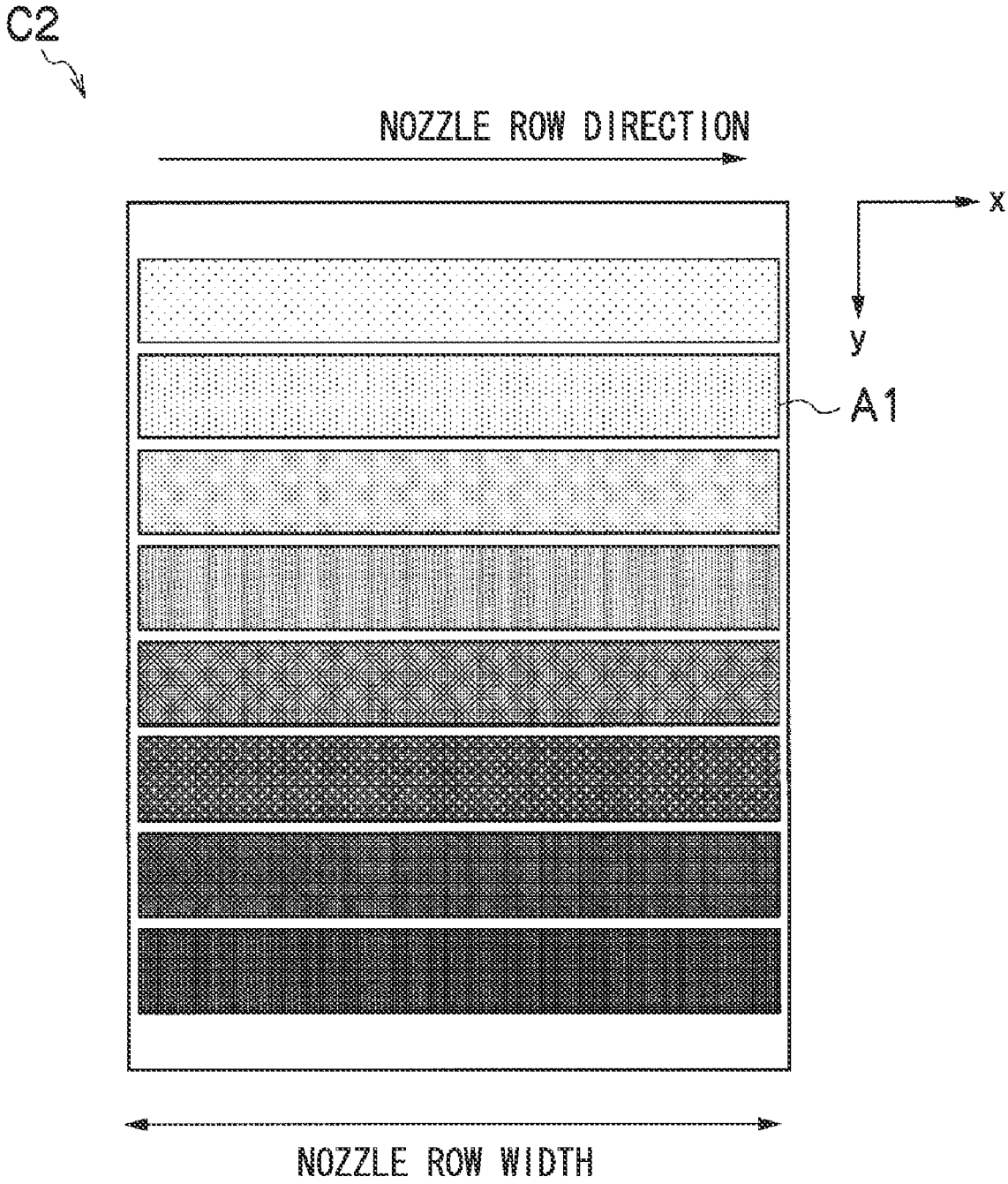
FIG. 22 is a plan diagram showing a density measurement test chart.

FIG. 22 is a plan diagram showing an embodiment of a density measurement test chart (non-uniformity correction pattern). As shown in FIG. 22, the density measurement test chart C2 is formed by printing a density pattern in which the density is uniform in the x direction and the density changes in a stepwise fashion in the y direction. By reading in the image of the density measurement test chart C2 by means of the in-line determination unit 144, it is possible to obtain density data corresponding to the pixel positions (measurement density positions) of the in-line determination unit 144 in the nozzle row direction. Due to the limitations of the margin area of the recording medium 114, it is possible to form the test chart C2 by dividing over a plurality of sheets of recording medium 114.

The recording medium 114 which has completed the image recording of the non-uniformity correction pattern (the test chart C2) and the image portion is conveyed by the conveyance devices, such as the transfer drum 124*d* and the pressure drum 126*d*, and the print results of this test chart C2 are read in by the in-line determination unit 144 (step S36 in FIG. 19). Data is obtained from this read information, and density data which represents the density distribution in the main scanning direction is acquired.

The image data is corrected on the basis of these measurement results (step S38).

Figure 23:
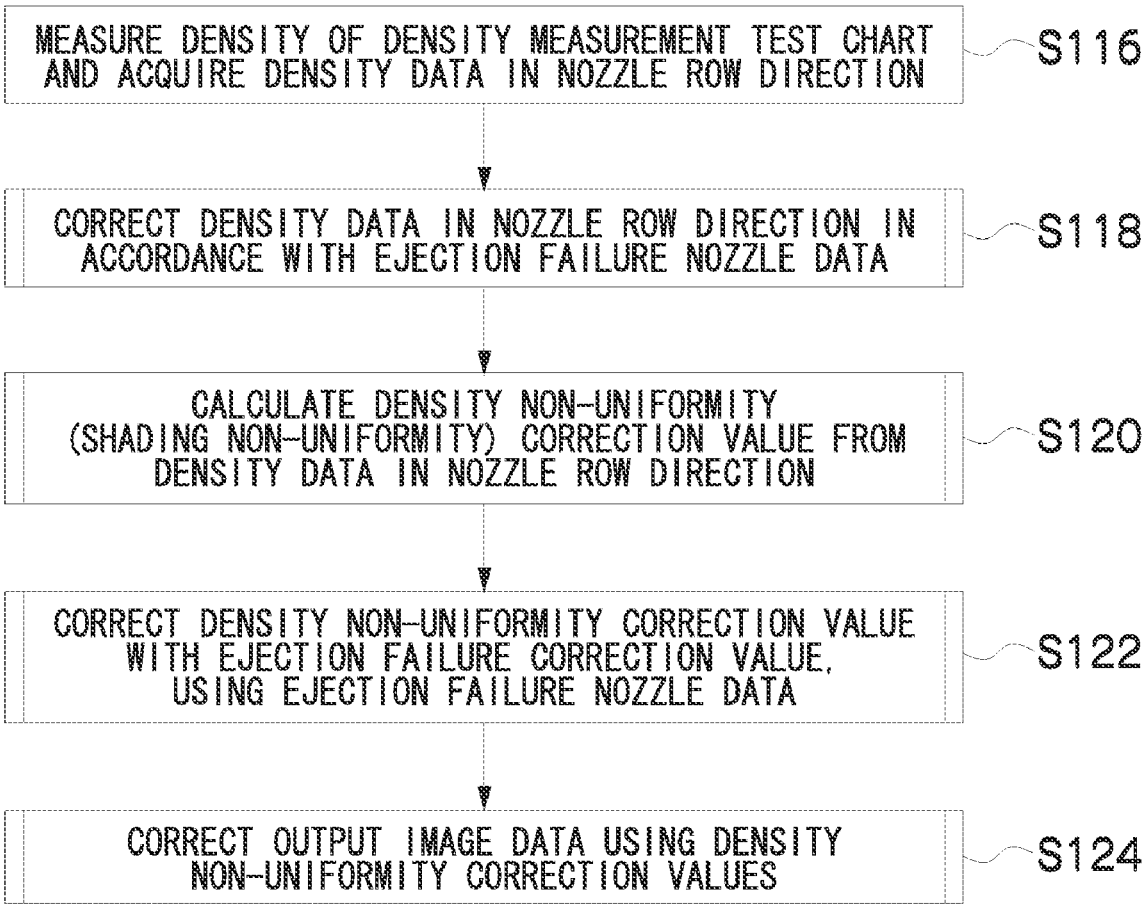
FIG. 23 is a flowchart showing the details of image data correction processing in step S38 in FIG. 19.

FIG. 23 is a flowchart of the image data correction processing in step S38.

From the results of measuring the density of the density measurement chart, density data showing the density distribution in the nozzle row direction (main scanning direction; called the x direction) is acquired (step S116). Next, the density data in the nozzle row direction is corrected on the basis of the ejection failure nozzle data (step S118).

Figure 24:
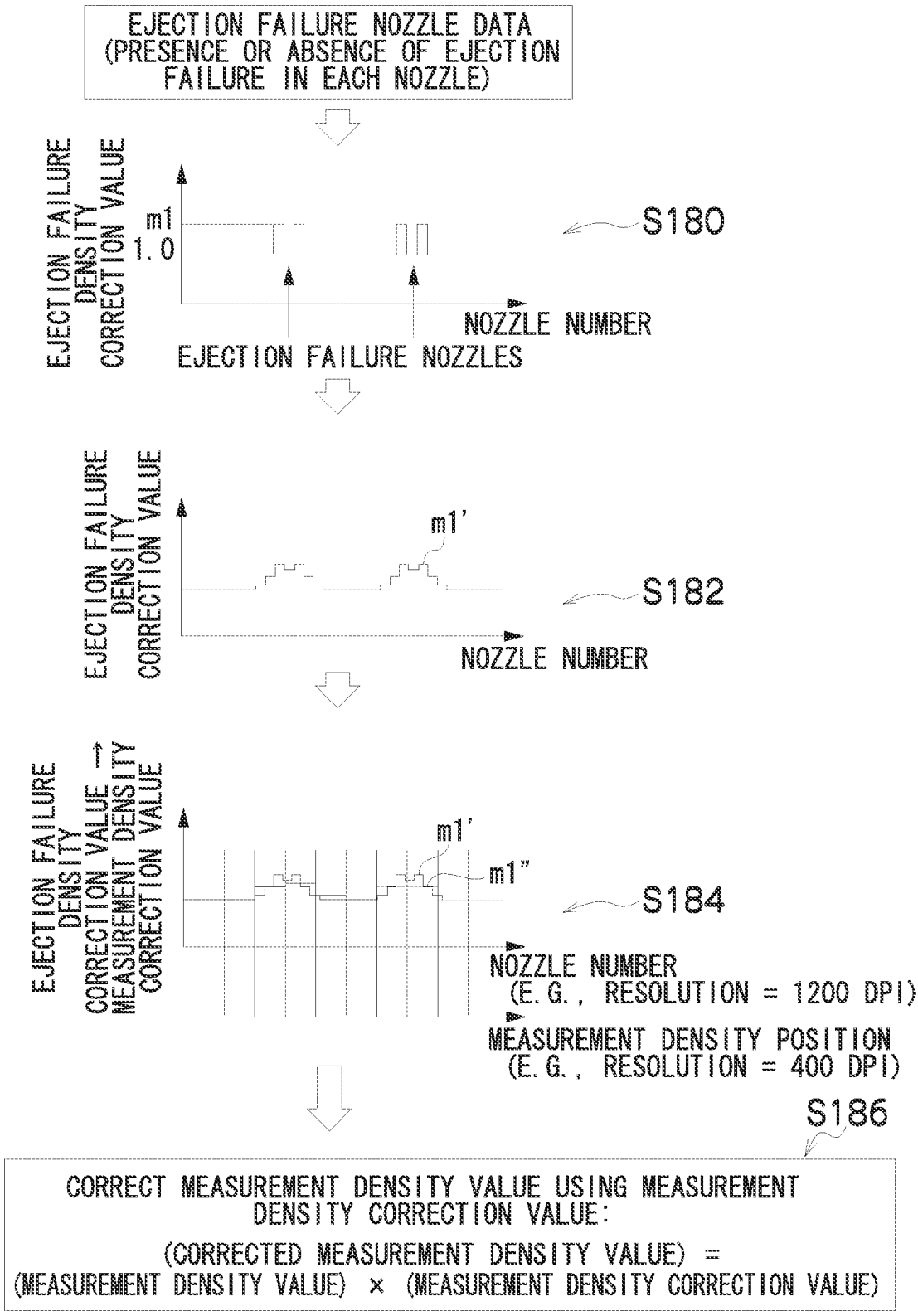
FIG. 24 is a diagram for describing the details of the density data correction processing in step S118 in FIG. 23.

FIG. 24 is a diagram for describing the details of the density data correction processing in step S118 in FIG. 23.

Firstly, ejection failure density correction values (m1) are set for the nozzles which are adjacent in the x direction with respect to a nozzle identified as an ejection failure nozzle (step S180). Here, the ejection failure density correction values (m1) are a value which is specified in advance by experimentation and is saved in the inkjet recording apparatus 100; m1≧1 (for example, m1=1.4 to 1.6). The value of m1 relating to nozzles other than the nozzles adjacent to an ejection failure nozzle is 1.0. Then, as indicated by m1' in FIG. 24, the ejection failure density correction values are smoothed in the x direction by means of a low-pass filter (LPF) or a moving average calculation (step S182).

The ejection failure density correction values m1' corresponding to the nozzle positions (nozzle numbers) are converted into measurement density correction values m1" for the pixel positions (measurement density positions) of the in-line determination unit 144 (step S184). In the embodiment shown in FIG. 24, in order to simplify the description, the nozzle density of the head 250 in the x direction is taken to be 1200 npi and the reading resolution of the in-line determination unit 144 in the x direction is taken to be 400 dpi. In this case, measurement density correction value is obtained by averaging the ejection failure density correction values (m1') in units of 3 (=1200/400) nozzles.

Thereupon, by using the measurement density correction values m" determined in step S184, the density data (measurement density values) is corrected as follows (step S186): "corrected density measurement value" ="measurement density value"×"measurement density correction value".

In the embodiment shown in FIG. 24, the measurement density correction value is set to a value greater than 1.0 in the measurement density positions including the ejection failure nozzles and the measurement density positions in the vicinity of same, whereby the measurement density value in the measurement density position is made higher by the correction process.

Next, the procedure advances to step S120 in FIG. 23, and density non-uniformity correction values (shading non-uniformity correction values) are calculated on the basis of the density data for the measurement density positions of the in-line determination unit 144 which have been corrected in step S118 (step S120).

Figure 25:
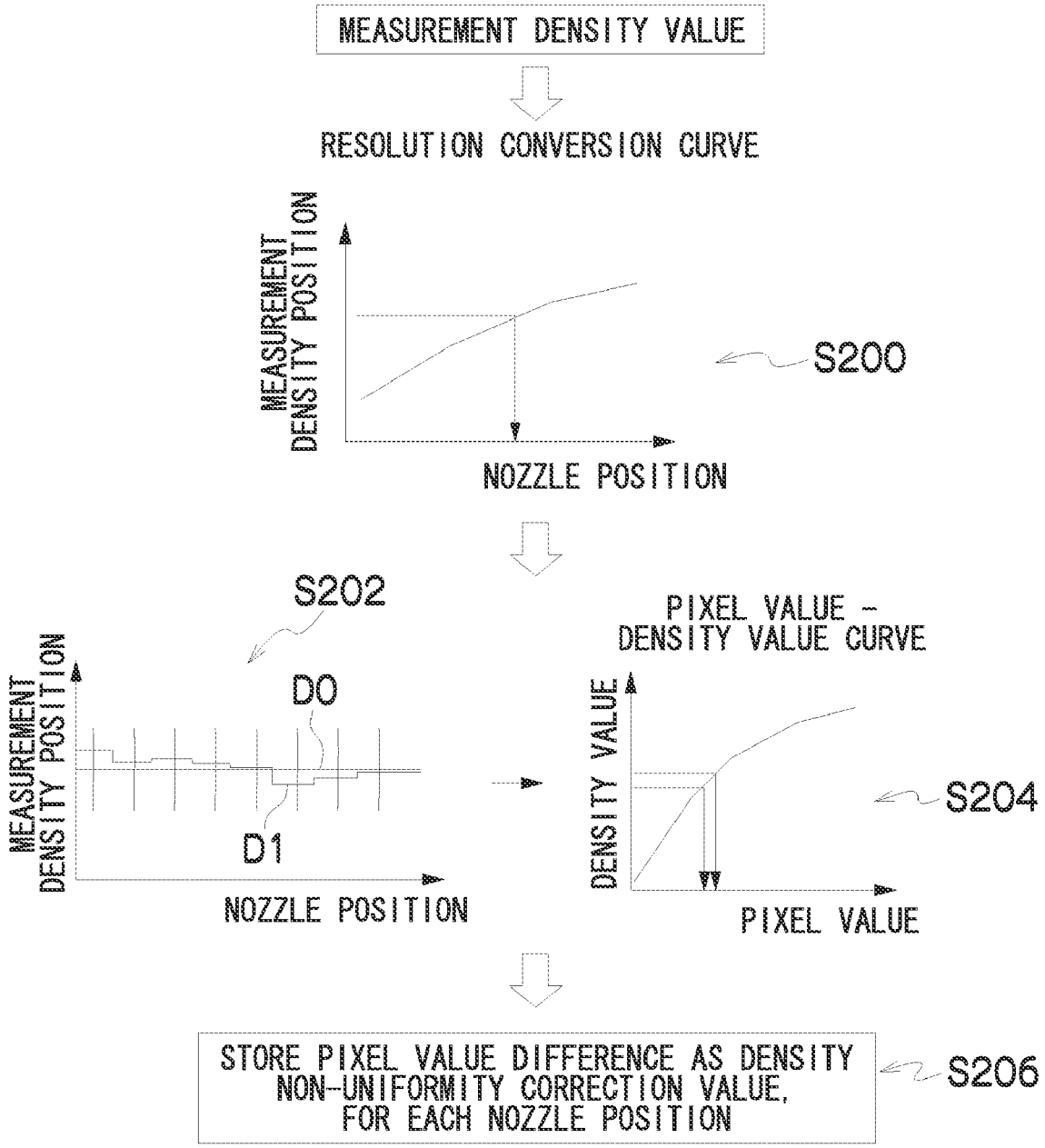
FIG. 25 is a diagram for describing the details of the process for calculating density non-uniformity correction values in step S120 in FIG. 23.

FIG. 25 is a diagram for describing the details of processing for calculating the density non-uniformity correction values in step S120 in FIG. 23.

As shown in FIG. 25, firstly, the measurement density values for the measurement density positions which have been corrected in step S118 are converted into density data for the nozzle positions (step S200), in accordance with a resolution conversion curve which represents the correspondence between the pixel positions (measurement density positions) of the in-line determination unit 144 and the nozzle positions.

Thereupon, the differences between the density data D1 for the nozzle positions obtained in step S200 and the target density value D0 are calculated (step S202).

Thereupon, the differences in the density values calculated in step S202 are converted to differences in pixel values, in accordance with the pixel value–density value curve showing the correspondence between the pixel values and the density values (step S204). These differences in the pixel values are stored in the image buffer memory 182 as density non-uniformity correction values for the nozzle positions (step S206).

Figure 26:
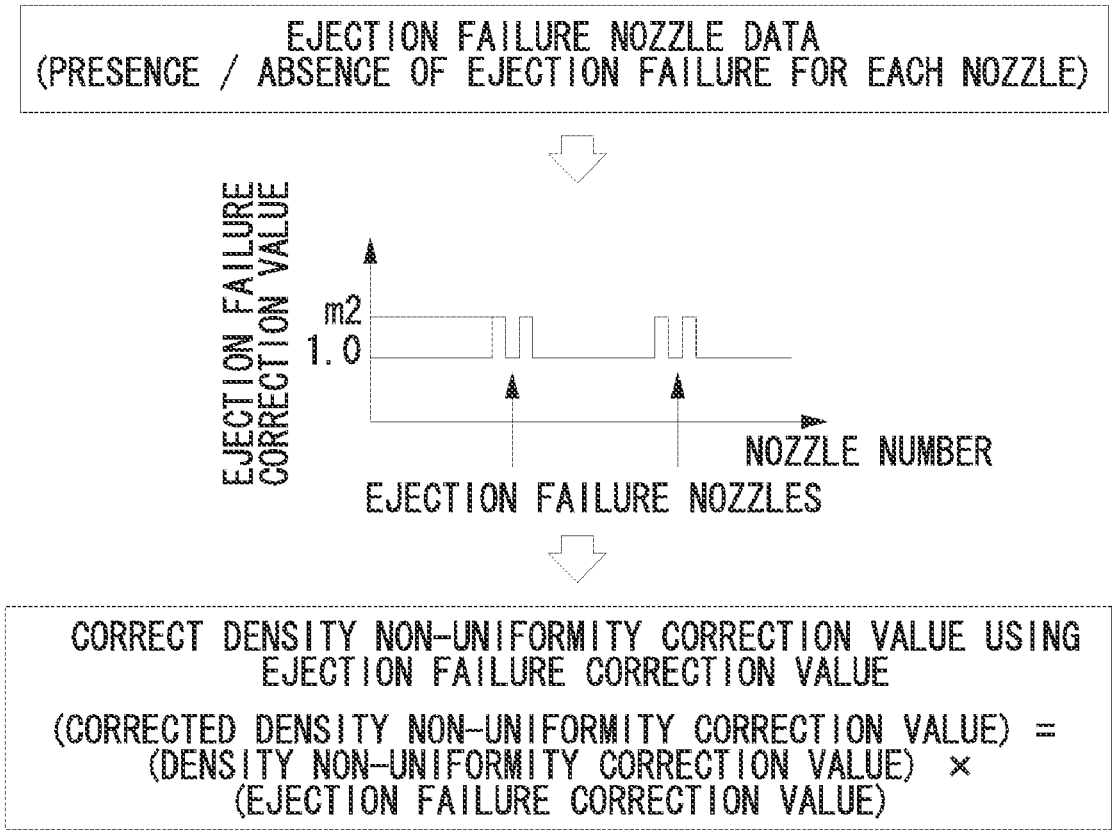
FIG. 26 is a diagram for describing the details of the processing in step S122 in FIG. 23.

Thereupon, the procedure advances to step S122 in FIG. 23 and, using the ejection failure nozzle data, the density non-uniformity correction values are corrected using the ejection failure correction values (step S122). In other words, as shown in FIG. 26, the ejection failure correction values (m2) are set in the nozzles which are adjacent to an ejection failure nozzle. Here, the ejection failure correction values (m2) are a value which is specified in advance by experimentation and is saved in the inkjet recording apparatus 100; m2≧1.0 (for example, m2=1.4 to 1.6). The value of m2 relating to nozzles other than the nozzles adjacent to the ejection failure nozzle is 1.0. Then, the density non-uniformity correction values are corrected as follows: "corrected density non-uniformity correction value"="density non-uniformity correction value"× "ejection failure correction value".

Instead of multiplying the density non-uniformity correction value by the ejection failure correction value, it is also possible to add the ejection failure correction value to the density non-uniformity correction value.

Next, output image data is generated by correcting the input image data using the density non-uniformity correction values (step S124 in FIG. 23). An image is formed on a recording medium by a subsequent image formation process, on the basis of the corrected output image data obtained in this way.

More specifically, after step S38 in FIG. 19, in step S40, it is judged whether or not the print job has been completed, and if it is not yet completed, the procedure returns to step S22 and image formation is carried out onto the next recording medium 114. When an image is formed on the image portion after correcting the image data in step S38, recording is performed using only the normal nozzles and without using the nozzles which have been determined as abnormal nozzles in the previous ejection defect detection operation (namely, by disabling the ejection of the abnormal nozzles).

In this way, the above-described processing (steps S22 to S40) is repeated until the print job is completed. When it is confirmed that the print job has been completed in step S40, then the printing is terminated (step S42).

As described above, while carrying out image recording in the image portion during continuous printing, a test chart is formed in the non-image portion, this test chart is read, and on-line correction is carried out on the basis of the test chart reading results.

According to the present embodiment, it is possible to carry out accurate density correction irrespectively of the resolution of the in-line determination unit 144 used to read the density measurement test chart, when correcting density non-uniformity caused by the presence of ejection failure nozzles. Furthermore, since the resolution of the in-line determination unit 144 can be reduced, then it is possible to lighten the processing load by reducing the volume of data relating to correction of density non-uniformity. Moreover, it is possible to use an inexpensive low-resolution unit for the in-line determination unit 144, and therefore the cost of the apparatus can be lowered.

Further Correction Methods

Next, further correction methods are described. The description given below does not explain the composition which is similar to the elements shown in FIGS. 19 to 26.

Figure 27:
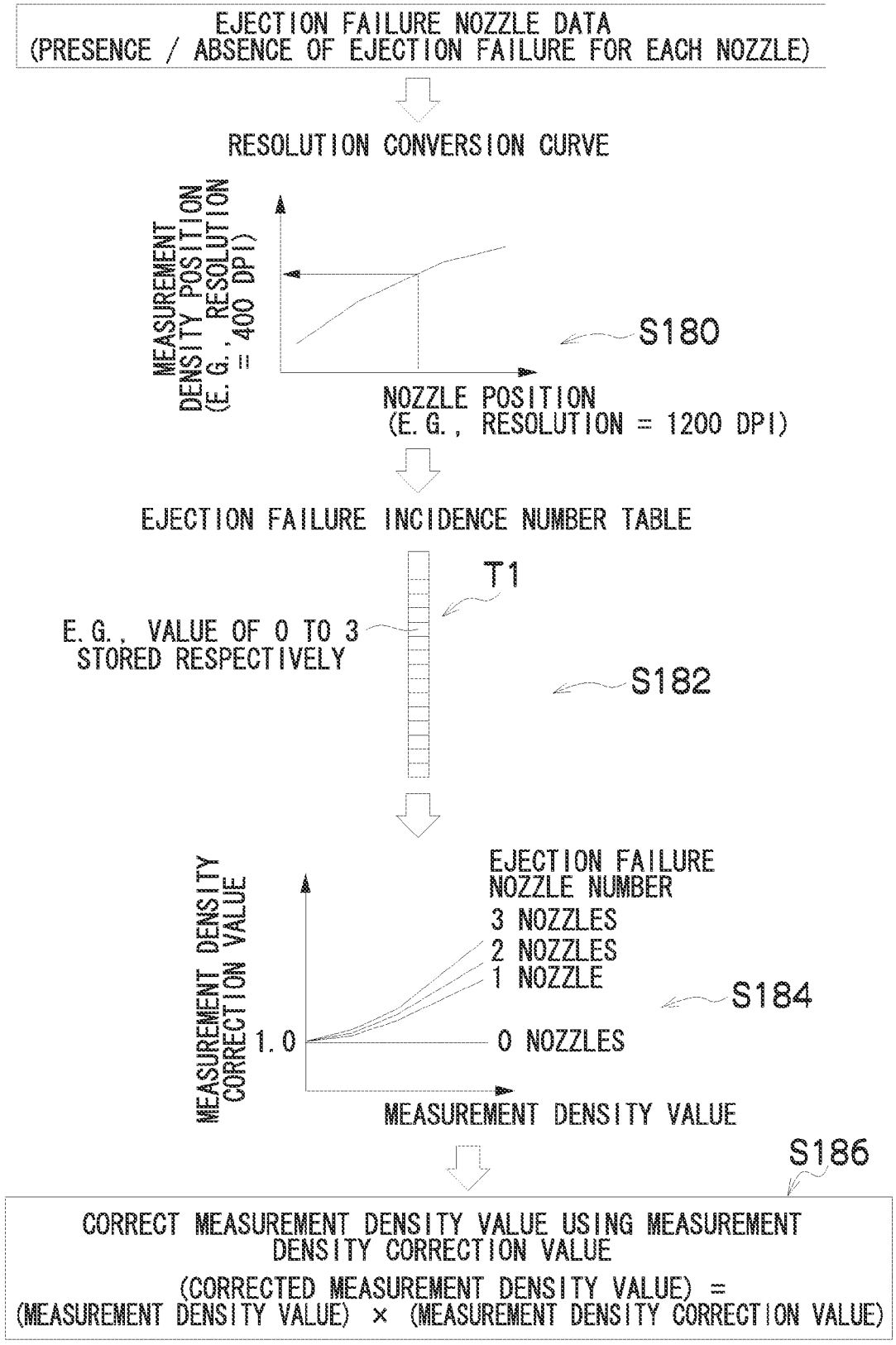
FIG. 27 is a diagram showing a further embodiment of density data correction processing in step S118 in FIG. 23.

FIG. 27 is a diagram showing the details of the density data correction processing in step S118 in FIG. 23.

As shown in FIG. 27, in the present embodiment, when correcting the density data, firstly the positions of ejection failure nozzles in the ejection failure nozzle data are converted to measurement density positions of the in-line determination unit 144, on the basis of the resolution conversion curve (step S180).

Thereupon, the number of ejection failure nozzles in the measurement density positions of the in-line determination unit 144 is determined on the basis of the ejection failure nozzle data newly acquired in step S30 in FIG. 19, and this number is stored in the ejection failure incidence number table T1 (step S182). In the embodiment shown in FIG. 27, since the nozzle density of the head 250 in the x direction is 1200 npi and the reading resolution of the in-line determination unit 144 in the x direction is 400 dpi, then a value of 0 to 3 is stored as ejection failure incidence number data for the respective measurement density positions in the ejection failure incidence number table T1.

Thereupon, the density data in the nozzle row direction is corrected on the basis of the ejection failure incidence number data (steps S184 and S186) as follows: "corrected density measurement value"="measurement density value"×"measurement density correction value".

Here, the measurement density correction value is a parameter which is specified by experimentation and is beforehand stored in the ROM 175 of the inkjet recording apparatus 100. In the embodiment shown in FIG. 25, the greater the number of ejection failure nozzles at the measurement density position, and the greater the measurement density value, the larger the measurement density correction value becomes. In other words, in step S186, the greater the number of ejection failure nozzles at the position in question, and the greater the measurement density value, the greater the extent to which the measurement density value (density data) after correction for the position in question is corrected so as to become a larger value.

According to the present embodiment, similarly to the embodiments described in FIGS. 23 to 26, it is possible to carry out accurate density correction irrespectively of the resolution of the in-line determination unit 144 used to read the density measurement test chart, when correcting density non-uniformity caused by the presence of ejection failure nozzles.

<Countermeasures in Cases Where a Large Number of Abnormal Nozzles are Detected>

In the steps described in S28 to S30 in FIG. 19, if the number of nozzles determined as abnormal nozzles exceeds a prescribed specific value, it is desirable that a warning should be issued to the user. For example, a warning message is displayed on the display unit 198 and a warning is issued to the user in respect of the need for head maintenance or the like.

Alternatively, a desirable mode is one in which instead of or in combination with the warning described above, control is automatically implemented for executing head maintenance. In this case, since it is necessary to move the head to the maintenance position, then printing is interrupted, and maintenance operations, such as pressurized purging, ink suctioning, dummy ejection, wiping of the nozzle surface, and the like, are carried out in the maintenance unit.

Flowchart of Non-uniformity Correction Sequence (Embodiment 2)

Figure 28:
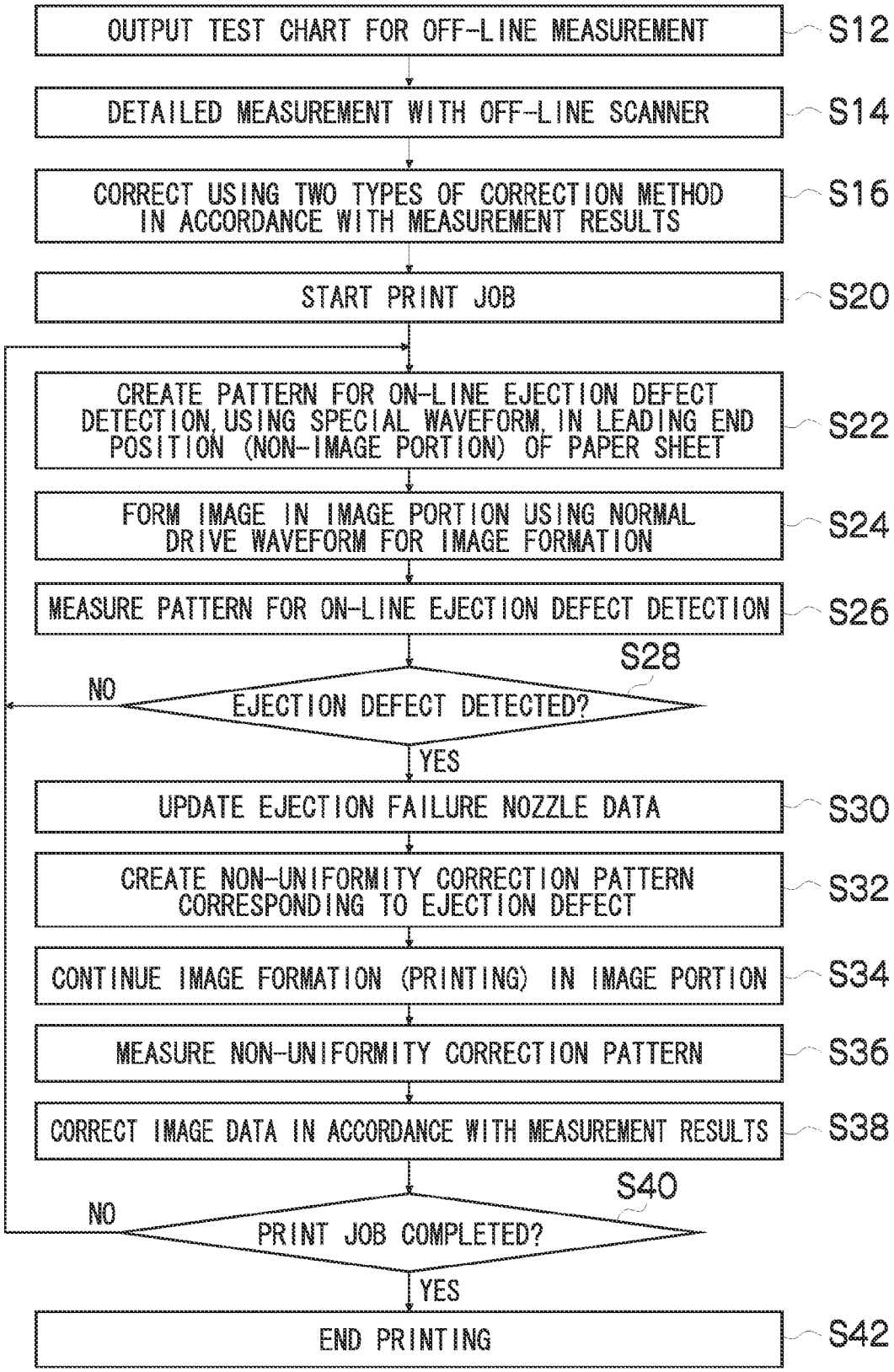
FIG. 28 is a flowchart showing a further embodiment of a non-uniformity correction sequence.

FIG. 28 is a flowchart showing a second embodiment of a non-uniformity correction sequence in the inkjet recording apparatus 100 according to an embodiment of the present invention. In FIG. 28, steps which are the same as or similar to those in the flowchart shown in FIG. 19 are denoted with the same step numbers and description thereof is omitted here.

The non-uniformity correction sequence shown in FIG. 28 performs advance correction off-line, instead of the advance correction using the in-line determination unit shown in FIG. 19. More specifically, the non-uniformity correction shown in FIG. 28 combines: advance correction (off-line correction) steps (steps S12 to S16) of acquiring correction data by measuring a test chart off-line before the start of continuous printing for a print job; and on-line correction steps (steps S20 to S40) for carrying out correction in an adaptive fashion while carrying out continuous printing (without interrupting printing), by measuring a test chart with the sensor inside the inkjet recording apparatus 100 (the in-line determination unit 144) during continuous printing.

As shown in FIG. 28, firstly, a test chart for off-line measurement is output (step S12), and the print results are measured in detail by means of an off-line scanner (not shown) (step S14). The test chart referred to here includes a line pattern suited to measurement of depositing position variation (deposition error) in each nozzle, a line pattern suited to identifying the positions of ejection failure nozzles, a density pattern suited to measurement of density non-uniformity, and the like. In the case of off-line measurement, it is possible to form the test pattern over the whole recording surface of the recording medium 114 (namely, on the image forming region and the non-image region).

It is possible to print a combination of these test patterns on one sheet of recording medium, and it is possible to print the elements of respective test patterns by dividing between a plurality of sheets of recording media. The print results of the test chart output in this way are read in using an image reading device, such as a flat bed scanner, and data of various kinds required for image correction and other processing, such as depositing error data showing depositing position error of each nozzle, ejection failure nozzle data identifying the positions of ejection failure nozzles, and the like, is generated. Desirably, the off-line scanner used has a higher resolution than the in-line determination unit 144 inside the inkjet recording apparatus 100.

The various data obtained in this way is input to the inkjet recording apparatus 100 through the communication interface or external storage medium (a removable medium) or the like.

In the inkjet recording apparatus 100, the results of this off-line measurement are used in the above-described two correction methods; specifically in the first correction method which corrects density non-uniformity caused by depositing error, and in the second correction method which corrects density non-uniformity caused by ejection failure nozzles.

The correction coefficient data, ejection failure nozzle data and depositing error data calculated respectively by the first correction method and the second correction method is stored in the storage device inside the inkjet recording apparatus 100 (and desirably, in the non-volatile storage device, for example, the ROM 175).

There are no particular restrictions on the timing at which the off-line measurement is carried out, but it is, for example, carried out at a frequency of once per day, when the inkjet recording apparatus 100 is started up, or the like. Moreover, when forming a test chart for off-line measurement, it is possible to use a drive signal having the recording waveform, and it is also possible to use a drive signal having the abnormal nozzle detective waveform. Furthermore, detailed measurement can be carried out by using both waveforms. However, desirably, a drive signal having the recording waveform is used for the test chart for measuring depositing position error.

The steps from step S20 onwards in the flowchart in FIG. 28 (steps S20 to S42) are the same as FIG. 19 and description thereof is omitted here.

Fine Adjustment of Drive Waveform Signals in Respective Heads

Due to their individual properties, the respective CMYK heads (or head modules) may produce different ejected droplet volumes or ejection velocities when the same drive signal is applied respectively thereto. Therefore, it is desirable to adopt a mode in which the waveform is adjusted finely for each head (or each head module).

For example, a correction parameter for correcting the abnormal nozzle detective waveform in respect of each head can be stored in the ROM 175, or the like, and this correction parameter can be used to correct the waveform of the drive signal applied to each head. Moreover, it is also possible to use this correction parameter as a correction parameter for the image formation (recording) waveform commonly.

To give one example of a specific method, a test pattern is formed in advance using an image formation (recording) waveform, for instance, upon dispatch of the inkjet recoding apparatus from the factory, and a correction parameter (for example, a waveform voltage magnification rate) is specified for each head on the basis of the measurement results for the density (or dot diameter) in the image. The information about the correction parameter is stored in the ROM 175, or the like, and is used to correct the waveform when driving ejection. Moreover, the correction parameter is also used to correct the abnormal nozzle detective waveform.

Further Embodiments of Abnormal Nozzle Detective Waveforms

Figure 29:
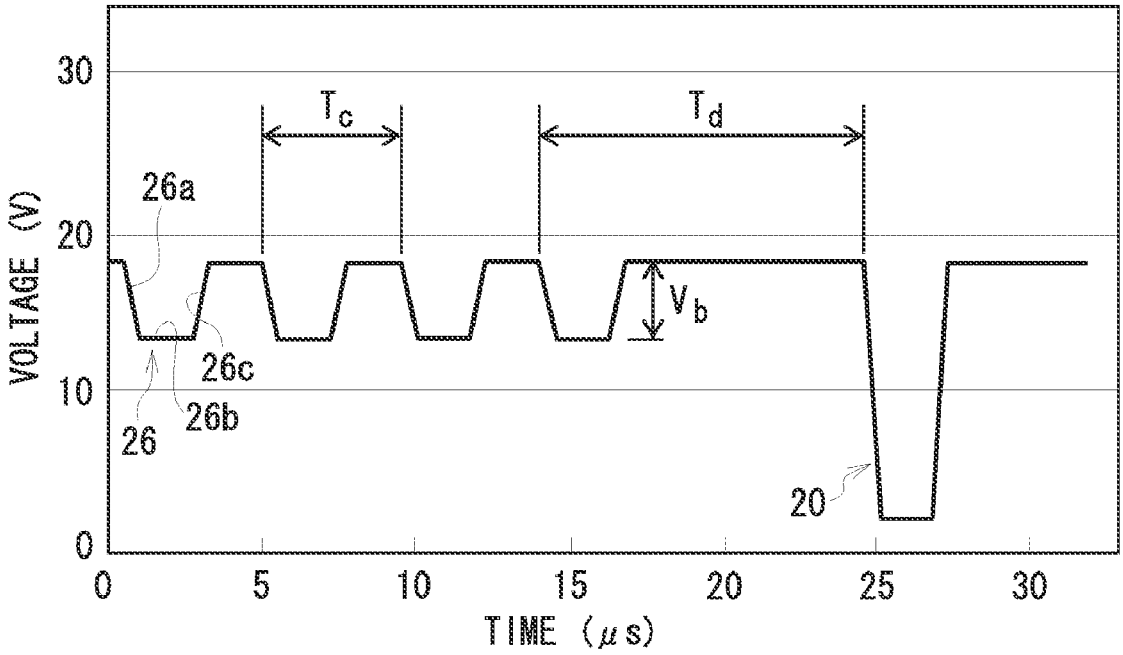
FIG. 29 is a waveform diagram showing a further embodiment of an abnormal nozzle detective waveform.
Figure 30:
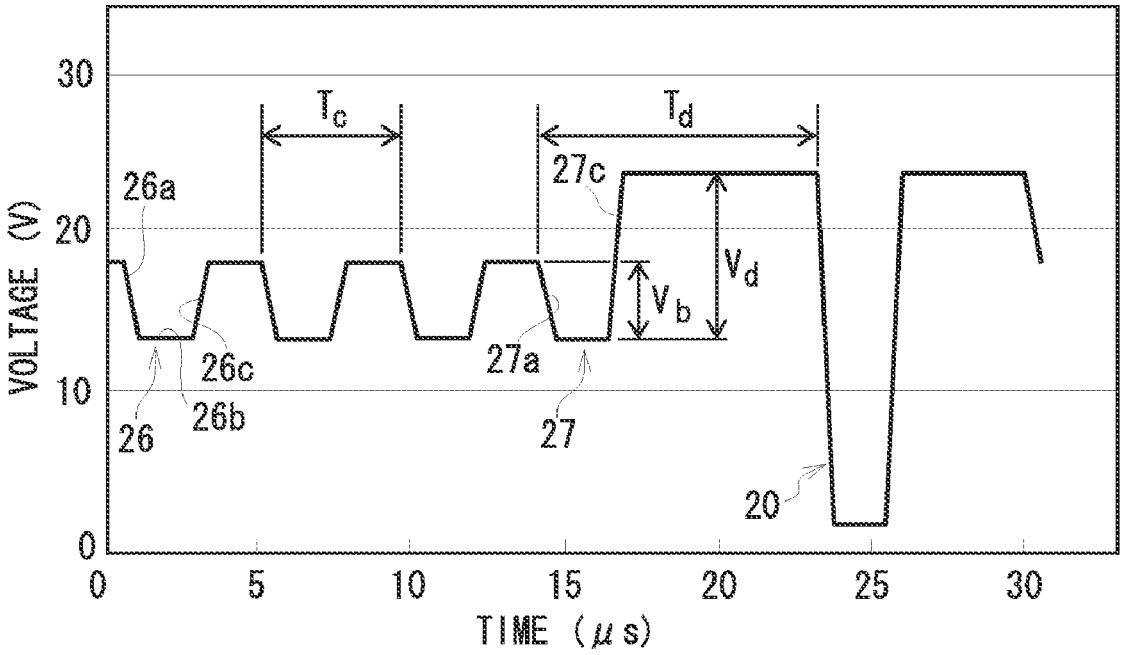
FIG. 30 is a waveform diagram showing a further embodiment of an abnormal nozzle detective waveform.

FIGS. 29 and 30 show further embodiments of abnormal nozzle detective waveforms. Each of FIGS. 29 and 30 shows the waveform of one print cycle (one period) for recording one dot (one pixel). It is possible to form a similar waveform using a plurality of print cycles.

The abnormal nozzle detective waveforms shown in FIGS. 29 and 30 are waveforms suited to detecting abnormal nozzles having external causes, but it is also possible to detect abnormal nozzles having internal causes by means of these waveforms.

The abnormal nozzle detective waveform shown in FIG. 29 is formed by adding, before the ejection pulse 20, a waveform in which two or more pulses 26 that do not produce ejection (hereinafter referred to as "non-ejection pulses") are applied consecutively as the waveform for causing ink to overflow from the nozzle prior to ink ejection (in order to increase the volume of ink swelling from the nozzle).

The non-ejection pulse 26 shown in FIG. 29 is constituted of: a signal element 26*a*, which reduces the potential from the reference potential (a portion for expanding the pressure chamber); a signal element 26*b*, which maintains the potential that has been reduced by the signal element 26*a;* and a signal element 26*c*, which raises the potential of the signal element 26*b* up to the reference potential (a portion for compressing the pressure chamber). The consecutive non-ejection pulses 26 are repeated at the head resonance period $T_c$.

Moreover, the interval (pulse period) $T_d$ between the consecutive non-ejection pulses 26 and the ejection pulse 20 is desirably longer than the head resonance period $T_c$,taking account of the time taken by the ink (meniscus) which has been caused to swell by the refilling action to be pulled inside the nozzle. In the embodiment in FIG. 29, $T_d=2\times T_c$.

By applying the consecutive non-ejection pulses 26 as in FIG. 29, it is possible to cause overflow of the ink from the nozzle. If a composition where two or more non-ejection pulses are applied consecutively is called "consecutive shots" for the sake of convenience, then by causing the meniscus to vibrate repeatedly by means of the consecutive shots, it is possible to break down the meniscus (cause the ink to overflow outside the nozzle) while the ink is in the form of a thick pillar. In other words, overflowing of the ink from the nozzle occurs due to the whole of the meniscus swelling as a result of the vibration of the meniscus caused by the consecutive shots. If the water-repelling film on the outside of the nozzle has deteriorated partially, then the amount of overflow becomes greater than normal, and the ejection state from the nozzle in question becomes abnormal.

Similarly to the embodiment shown in FIG. 11, the potential difference $V_b$ of the non-ejection pulse 26 in FIG. 29 is adjusted to a smaller value than the potential difference of the ejection pulse 20. In FIG. 11, desired effects are obtained by applying the pulse 24 whereby the ejection velocity becomes virtually zero with one pulse (independent pulse). However, in the composition in FIG. 11, if there is variation in the nozzle diameters or variation in the piezoelectric elements within one head module in which the same waveform is used, then it is envisaged that there are cases where the variations in the ejection elements are not tolerated, for instance, a droplet of the ink may be ejected due to the application of the first pulse 24 having this waveform.

In contrast to this, by adopting the composition which produces overflowing of the ink from the nozzle by applying the consecutive non-ejection pulses 26 as in FIG. 29, it is possible to gradually increase the vibration of the meniscus, and hence the meniscus can be caused to naturally break down.

The potential difference $V_b$ of the non-ejection pulses 26 in FIG. 29 can be set to a smaller value than the potential difference $V_a$ of the first pulse 24 in FIG. 11, and therefore a merit is obtained in that manufacturing variation in the head, such as variation in the nozzle diameters, can be tolerated to some extent in the embodiment in FIG. 29, compared to the embodiment in FIG. 11. FIG. 29 shows the embodiment in which four non-ejection pulses 26 are applied consecutively, but the shape and the number of the consecutive non-ejection pulses 26 is not limited to the embodiment in FIG. 29.

FIG. 30 is a further embodiment of an abnormal nozzle detective waveform. The waveform shown in FIG. 30 can be used instead of the abnormal nozzle detective waveform shown in FIG. 29. In the abnormal nozzle detective waveform shown in FIG. 30, a non-ejection pulse 27 that is applied immediately before the ejection pulse 20 is constituted of a signal element 27*c*, which is a portion for compressing the pressure chamber and has the potential difference $V_d$ greater than the potential difference $V_b$ of a signal element 27*a*, which is a portion for expanding the pressure chamber.

By using the waveform shown in FIG. 30, it is possible to further increase the amount of ink overflowing from the nozzle in comparison with FIG. 29. A composition which increases the amount of overflow by making the potential difference of the pressure chamber compressing portion of a non-ejection pulse that is applied immediately before an ejection pulse greater than the potential difference of the pressure chamber expanding portion also has beneficial effects in cases other than the consecutive shot method. For example, it is also possible that the first pulse 24 in FIG. 11 employs a similar composition to the non-ejection pulse 27 in FIG. 30.

Furthermore, it is also possible to adopt a mode which uses a waveform in which the ink is swollen from the nozzle by means of the consecutive shots as shown in FIGS. 29 and 30, and the ejection velocity is slower than the recording waveform.

Figure 31:
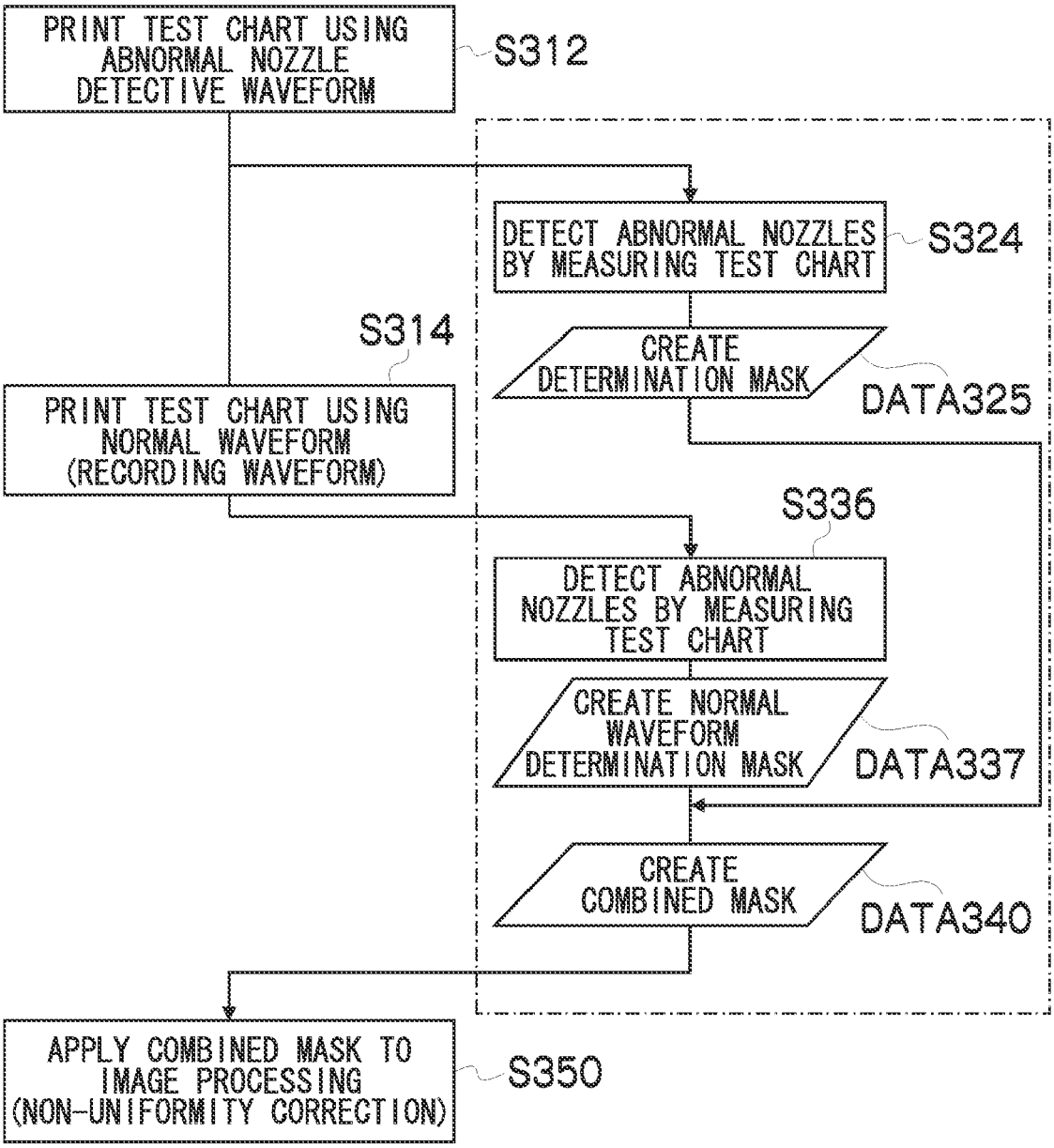
FIG. 31 is a flowchart showing a further embodiment of advance correction processing employed in the inkjet recording apparatus.

Further flowcharts of Advance Correction Processing FIG. 31 is a flowchart showing a further embodiment of advance correction processing employed in the inkjet recording apparatus 100. The advance correction processing shown in FIG. 31 can be employed instead of the advance correction processing shown in step S11 in FIG. 19 and in steps S12 to S16 in FIG. 28.

When printing is started by the inkjet recording apparatus 100, firstly, a test chart (a test chart for detecting ejection defect nozzles) is printed using the abnormal nozzle detective waveform in step S312 in FIG. 31, as advance correction processing. Desirably, this test chart printing step uses the abnormal nozzle detective waveform such as that shown in FIGS. 7 to 11, 28 and 29 (and in particular, the abnormal nozzle detective waveform that is suited to the detection of causes that are external to the nozzles).

The test chart output in step S312 is read in by an optical reading device (here, an off-line scanner is used), and the image data thus read in is analyzed to detect ejection defect nozzles (step S324).

An ejection defect nozzle determined to have an abnormality (ejection defect) in step S324 is a nozzle that either is already in an ejection defect state (including ejection failure), or has a high probability of producing defective ejection during printing, and therefore, when executing a print job, such nozzles are disabled for ejection (masked) so as not to be used for printing. Consequently, information (DATA 325) on the nozzles that are not to be used in printing is created from the detection results for ejection defect nozzles obtained in step S324. This information on nozzles which are the object of ejection disabling (in other words, information on masked nozzle positions) is called a "determination mask" (DATA 325) below.

Following the printing of the test chart (first test chart) in step S312, a second test chart (a test chart for detecting ejection defect nozzles) is printed using the normal waveform (recording waveform) (step S314). In the printing of the test chart in step S314, the recording waveform that is employed in normal image formation is used.

The test chart output in step S314 is read in by the optical reading device (here, the off-line scanner is used), and the image data thus read in is analyzed to detect ejection defect nozzles (step S336).

An ejection defect nozzle which is determined to have an abnormality (ejection defect) in step S336 is disabled for ejection so as not to be used in printing when executing a print job. Consequently, information (DATA 337) on the nozzles that are not to be used in printing is created from the detection results for ejection defect nozzles obtained in step S336. This information on nozzles which are the object of ejection disabling (in other words, information on masked nozzle positions) is called a "normal waveform determination mask" (DATA 337) below.

It is thought that the determination mask (DATA 325) acquired from the determination of the test chart using the abnormal nozzle detective waveform includes the information on the normal waveform determination mask (DATA 337). However, there are cases where the number of detected abnormal nozzles may increase or decrease due to variation in the effectiveness of maintenance process (not shown) (such as wiping of the nozzle surface, advance ejection or a combination of these, for example), which are carried out before step S312, or between step S312 and step S314.

Therefore, in the mode shown in FIG. 31, a combined mask (DATA 340) which is the logical sum (OR) of the determination mask (DATA 325) and the normal waveform determination mask (DATA 337) is created, and image processing such as ejection failure correction (non-uniformity correction), and the like, is carried out using this combined mask (DATA 340) (step S350). For example, a correction coefficient for ejection failure correction is specified using the combined mask (DATA 340), and this correction coefficient is applied for the input image data for printing. Printing data is generated which reduces the visibility of image formation defects caused by the non-ejecting nozzles, by compensating for the image formation defects caused by the non-ejecting nozzles (masked nozzles), by means of image formation by other adjacently positioned nozzles. A print job is carried out on the basis of this corrected print data (see step S20 onward in FIG. 19 and FIG. 28).

Thus, the inkjet recording apparatus employing the processing shown in FIG. 31 acquires the information on the abnormal nozzles by using the combination of the normal waveform, which is used in image recording during the normal printing operation, and the abnormal nozzle detective waveform, which is used only in a particular region or at a particular timing, for instance, when printing the test pattern (chart) for detecting abnormal nozzles, and restricts the use of (disables ejection from) nozzles which have a high possibility of producing defective ejection during the execution of a print job, as well as carrying out correction of the output image.

In the processing flow in FIG. 31, in step S312, only one type of the abnormal nozzle detective waveform is used; however, it is also possible to form similar test patterns respectively using the abnormal nozzle detective waveforms of a plurality of types, to acquire corresponding mask information (ejection defect nozzle information), and to form a combined mask from this mask information. In other words, in the advance correction processing in FIG. 31, at least one abnormal nozzle detective waveform is used in addition to the waveform employed in the normal image formation (normal waveform), as a waveform for detecting abnormal nozzles.

In the description given above, the embodiment has been described in which respective test patterns output at steps S312 and S314 are read in by the off-line operation; however, it is also possible to adopt a mode in which the test patterns are read in by the in-line operation, using the in-line determination unit 144 in FIG. 12. In this case, processing devices for the respective steps surrounded by the dotted line in FIG. 31 are mounted in the printer (inkjet recording apparatus), and all of the processing from step S312 to S350 is incorporated into the control sequence of the printer.

Example of Application to Other Apparatuses

In the embodiments described above, application to the inkjet recording apparatus for graphic printing has been described, but the scope of application of the present invention is not limited to this. For example, the present invention can also be applied widely to inkjet systems which obtain various shapes or patterns using liquid function material, such as a wire printing apparatus, which forms an image of a wire pattern for an electronic circuit, manufacturing apparatuses for various devices, a resist printing apparatus, which uses resin liquid as a functional liquid for ejection, a color filter manufacturing apparatus, a fine structure forming apparatus for forming a fine structure using a material for material deposition, or the like. It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an inkjet head which includes a plurality of nozzles through which droplets of liquid are ejected and a plurality of pressure generating elements corresponding to the nozzles;

a conveyance device which conveys a recording medium;

a recording waveform signal generating device which generates a drive signal having a recording waveform which is applied to the pressure generating elements when recording a desired image on the recording medium by means of the inkjet head;

an abnormal nozzle detective waveform signal generating device which generates a drive signal having an abnormal nozzle detective waveform including a waveform that is different from the recording waveform and applied to the pressure generating elements when performing ejection for abnormality detection to detect an abnormal nozzle among the nozzles in the inkjet head;

a detective ejection control device which causes the ejection for abnormality detection to be performed from the nozzles by applying the drive signal having the abnormal nozzle detective waveform to the pressure generating elements, in a state where the inkjet head is disposed in a head position which enables deposition of the ejected droplets onto the recording medium;

an abnormal nozzle detective device which identifies the abnormal nozzle showing an ejection abnormality from results of the ejection for abnormality detection;

a correction control device which corrects image data in such a manner that ejection is stopped from the identified abnormal nozzle and the desired image is recorded by the nozzles other than the abnormal nozzle; and a recording ejection control device which performs image recording by controlling ejection from the nozzles other than the abnormal nozzle in accordance with the image data that has been corrected by the correction control device;

wherein the abnormal nozzle detective waveform includes a waveform which increases a volume of the liquid swelling from the nozzles compared to the recording waveform.

2. The inkjet recording apparatus as defined in claim 1, wherein:

the desired image is recorded on an image forming region of the recording medium; and the ejection for abnormality detection is performed so as to deposit the ejected droplets onto a non-image region of the recording medium outside the image forming region.

3. The inkjet recording apparatus as defined in claim 2, wherein at least one of a test pattern for abnormal nozzle detection and a test pattern for density non-uniformity correction is formed in the non-image region on the recording medium.

4. The inkjet recording apparatus as defined in claim 1, wherein the nozzles are respectively connected to corresponding pressure chambers, and a volume of each of the pressure chambers is changed by driving corresponding one of the pressure generating elements.

5. The inkjet recording apparatus as defined in claim 1, wherein the abnormal nozzle detective waveform includes a waveform which reduces an ejection velocity compared to the recording waveform.

6. The inkjet recording apparatus as defined in claim 5, wherein the waveform which reduces the ejection velocity compared to the recording waveform includes at least one of a waveform having a smaller potential difference than the recording waveform, a waveform having a modified pulse width in comparison with a pulse of the recording waveform, a waveform having a modified pulse gradient in comparison with the pulse of the recording waveform, and a waveform in which a pre-pulse of a potential difference that does not cause ejection is added by $(T_c/2)\times n$ before an application of an ejection pulse, where $T_c$ is a head resonance period and n is a natural number.

7. The inkjet recording apparatus as defined in claim 1, wherein the waveform which increases the volume of the liquid swelling from the nozzles compared to the recording waveform includes at least one of a waveform having a larger potential difference than the recording waveform, a waveform in which a signal element compressing the pressure chamber to an extent that does not produce ejection is added before ejection, a waveform in which at least two pulses in which a signal element compressing the pressure chamber to an extent that does not produce ejection is added before ejection are applied consecutively at a time interval of $T_c\times n$, where $T_c$ is a head resonance period and n is a natural number, a waveform which applies another pulse of a potential difference that does not produce ejection before application of the ejection pulse, and a waveform which performs ejection by applying a subsequent second pulse after causing the liquid to overflow from the nozzle by applying a first pulse which does not normally produce ejection when the first pulse is applied alone.

8. The inkjet recording apparatus as defined in claim 1, wherein the abnormal nozzle detective waveform is selectable from at least two types of waveforms.

9. The inkjet recording apparatus as defined in claim 8, wherein at least one of the at least two types of waveforms includes a waveform which reduces an ejection velocity compared to the recording waveform.

10. The inkjet recording apparatus as defined in claim 8, wherein at least one of the at least two types of waveforms includes a waveform which increases a volume of the liquid swelling from the nozzles compared to the recording waveform.

11. The inkjet recording apparatus as defined in claim 1, wherein the abnormal nozzle detective waveform includes a waveform which reduces an ejection velocity compared to the recording waveform, and a waveform which increases a volume of the liquid swelling from the nozzles compared to the recording waveform.

12. The inkjet recording apparatus as defined in claim 1, wherein the abnormal nozzle detective device includes an optical sensor which optically determines the results of the ejection for abnormality detection.

13. The inkjet recording apparatus as defined in claim 12, wherein the optical sensor is an image reading device which is disposed to face the conveyance device which conveys the recording medium after image formation by the inkjet head, the image reading device reading a recording surface of the recording medium during conveyance by the conveyance device.

14. The inkjet recording apparatus as defined in claim 13, wherein advance detection by the optical sensor and advance correction using results of the advance detection are carried out before recording the desired image on the recording medium, and detection by the optical sensor and correction using results of the detection are carried out during the recording of the desired image.

15. The inkjet recording apparatus as defined in claim 14, wherein a plurality of types of waveforms are used as the abnormal nozzle detective waveform in the advance detection, and one type of waveform is used as the abnormal nozzle detective waveform in the detection during the recording of the desired image.

16. The inkjet recording apparatus as defined in claim 13, further comprising a second optical sensor having detection characteristics that are different from the optical sensor disposed to face the conveyance device.

17. The inkjet recording apparatus as defined in claim 16, wherein the second optical sensor has a different resolution to the optical sensor disposed to face the conveyance device.

18. The inkjet recording apparatus as defined in claim 16, wherein:

the second optical sensor is an off-line image reading device which reads offline the recording surface on the recording medium; and advance detection by the second optical sensor and advance correction using results of the advance detection are carried out before recording the desired image on the recording medium, and detection by the optical sensor and correction using results of the detection are carried out during the recording of the desired image.

19. The inkjet recording apparatus as defined in claim 18, wherein a plurality of types of waveforms are used as the abnormal nozzle detective waveform in the advance detection, and one type of waveform is used as the abnormal nozzle detective waveform in the detection during recording of the desired image.

20. The inkjet recording apparatus as defined in claim 12, further comprising:

an information storage device which stores information specifying criteria for judging whether or not there is an ejection abnormality with respect to information obtained from the optical sensor, wherein the abnormal nozzle showing the ejection abnormality is identified in accordance with the criteria.

21. The inkjet recording apparatus as defined in claim 20, wherein a plurality of image quality modes are prepared, and the inkjet recording apparatus further comprises a control device which changes the criteria in accordance with one of the image quality modes that is set.

22. The inkjet recording apparatus as defined in claim 1, further comprising a warning output device which outputs a warning in accordance with number of nozzles that have been determined as abnormal.

23. The inkjet recording apparatus as defined in claim 1, further comprising a maintenance control device which implements control for carrying out a maintenance operation of the inkjet head in accordance with number of nozzles that have been determined as abnormal.

24. The inkjet recording apparatus as defined in claim 1, wherein the abnormal nozzle detective waveform includes a waveform which applies an ejection pulse capable of causing ejection of the droplet from the nozzle, and at least one non-ejection pulse which causes a meniscus of the liquid to swell to an extent which ejects no droplet from the nozzle, before application of the ejection pulse.

25. The inkjet recording apparatus as defined in claim 24, wherein the abnormal nozzle detective waveform further includes a waveform which applies the non-ejection pulse consecutively at a head resonance period $T_c$, in order to cause the meniscus of the liquid to swell, before the application of the ejection pulse.

26. The inkjet recording apparatus as defined in claim 24, wherein the non-ejection pulse includes a portion which causes a pressure chamber provided corresponding to the nozzle to expand, and a portion which causes the pressure chamber to contract, a potential difference of the portion which causes the pressure chamber to contract being greater than a potential difference of the portion which causes the pressure chamber to expand.

27. The inkjet recording apparatus as defined in claim 24, wherein a pulse period between the ejection pulse and the non-ejection pulse applied immediately before the ejection pulse in the abnormal nozzle detective waveform is not shorter than a head resonance period $T_c$.

28. An inkjet recording method, comprising:

a recording waveform signal generating step of generating a drive signal having a recording waveform which is applied to pressure generating elements when recording a desired image on a recording medium by means of an inkjet head including a plurality of nozzles through which droplets of liquid are ejected and the pressure generating elements corresponding to the nozzles;

an abnormal nozzle detective waveform signal generating step of generating a drive signal having an abnormal nozzle detective waveform including a waveform that is different from the recording waveform and applied to the pressure generating elements when performing ejection for abnormality detection to detect an abnormal nozzle among the nozzles in the inkjet head;

a detective ejection control step of causing the ejection for abnormality detection to be performed from the nozzles by applying the drive signal having the abnormal nozzle detective waveform to the pressure generating elements, in a state where the inkjet head is disposed in a head position which enables deposition of the ejected droplets onto the recording medium;

an abnormal nozzle detection step of identifying an abnormal nozzle showing an ejection abnormality from results of the ejection for abnormality detection;

a correction control step of correcting image data in such a manner that ejection is stopped from the identified abnormal nozzle and the desired image is recorded by the nozzles other than the abnormal nozzle; and a recording ejection control step of performing image recording by controlling ejection from the nozzles other than the abnormal nozzle in accordance with the image data that has been corrected by the correction control step;

wherein the abnormal nozzle detective waveform includes a waveform which increases a volume of the liquid swelling from the nozzles compared to the recording waveform.

29. An inkjet recording apparatus, comprising:

an inkjet head which includes a plurality of nozzles through which droplets of liquid are ejected and a plurality of pressure generating elements corresponding to the nozzles;

a conveyance device which conveys a recording medium;

a recording waveform signal generating device which generates a drive signal having a recording waveform which is applied to the pressure generating elements when recording a desired image on the recording medium by means of the inkjet head;

a first abnormal nozzle detective waveform signal generating device which generates a drive signal having a first abnormal nozzle detective waveform including a waveform that reduces an ejection velocity compared to the recording waveform and is applied to the pressure generating elements when performing ejection for abnormality detection to detect an abnormal nozzle among the nozzles in the inkjet head;

a second abnormal nozzle detective waveform signal generating device which generates a drive signal having a second abnormal nozzle detective waveform including a waveform that increases a volume of the liquid swelling from the nozzles compared to the recording waveform and is applied to the pressure generating elements when performing ejection for abnormality detection to detect an abnormal nozzle among the nozzles in the inkjet head;

a detective ejection control device which causes the ejection for abnormality detection to be performed from the nozzles by applying one of the drive signal having the first abnormal nozzle detective waveform and the drive signal having the second abnormal nozzle detective waveform to the pressure generating elements; and an abnormal nozzle detective device which identifies the abnormal nozzle showing an ejection abnormality from results of the ejection for abnormality detection.

30. An abnormal nozzle detection method, comprising:

a first abnormal nozzle detective waveform signal generating step of generating, separately from a drive signal having a recording waveform which is applied to pressure generating elements when recording a desired image on a recording medium by means of an inkjet head including a plurality of nozzles through which droplets of liquid are ejected and the pressure generating elements corresponding to the nozzles, a drive signal having a first abnormal nozzle detective waveform including a waveform that reduces an ejection velocity compared to the recording waveform and is applied to the pressure generating elements when performing ejection for abnormality detection to detect an abnormal nozzle among the nozzles in the inkjet head;

a second abnormal nozzle detective waveform signal generating step of generating a drive signal having a second abnormal nozzle detective waveform including a waveform that increases a volume of the liquid swelling from the nozzles compared to the recording waveform and is applied to the pressure generating elements when performing ejection for abnormality detection to detect an abnormal nozzle among the nozzles in the inkjet head;

a detective ejection control step of causing the ejection for abnormality detection to be performed from the nozzles by applying one of the drive signal having the first abnormal nozzle detective waveform and the drive signal having the second abnormal nozzle detective waveform to the pressure generating elements; and an abnormal nozzle detection step of identifying the abnormal nozzle showing an ejection abnormality from results of the ejection for abnormality detection.

* * * * *